US010350771B2

(12) United States Patent
Perlberg et al.

(10) Patent No.: US 10,350,771 B2
(45) Date of Patent: Jul. 16, 2019

(54) SHAVING APPARATUS

(71) Applicant: Hybrid Razor LTD, Rosh Haayin (IL)

(72) Inventors: Gil Perlberg, Zichron Yaakov (IL); Beni Nachon, Qiriat-Ata (IL); Shoham Zak, Givat Ela (IL); Gitay Kryger, Rosh Haayin (IL); Tsafrir Ben-Ari, Shimshit (IL)

(73) Assignee: Hybrid Razor LTD

( * ) Notice: Subject to any disclaimer, the term of this patent is extended or adjusted under 35 U.S.C. 154(b) by 0 days.

(21) Appl. No.: 15/119,821

(22) PCT Filed: Feb. 18, 2015

(86) PCT No.: PCT/IB2015/000669

§ 371 (c)(1),
(2) Date: Aug. 18, 2016

(87) PCT Pub. No.: WO2015/125021

PCT Pub. Date: Aug. 27, 2015

(65) Prior Publication Data

US 2017/0057103 A1 Mar. 2, 2017

Related U.S. Application Data

(63) Continuation-in-part of application No. PCT/IB2014/001886, filed on May 19, 2014.
(Continued)

(51) Int. Cl.

| | |
|---|---|
| ***B26B 19/18*** | (2006.01) |
| ***B26B 19/38*** | (2006.01) |
| ***B26B 21/34*** | (2006.01) |

(52) U.S. Cl.
CPC ..... *B26B 19/18* (2013.01); *B26B 19/388* (2013.01); *B26B 21/34* (2013.01)

(58) Field of Classification Search
CPC ..... B26B 19/16; B26B 19/18; B26B 19/388
(Continued)

(56) References Cited

U.S. PATENT DOCUMENTS 911,472 A * 2/1909 Brunacci ..... B26B 19/042 30/43.6
1,420,943 A * 6/1922 Philp ..... B26B 19/18 30/43.6

(Continued)

FOREIGN PATENT DOCUMENTS

CA 2787348 A1 * 7/2011 ..... B26B 19/18
CA 2787348 C * 5/2015 ..... B26B 19/18

(Continued)

OTHER PUBLICATIONS

Corresponding International Search Report for PCT/IB2014/001886 dated Jan. 16, 2015. WO.

(Continued)

*Primary Examiner* — Jason Daniel Prone
(74) *Attorney, Agent, or Firm* — The Belles Group, P.C.

(57) ABSTRACT

A shaving apparatus (1000) is disclosed in which a rotary cutter (1300) and a fixed blade (350) are used to shear a user's hairs therebetween during a shaving process. Various advancements are disclosed herein, including without limitation accurate positioning of the fixed blade in the head (200A) relative to the contact apex of the rotary cutter, bi-directional rotation of the rotary cutter, a cover-blade assembly for detachable coupling and decoupling from a base component of the head, the use of contact rollers on the head to treat and/or prep the skin and/or hairs for shearing, and a rotary cutter configured to pinch, pull and shear hairs.

19 Claims, 33 Drawing Sheets

Related U.S. Application Data

(60) Provisional application No. 61/941,240, filed on Feb. 18, 2014.

(58) Field of Classification Search
USPC ..... 30/43.4–43.6
See application file for complete search history.

(56) References Cited

U.S. PATENT DOCUMENTS 1,436,960 A * 11/1922 Jakubiec ..... B26B 19/30 30/42
1,981,202 A * 11/1934 Shipman ..... B26B 19/18 30/43.6
2,096,379 A 10/1937 Peak
2,127,881 A * 8/1938 Morris ..... B26B 21/20 30/32
2,186,092 A * 1/1940 Benner ..... B26B 19/16 30/43.6
2,229,972 A * 1/1941 Holsclaw ..... B26B 19/18 30/43.6
2,281,789 A * 5/1942 Moskovics ..... B26B 19/14 30/43.6
2,281,922 A * 5/1942 Dalkowitz ..... B26B 19/16 30/43.6
2,342,291 A * 2/1944 Morelli ..... B26B 21/00 30/43.6
2,360,785 A 10/1944 Mehl
2,474,027 A * 6/1949 Berger ..... B26B 19/18 30/43.6
2,524,822 A * 10/1950 Neidig ..... B26B 19/18 30/43.6
2,574,472 A 11/1951 Galvao
2,594,764 A * 4/1952 Garrard et al. ..... B26B 19/18 30/43.6
2,601,721 A * 7/1952 Garrard et al. ..... B26B 19/18 30/43.6
2,839,829 A * 6/1958 Knapp ..... B26B 19/30 30/43.4
2,858,607 A * 11/1958 Kane ..... B26B 19/16 30/43.6
D190,325 S * 5/1961 Pepin ..... 30/43.6
3,050,851 A * 8/1962 Negri ..... B26B 19/16 30/43.6
3,128,550 A * 4/1964 Miselli ..... B26B 19/16 30/43.6
3,381,373 A * 5/1968 Brown ..... B26B 19/148 30/43.6
3,431,643 A * 3/1969 Miceli ..... B26B 19/16 30/43.6
3,494,031 A * 2/1970 Sklenar ..... B26B 19/16 30/43.6
3,710,442 A * 1/1973 Meyer ..... B26B 19/141 30/43.6
3,829,966 A * 8/1974 Owens ..... B26B 19/16 30/43.6
4,043,036 A * 8/1977 Stevens, Sr. ..... B26B 19/16 30/43.6
4,151,645 A * 5/1979 Tietjens ..... B26B 19/42 30/43.6
4,802,281 A * 2/1989 Tietjens ..... B26B 19/16 30/43.6
4,807,359 A * 2/1989 Wijma ..... B26B 19/16 30/43.6
4,811,483 A * 3/1989 Bakker ..... B26B 19/16 30/43.6
4,811,484 A * 3/1989 Wijma ..... B26B 19/16 30/43.6
4,827,613 A * 5/1989 Bakker ..... B26B 19/16 30/43.6
4,884,338 A * 12/1989 Stewart ..... B26B 19/141 30/43.6
4,894,912 A * 1/1990 Tietjens ..... B26B 19/16 30/43.5
5,022,154 A 6/1991 Johnson
5,035,053 A * 7/1991 Hoekstra ..... B26B 19/16 30/43.6
5,367,599 A * 11/1994 Okada ..... B26B 19/28 388/809
5,377,699 A * 1/1995 Varnum ..... A45D 26/0004 30/43.5
5,921,134 A * 7/1999 Shiba ..... B26B 19/04 30/43.92
6,442,840 B2 * 9/2002 Zucker ..... B26B 19/16 30/43.6
6,568,083 B1 * 5/2003 Taniguchi ..... B26B 19/048 30/43.6
7,367,126 B2 * 5/2008 Freund ..... B26B 21/38 30/34.05
7,446,495 B2 * 11/2008 Tse ..... B26B 19/06 30/45
7,703,209 B2 * 4/2010 Freund ..... B26B 21/38 30/41.7
8,033,022 B2 * 10/2011 Ben-Ari ..... B26B 21/34 30/43.4
8,561,301 B2 * 10/2013 Schnak ..... B26B 21/526 30/45
8,601,696 B2 * 12/2013 Ben-Ari ..... B26B 19/18 30/43.5
8,661,687 B2 * 3/2014 Rebaudieres ..... B26B 21/14 30/32
8,667,692 B2 * 3/2014 Kraus ..... B26B 19/46 30/43.92
8,887,401 B2 * 11/2014 Oxford ..... B26B 21/34 30/41.6
9,862,107 B2 * 1/2018 Perlberg ..... B26B 21/34 30/43.6
2002/0055695 A1 * 5/2002 Takahata ..... B26B 19/282 601/89
2002/0108251 A1 * 8/2002 Brum ..... B26B 19/28 30/45
2005/0000093 A1 * 1/2005 Shagalov ..... B26B 19/00 30/43.6
2006/0218793 A1 * 10/2006 Zucker ..... B26B 19/16 30/43.4
2007/0220755 A1 * 9/2007 Dror ..... B26B 19/16 30/42
2008/0060202 A1 * 3/2008 Oh ..... B26B 19/16 30/43.6
2011/0173816 A1 7/2011 Ben-Ari
2011/0197726 A1 * 8/2011 Kraus ..... B26B 19/046 30/42
2011/0314677 A1 * 12/2011 Meier ..... A46B 5/0062 30/41.8
2012/0000075 A1 1/2012 Ben-Ari
2012/0227554 A1 * 9/2012 Beech ..... B26B 19/382 30/34.05
2014/0096397 A1 * 4/2014 Ben-Ari ..... B26B 19/18 30/43.6
2014/0137714 A1 * 5/2014 Krenik ..... B26B 19/3806 83/23
2016/0167241 A1 * 6/2016 Goldfarb ..... B26B 21/4056 30/41.7
2016/0375595 A1 * 12/2016 Mintz ..... B26B 19/3873 30/123
2017/0057103 A1 3/2017 Perlberg et al.
2017/0136636 A1 * 5/2017 Zak ..... B26B 19/18 30/43.6

FOREIGN PATENT DOCUMENTS

DE 2503175 7/1975
EP 2525949 B1 * 8/2017 ..... B26B 19/18
EP 2810579 B1 * 8/2017
EP 3228430 A1 * 10/2017
FR 1556327 2/1969
FR 2126486 10/1972
GB 2294228 4/1996

(56) References Cited

FOREIGN PATENT DOCUMENTS

| | | | | | |
|---|---|---|---|---|---|
| WO | WO 2011086474 | A1 * | 7/2011 | ..... | B26B 19/18 |
| WO | WO 2014191844 | A2 * | 12/2014 | ..... | B26B 19/18 |
| WO | WO 2014191844 | A3 * | 7/2015 | ..... | B26B 19/18 |
| WO | WO 2015125021 | A3 * | 1/2016 | ..... | B26B 19/18 |
| WO | 2017182872 | | 10/2017 | | |

OTHER PUBLICATIONS

Corresponding International Search Report for PCT/IB2015/000669 dated Sep. 8, 2015. WO.
Corresponding Extended European Search Report for EP 17169111 dated Sep. 13, 2017.
Corresponding U.S. Non-Final Office Action for U.S. Appl. No. 15/829,312 dated Jan. 29, 2018.
U.S. Final Office Action in Corresponding U.S. Appl. No. 5/829,312 dated Jul. 13, 2018. US.

* cited by examiner

SHAVING APPARATUS

CROSS-REFERENCE TO RELATED PATENT APPLICATIONS

The present application is a U.S. national stage application under 35 U.S.C. § 371 of PCT/IB2015/000669, filed Feb. 18, 2015, which in turn is a continuation-in-part of International Patent Application No. PCT/IB2014/001886, filed May 19, 2014, which in turn claims the benefit of United States Provisional Patent Application No. 61/941,240, filed Feb. 18, 2014.

The present application also claims the benefit of U.S. Provisional Patent Application No. 61/941,240, filed Feb. 18, 2014.

The entireties of the above-referenced patent applications are hereby incorporated by reference herein.

BACKGROUND

The present invention relates generally to shaving apparatus, and specifically shaving apparatus that utilize a shearing technique to cut hair bristles between a rotary cutter and a fixed blade.

The current methods for removing hair from the human body, by shaving, as opposed to epilation, involve two basic approaches: the razor approach, wherein a very sharp blade is pushed against the skin at an angle, thereby cutting hair; and the screen approach, wherein a thin fenestrated metal screen is moved across the skin, exposing hair though the holes and cutting them by a mechanized, typically motorized, cutting element.

In the sharp razor blade approach, the energy for cutting is provided by the hand driving the razor across the skin of the user, typically by the hand of the user him/herself. The conditions of cutting hair are a compromise between the ease of cutting a soft (or softened) hair (or hair bristle) and having the necessary counter-force against the blade's force which can only come from the hardness of the hair bristle. Apart from being a compromise difficult to optimize daily on a variety of hair bristles, the sharpness of the blade and its angle pose a constant risk of nicks and cuts, as the blade is driven forcefully across the skin.

In the screen approach of most motorized shaving apparatus, the problem of safety is mitigated since the skin and the cutting elements are separated by the screen. Moreover, the hair bristles which penetrate the screen through its holes are given a prop to be cut against; hence, the lack of a counter-force for cutting is also mitigated to some extent. However, in order to arrive at an efficient cutting condition, the hair bristle must enter a hole and be perpendicular to the skin, requirements which are not always met unless the screen is constantly moved across the skin. Still, when the hair bristle is eventually cut at the optimal angle, it cannot be cut close to the skin due to the separating screen.

One cutting technique which requires minimal force for cutting hair can be effectuated with scissors. Scissors cut hair at the crossing point of two blades which do not have to be very sharp in order to cut the hair due to the fact that the blades contact the hair from substantially opposite directions in the plane of cutting, mutually providing each other with a counter-force for cutting. It is impractical to use scissors for daily shaving.

BRIEF SUMMARY OF THE INVENTION

The inventions set forth herein are directed to a shaving apparatus in which a rotary cutter and a fixed blade are used to shear a user's hairs there between during a shaving process. Rotation of the rotary cutter is driven by an electric motor. The inventions disclosed herein provide various advancements in such shaving apparatus utilizing a fixed blade and rotary cutter to shear the user's hairs.

In one aspect, the present invention can be directed to a shaving apparatus in which a rotary cutter and a fixed blade are used to shear a user's hairs therebetween during a shaving process. Rotation of the rotary cutter is driven by an electric motor. At least one component of the head portion of the shaving apparatus is configured to provide registration for the fixed blade relative to the rotary cutter. Such registration, in certain embodiments, allows for precise and/or easily reproducible location of the fixed blade so that the vertical and/or horizontal position of the cutting edge of the fixed blade to the cutting edges of the rotary cutter is achieved.

In one such embodiment, the invention can be a shaving apparatus comprising: a handle portion; a power source; a head portion coupled to the handle portion, the head portion comprising: a support structure comprising a horizontal registration feature and a vertical registration feature; a rotary cutter comprising a plurality of cutting edges, the rotary, cutter mounted to the support structure so as to be rotatable relative to the support structure about a rotational axis, the rotary cutter comprising an outer surface defining a reference cylinder about the rotational axis and having a contact apex; and a fixed blade having a cutting edge, the fixed blade mounted to the support structure adjacent the rotary cutter so that: (1) the fixed blade is in operable engagement with the horizontal registration feature to position the cutting edge of the fixed blade at a predetermined horizontal distance from the contact apex; and (2) the fixed blade is in operable engagement with the vertical registration feature to position the cutting edge of the fixed blade at a predetermined vertical distance from the contact apex; and an electric motor operably coupled to the power source and the rotary cutter to rotate the rotary cutter about the rotational axis so that a user's hairs are sheared between the cutting edge of the fixed blade and the cutting edges of the rotary cutter.

In another such embodiment, the invention can be a shaving apparatus comprising: a handle portion; a power source; a head portion coupled to the handle portion, the head portion comprising: a support structure comprising; a rotary cutter comprising a plurality of cutting edges, the rotary cutter mounted to the support structure so as to be rotatable relative to the support structure about a rotational axis, the rotary cutter comprising a registration feature; and a fixed blade having a first end comprising a cutting edge and a second end opposite the first end, the fixed blade mounted to the support structure adjacent the rotary cutter so that the first end of the fixed blade is in contact with the registration feature of the rotary cutter; and an electric motor operably coupled to the power source and the rotary cutter to rotate the rotary cutter about the rotational axis so that a user's hairs are sheared between the cutting edge of the fixed blade and the cutting edges of the rotary cutter.

In another aspect, the present invention can be directed to a shaving apparatus in which a rotary cutter and a fixed blade are used to shear a user's hairs therebetween during a shaving process. Rotation of the rotary cutter is driven by an electric motor. The fixed blade is mounted to a support structure of the head portion and is oriented at an incline relative to a tangent line of the contact apex of the rotary cutter so that the end of the fixed blade comprising the cutting edge closer to the contact plane of a working surface of the head portion than the opposite end.

In one such embodiment, the invention can be a shaving apparatus comprising: a handle portion; a power source; a head portion coupled to the handle portion, the head portion comprising: a support structure; a rotary cutter comprising a plurality of cutting edges, the rotary cutter mounted to the support structure so as to be rotatable relative to the support structure about a rotational axis, the rotary cutter comprising an outer surface defining a reference cylinder about the rotational axis and having a contact apex; and a fixed blade comprising having a cutting edge, the fixed blade extending from a first end comprising the cutting edge of the fixed blade and a second end opposite the first end along a blade axis, the fixed blade mounted to the support structure adjacent the rotary cutter, the blade axis being inclined relative to a first reference line that is tangent to the reference cylinder at the contact apex; and an electric motor operably coupled to the power source and the rotary cutter to rotate the rotary cutter about the rotational axis so that a user's hairs are sheared between the cutting edge of the fixed blade and the cutting edges of the rotary cutter.

In a further aspect, the invention can be a shaving apparatus in which a rotary cutter and a fixed blade are used to shear a user's hairs therebetween during a shaving process. Rotation of the rotary cutter is driven by an electric motor. A head portion of the shaving apparatus includes a cover component to which the fixed blade is affixed. The cover component and the fixed blade may be removed from a base component of the head portion and, in certain embodiments, may be a refill component (i.e., a replaceable component by which a new fixed blade can be introduced).

In one such embodiment, the invention can be a shaving apparatus comprising: a handle portion; a power source; a head portion coupled to the handle portion, the head portion comprising: a base component coupled to the handle portion and comprising a cavity having an open top end; a rotary cutter comprising a plurality of first cutting edges, the rotary cutter disposed within the cavity and mounted to the base component so as to be rotatable relative to the base component about a rotational axis; a cover component comprising an opening; a first fixed blade having a first cutting edge, the first fixed blade fixedly mounted to the cover component to form a cover-blade assembly, the first cutting edge of the first fixed blade extending across the opening; the cover-blade assembly coupled to the base component so that: (1) the cover-blade assembly at least partially encloses the open top end of the cavity of the base component; (2) the first cutting edge of the first fixed blade is adjacent the rotary cutter; and (3) a portion of the rotary cutter is exposed via the opening of the cover component; and an electric motor operably coupled to the power source and the rotary cutter to rotate the rotary cutter about the rotational axis in a first rotational direction so that a user's hairs are sheared between the first cutting edge of the first fixed blade and the first cutting edges of the rotary cutter.

In another such embodiment, the invention can be a shaving apparatus comprising: a handle portion; a power source; a head portion coupled to the handle portion, the head portion comprising: a base component coupled to the handle portion and comprising a cavity having an open top end; a rotary cutter comprising a plurality of first cutting edges, the rotary cutter disposed within the cavity and mounted to the base component so as to be rotatable relative to the base component about a rotational axis; a cover component; a first fixed blade having a first cutting edge, the first fixed blade fixedly mounted to the cover component to form a cover-blade assembly, the first cutting edge of the first fixed blade being exposed; the cover-blade assembly coupled to the base component so that: (1) the cover-blade assembly at least partially encloses the open top end of the cavity of the base component to form a work window; (2) the first cutting edge of the first fixed blade is adjacent the rotary cutter and at least partially defines the work window; and (3) a portion of the rotary cutter is exposed via the work window; and an electric motor operably coupled to the power source and the rotary cutter to rotate the rotary cutter about the rotational axis in a first rotational direction so that a user's hairs are sheared between the first cutting edge of the first fixed blade and the first cutting edges of the rotary cutter.

In a yet further aspect, the invention can be a shaving apparatus in which a rotary cutter and a fixed blade are used to shear a user's hairs therebetween during a shaving process. Rotation of the rotary cutter is driven by an electric motor. A control circuit is included that can control the electric motor to selectively rotate the rotary cutter in either the clockwise direction or the counter-clockwise direction. The ability to selectively rotate the rotary cutter in both the clockwise and counter-clockwise direction can be utilized for a variety of end goals, including without limitation bi-directional shaving, the preparation of hairs for shearing, safety, and combinations thereof.

In one such embodiment, the invention can be a shaving apparatus comprising: a handle portion; a power source; a head portion coupled to the handle portion, the head portion comprising: a support structure; a rotary cutter comprising a plurality of first cutting edges, the rotary cutter mounted to the support structure so as to be rotatable relative to the support structure about a rotational axis; and a first fixed blade having a first cutting edge, the first fixed blade mounted to the support structure adjacent the rotary cutter; and an electric motor operably coupled to the power source and the rotary cutter; and a control circuit operably coupled to the electric motor and the power source, the control circuit configured to selectively: (1) rotate the rotary cutter about the rotational axis in a first rotational direction so that a user's hairs are sheared between the first cutting edge of the first fixed blade and the first cutting edges of the rotary cutter; and (2) rotate the rotary cutter about the rotational axis in a second rotational direction, the second rotational direction being opposite the first rotational direction.

In an even further aspect, the invention, can be a shaving apparatus in which a rotary cutter and a fixed blade are used to shear a user's hairs therebetween during a shaving process. Rotation of the rotary cutter is driven by an electric motor. The rotary cutter is configured to achieve a pinch, pull, and shear action for a user's hairs. Thus, it may be possible to achieve "below the skin surface" shaving.

In one such embodiment, the invention can be a shaving apparatus comprising: a handle portion; a power source; a head portion coupled to the handle portion, the head portion comprising: a support structure; a rotary cutter comprising a plurality of cutting elements and a plurality of pulling elements, the rotary cutter mounted to the support structure so as to be rotatable relative to the support structure about a rotational axis, the plurality of cutting elements defining a first reference cylinder centered about the rotational axis and having a first diameter, and the plurality of pulling elements defining a second reference cylinder centered about the rotational axis and having a second diameter that is less than the first diameter; and a fixed blade having a cutting edge, the fixed blade mounted to the support structure adjacent the rotary cutter so that the cutting edge; and an electric motor operably coupled to the power source and the rotary cutter to rotate the rotary cutter about the rotational axis so that: (1) a user's hairs are pinched and pulled between the pulling elements of the rotary cutter and the cutting edge of the fixed blade without shearing the user's hairs; and (2) the user's hairs are sheared between the cutting edge of the fixed blade and the cutting elements of the rotary cutter.

In a still further aspect, the invention can be a shaving apparatus in which a rotary cutter and a fixed blade are used to shear a user's hairs therebetween during a shaving process. Rotation of the rotary cutter is driven by an electric motor. A roller, in addition to the rotary cutter, is provided for contact with the user's skin. The roller can be configured to achieve a variety of end goals, including without limitation skin treatment, the preparation of hairs for shearing, safety, and combinations thereof.

In one such embodiment, the invention can be a shaving apparatus comprising: a handle portion; a power source; a head portion coupled to the handle portion, the head portion comprising: a support structure; a rotary cutter comprising a plurality of cutting edges, the rotary cutter mounted to the support structure so as to be rotatable relative to the support structure about a first rotational axis; a fixed blade having a cutting edge, the fixed blade mounted to the support structure adjacent the rotary cutter so that the cutting edge; and a first roller rotatably mounted to the support structure for contact with a user's skin, the rotary cutter located between the first roller and the fixed blade; and an electric motor operably coupled to the power source and the rotary cutter to rotate the rotary cutter about the first rotational axis so that the user's hairs are sheared between the cutting edge of the fixed blade and the cutting elements of the rotary cutter.

In another aspect, the invention can be a shaving apparatus comprising: a handle portion; a power source; a head portion coupled to the handle portion, the head portion comprising: a support structure; a rotary cutter comprising a plurality of first cutting edges, the rotary cutter mounted to the support structure so as to be rotatable relative to the support structure about a rotational axis; and a first fixed blade having a first cutting edge, the first fixed blade mounted to the support structure adjacent the rotary cutter; an electric motor operably coupled to the power source and the rotary cutter to rotate the rotary cutter about the rotational axis in a first rotational direction so that a user's hairs are sheared between the first cutting edge of the first fixed blade and the first cutting edges of the rotary cutter; and a control circuit comprising a current sensing circuit, the control circuit operably coupled to the electric motor and the power source, the control circuit configured to stop the motor upon the control circuit detecting that the current being drawn from the power source by the electric motor surges.

In a further aspect, the invention can be a shaving apparatus comprising: a handle portion; a power source; a head portion coupled to the handle portion, the head portion comprising: a support structure; a rotary cutter comprising a plurality of first cutting edges, the rotary cutter mounted to the support structure so as to be rotatable relative to the support structure about a rotational axis; and a first fixed blade having a first cutting edge, the first fixed blade mounted to the support structure adjacent the rotary cutter; an electric motor operably coupled to the power source and the rotary cutter to rotate the rotary cutter about the rotational axis in a first rotational direction so that a user's hairs are sheared between the first cutting edge of the first fixed blade and the first cutting edges of the rotary cutter; and a control circuit comprising a current sensing circuit and a user-perceptible output device, the control circuit operably coupled to the electric motor and the power source, the control circuit configured to activate the user-perceptible output device upon the control circuit detecting that the current being drawn from the power source by the electric motor surges Further areas of applicability of the present invention will become apparent from the detailed description provided hereinafter. It should be understood that the detailed description and specific examples, while indicating some embodiments of the invention, are intended for purposes of illustration only and are not intended to limit the scope of the invention.

BRIEF DESCRIPTION OF THE DRAWINGS

The features of the exemplified embodiments will be described with reference to the following drawings in which like elements are labeled similarly. The present invention will become more fully understood from the detailed description and the accompanying drawings, wherein.

DETAILED DESCRIPTION

Figure 1:
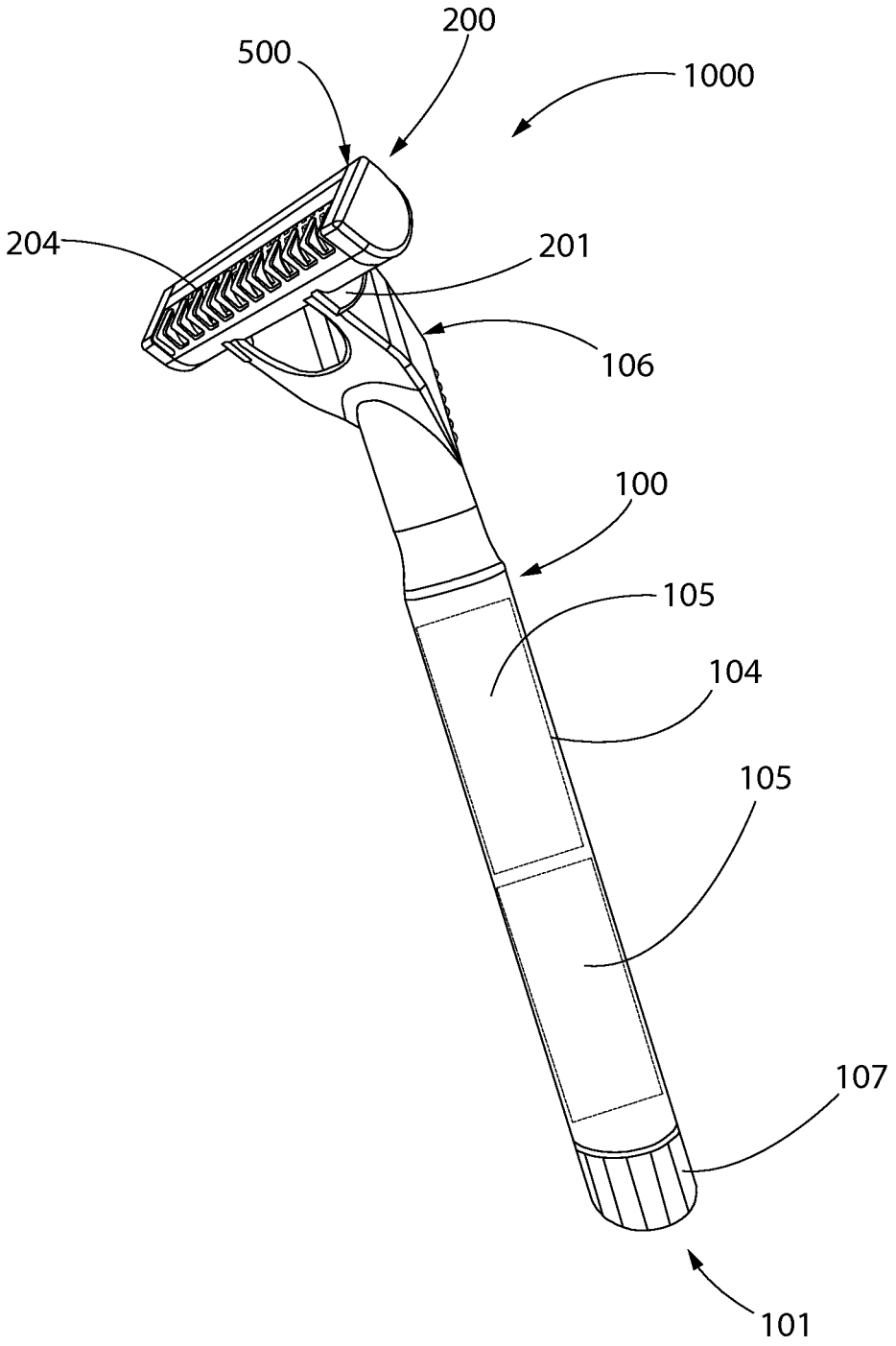
FIG. 1 is a front perspective view of a shaving apparatus according to an embodiment of the present invention.

The following description of some embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "mounted" and similar refer to a relationship wherein structures are secured or attached to one another either directly or indirectly through intervening structures, as well as both movable or rigid attachments or relationships, unless expressly described otherwise. Additionally, as used herein, when any two items or axes are said to be "parallel" to "perpendicular" to one another, these terms are intended to include instances where the items or axes are not perfectly "parallel" to "perpendicular" due to tolerances, which may be 1-3° in certain instances.

Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
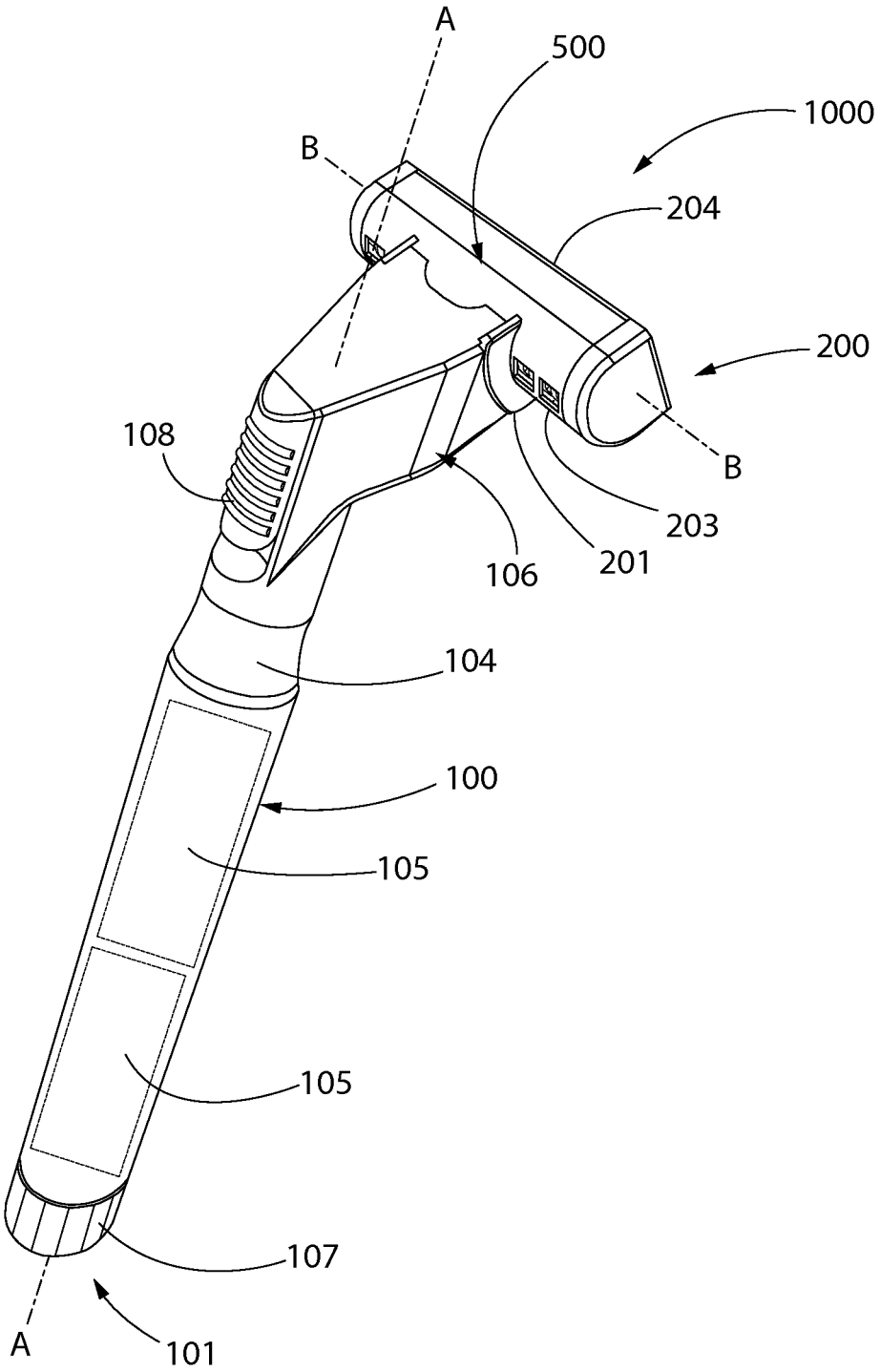
FIG. 2 is a rear perspective view of the shaving apparatus of FIG. 1.

Referring first to FIGS. 1 and 2 concurrently, a shaving apparatus 1000 according to an embodiment of the present invention is illustrated. The shaving apparatus 1000 generally comprises a handle portion 100 (hereinafter referred to as the "handle" for short) and a head portion 200 (hereinafter referred to as the "head" for short). The handle 100 provides the user of the shaving apparatus 1000 with the necessary structure to comfortably and firmly grip and maneuver the shaving apparatus 1000 in the manner necessary to shave a desired area of skin. In the exemplified embodiment, the handle 100 is an elongated structure that comprises a generally cylindrical portion 104 for gripping and a mounting member 106 for coupling of the head 200 to the handle 100. In one embodiment, the handle 100 has a length between 70 mm to 140 mm.

The cylindrical portion 104 extends along the longitudinal axis A-A. In one embodiment, the cylindrical portion 104 of the handle 100 has a diameter of between 10 mm to 25 mm. The mounting member 106 is coupled to a distal end of the cylindrical portion 104 and extends radially away from the longitudinal axis A-A in an inclined manner. The distal end of the mounting member 106 is configured so that the head 200 can be coupled thereto. The head 200 can be coupled to the mounting member 106 in a permanent, semi-permanent, or detachable manner. For example, the head 200, or a portion thereof, could be integrally formed with the mounting member 106, thereby creating a permanent coupling. Alternatively, the head 200 could be coupled to the mounting member 106 via ultrasonic welding, thermal welding, soldering, adhesion or combinations thereof, thereby creating a semi-permanent coupling. In still other embodiments, the head 200 could be coupled to the mounting member 106 via a snap-fit connection, a mechanical interlock, an interference fit, a threaded connection, a tab/slot interlock, a latch, or combinations thereof, thereby creating a detachable coupling. Of course, other coupling techniques are contemplated and are considered to be within the scope of the invention. Moreover, in certain other embodiments of the invention, the mounting member 106 can be less prominent or omitted all together so that the head 200 is directly coupled to the cylindrical portion 104 in any of the manners described above or otherwise contemplated.

As will be appreciated by the skilled artisan, an attempt to arrive at a minimal size and weight of a battery-powered motorized shaving apparatus may end at the size limitation of the battery which can power the motor effectively so as to deliver the required effect for the required time period. When achieving a reduction of the work-load of the motorized element and making its action more efficient, one can then reduce the overall size limitations imposed also of the power source, namely the battery or batteries. As presented herein, the shaving head according to some embodiments of the present invention is designed such that its scissors-like shaving action can be effected by a small motor, which can therefore be powered by a correspondingly small power source, compared to presently known configurations.

In the exemplified embodiment, the handle 100 also acts as a water-tight housing for a power source 105 (shown in dotted lines) that powers the motor 400 that rotates the rotary cutter 300 of the head 200 (the details of which will be discussed in greater detail below). Of course, in other embodiments, the power source 105 may be housed elsewhere in the shaving apparatus 1000. For example, in certain alternate embodiments, the power source 105 may be housed entirely or at least partially within the head 200. The power source 105 can be in the form of one or more batteries as is known in the art. In the exemplified embodiment, the batteries are disposed on and extend along the longitudinal axis A-A of the handle 100. Of course, alternative types of power sources can be utilized to power the motor 400 as desired. The exact type of power source 105 utilized in the shaving apparatus 1000 will depend on the power requirements of the motor 400 and, thus, is not to be considered limiting of the present invention unless specifically stated otherwise in the claims.

The power source 105 could be replaceable or permanent. In embodiments in which a removable power source 105 is used, the power source 105 may be one or more batteries that could be removed from the handle 100 for replacement or recharging. In such an embodiment, the handle 100 will further comprise the necessary structure to access the chamber of the handle 100 in which the power source 105 is located. In the exemplified embodiment, a removable cap 107 is provided at the proximal end 101 of the handle 100. The removable cap 107 can be coupled to the cylindrical portion 104 of the handle 100 via a threaded connection, a tight-fit assembly, or other connection technique that would create a fluid tight boundary so that water could not enter the chamber in which the power source 105 is located. In alternate embodiments, access to the internal chamber of the handle 100 in which the power source 105 is disposed can be accomplished via a hinged panel, a latch, a removable panel or any other structure as would be known to one of skill in the art.

In embodiments where a permanent (or non-removable) battery is used, the handle 100 may further comprise an electrical port to which a power cord could be electrically coupled to recharge the power source 105. To prevent water or other fluids from entering the electrical port, the electrical port may be provided behind a removable access panel or be provided with a cap/plug that seals the electrical port.

In still other embodiments, the power source may be external to the handle 100 of head 200, such as an electrical supply from a wall socket or other source of electricity. In one such embodiment, the handle 100 or head 200 may include a port or other mechanism for operably coupling to the external power source, such as to a first end of a power plug.

In the exemplified embodiment, the motor 400 is located within the head 200 of the shaving apparatus 1000 and, more specifically, within a central cavity of the rotary cutter 300. In certain other embodiments, however, the motor 400 may be located partially or entirely within the handle 1000. In such embodiments, the drive shaft of the motor 400 may be operably coupled to the rotary cutter 400 via gears, pulleys, belts, and other couplers capable of transmitting rotational motion.

Figure 19:
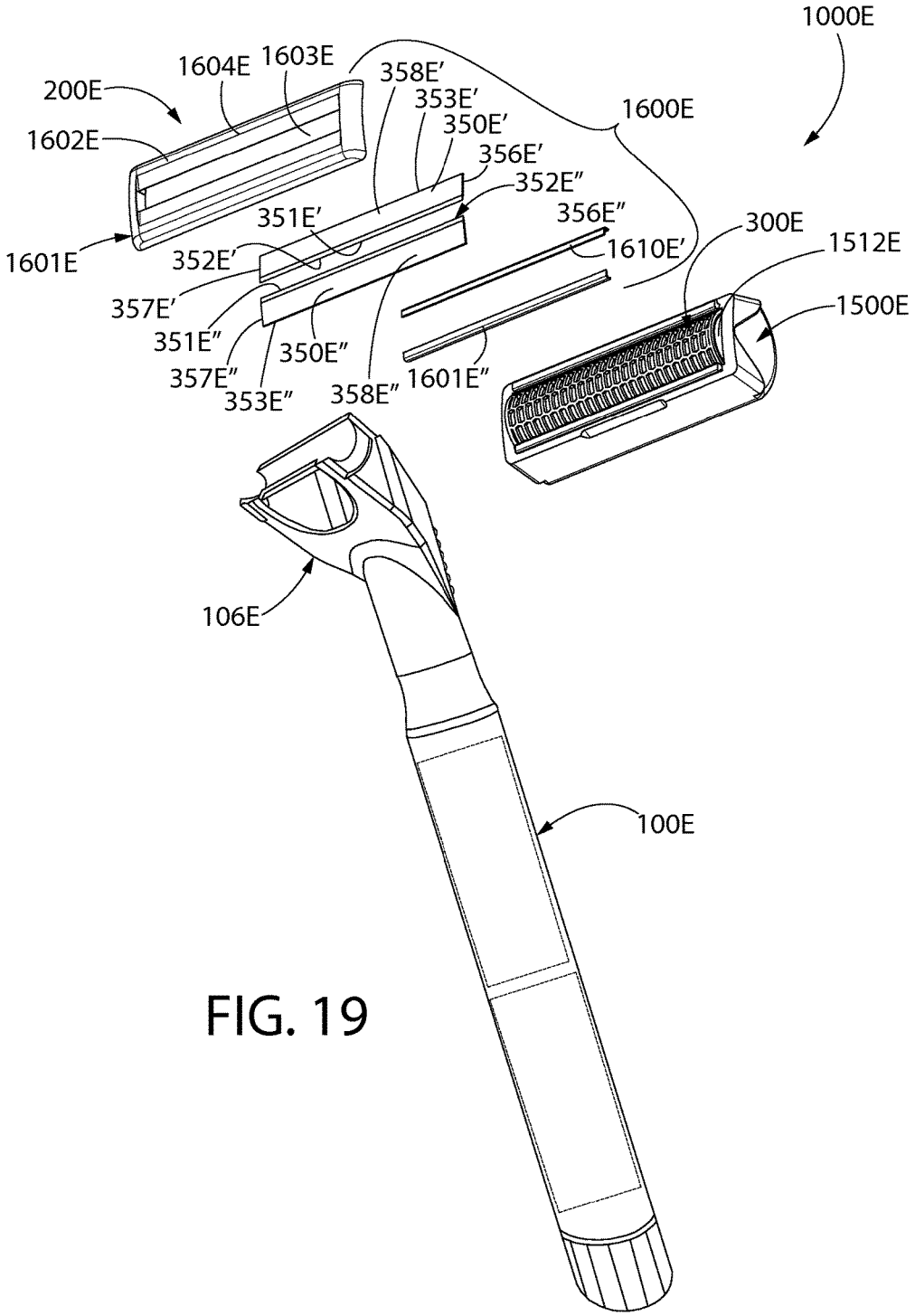
FIG. 19 is an exploded view of the shaving apparatus of FIG. 17.

A user-operated actuator 108, such as a switch, may be provided on the handle 100 for manually controlling the energization of the motor 400. Examples of user-operated actuators 108 include manual slide switches, capacitance touch-control, rotatable knobs, toggle switches, and combinations hereof. Any type of manual or automatic switch can be utilized as would be known by those of skill in the art. In addition to the user-operated actuator, a control circuit for controlling the performance characteristics of the motor 400 is also included within the chamber of the handle 100. This will be discussed in greater detail below with respect to FIG. 19.

As mentioned above, the head 200 is coupled to the distal end of the mounting member 106 of the handle 100. The head 200 has a generally elongated shape and extends along the longitudinal axis B-B. As discussed in detail below, the longitudinal axis B-B of the head 200 also serves as the axis of rotation of the rotary cutter 300. In the exemplified embodiment, when the head 200 is coupled to the handle 100, the head 200 is substantially perpendicular to the handle 100. More specifically, when the head 200 is coupled to the handle 100, the longitudinal axis B-B of the head 200 is substantially perpendicular to the longitudinal axis A-A of the handle 100. Moreover, the handle 200 is coupled to the center of the head 200 so that the shaving apparatus 1000 has a generally T-shape.

It is to be noted that while a few potential structural manifestations of the head 200 and handle 100 are exemplified, the head 200 and handle 100 can take on a wide variety of shapes and sizes in other embodiments. For example, in certain embodiments, the head 200 may not be such a distinctive element than that of the handle 100. For example, the head 200 may simply be a distal or side portion of the handle 100 that can contact the user's skin. In one embodiment, the combination of the head 200 and handle 200 can form, without limitation, a cylindrical structure, a bulbous structure, or an egg-shaped structure.

In the exemplified embodiment, the head 200 is coupled to the handle 100 through the use of fastener elements 201 that extend from a tubular housing 202 of the head 200. The fastener elements 201 are plates that extend from a rear face 203 of the head 200 opposite the front face 204 of the head 200, wherein the front face 204 can be considered a working surface (or contact surface) of the head 200, as will be described in greater detail below. The fastener elements 201 matingly engage corresponding structure on the mounting member 106 of the handle 100. Of course, the fastener elements 201 can take on a wide variety of structures, including pins, tangs, sockets, or other coupling or mating structures. In certain other embodiments, the head 200 may be pivotally connected to the handle 100 so that the orientation of the head 200 can be pivoted with respect to the handle 100. Thought of another way, in such an arrangement, the head 200 can be pivoted so that the longitudinal axis B-B of the head 200 can be moved along an arcuate path relative to the longitudinal axis A-A of the handle 100. Such pivotal movement can be accomplished in a variety of manners. In one embodiment, the fastener elements 201 of the head 200 pivotally couples the head 200 to the mounting member 106. In another embodiment, the mounting member 106 is pivotally coupled to the cylindrical portion 104 of the handle 100. Pivotally coupling the head 200 to the handle 100 enables the front face 204 of the head 200 to be pivoted to any desired position with respect to the handle 100 during use of the shaving apparatus 1000, thereby allowing the user a greater degree of flexibility and the ability to shave complex contours and/or hard to reach places.

The pivotal coupling of the head 200 to the handle 100 allows the head 200 to swivel (i.e., rock) within a limited angle range about the longitudinal axis A-A of the handle. Such pivotal rotation allows the head 200 to adjust its position relative to the plane of motion and the skin of a user during use of the shaving apparatus 1000. Such pivotal motion can be limited, by mechanical means in the attachment mechanism and/or the handle 100 and/or the head 200, to a desired angle of rotation. In certain embodiments, the angle of rotation may be 180 degrees, 90 degrees, 60 degrees, 30 degrees or less than 30 degrees.

As mentioned above, in certain alternate embodiments, the head 200 will be detachably coupled to the handle 100. In such embodiments, the head 200 can be sold as a "refill" head for the handle 100. As mentioned above (and discussed in greater detail below with respect to FIGS. 4 and 9), the motor 400 may be located within the rotary cutter 300 of the head 200 in certain embodiments. Moreover, as discussed above, the power source 105 is located within the handle 100. Thus, a continuous electrical connection extends from the power source 105 in the handle 100 to the motor 400 in the head 200 in order to power the motor 400 during use. Therefore, in embodiments where the head 200 is detachably coupled to the handle 100 and the motor is located within the head 200, electrical interface connectors (i.e., contacts) will be provided at appropriate positions on both the handle 100 and the head 200 that come into electrical coupling with one another when the head 200 is coupled to the handle 100, thereby completing the electrical circuit.

Figure 3:
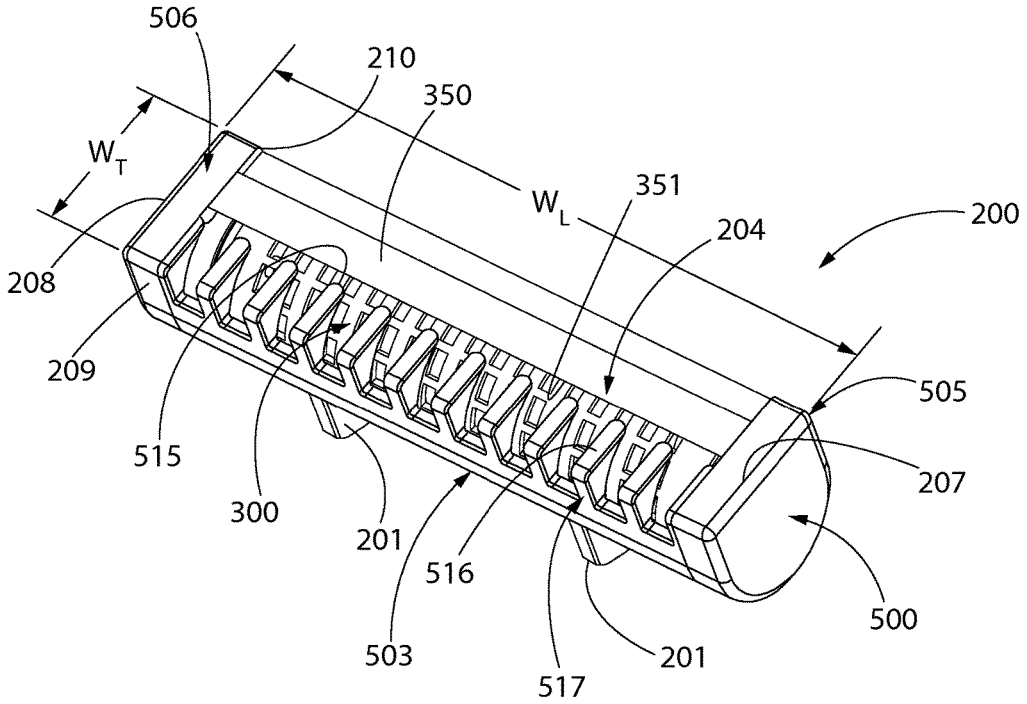
FIG. 3 is a top perspective view of a head portion of the shaving apparatus of FIG. 1.
Figure 4:
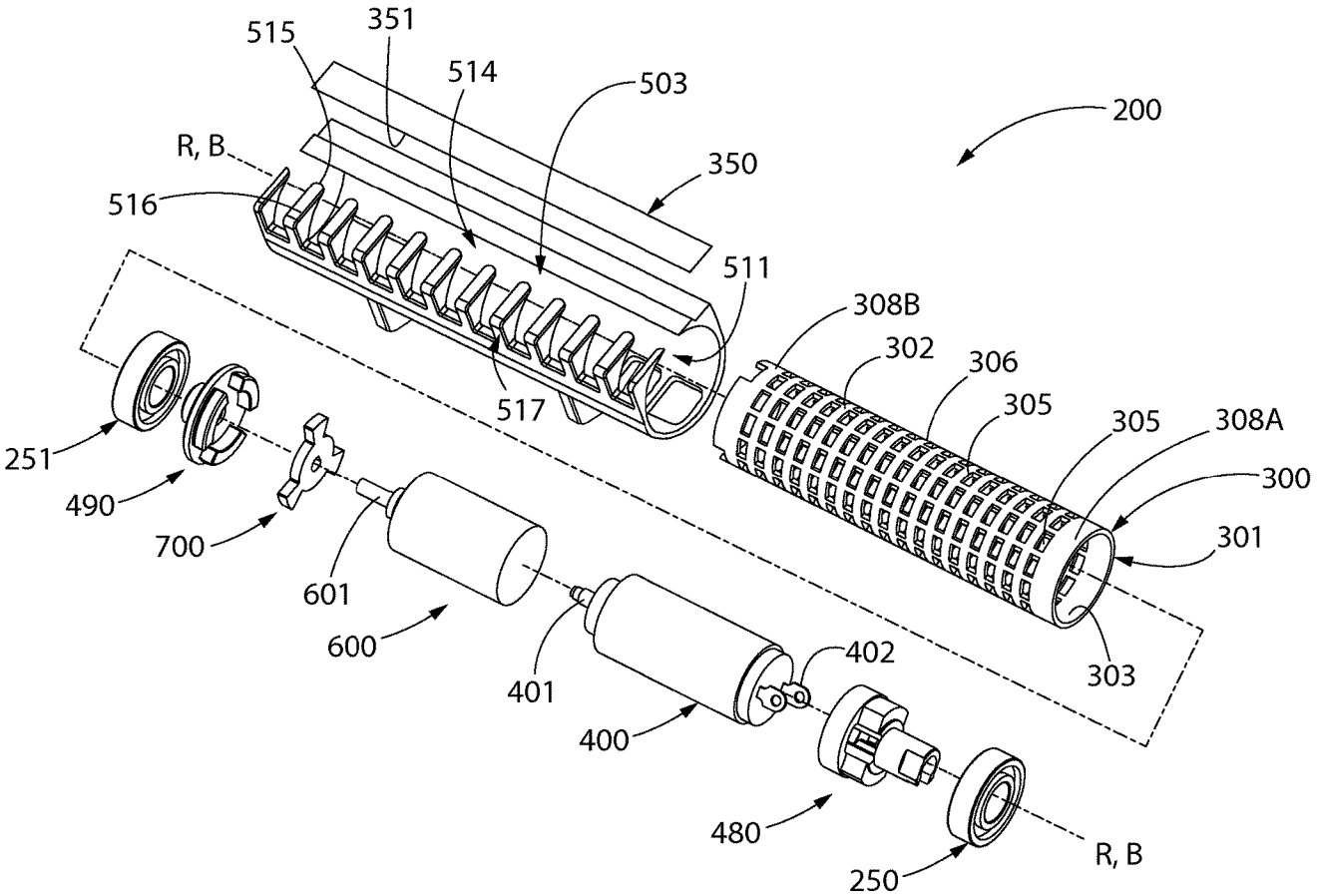
FIG. 4 is an exploded view of the head portion of the shaving apparatus of FIG. 1.

Referring now to FIGS. 3-4 concurrently, the head 100 generally comprises a support structure 500, a fixed blade 350, the motor 400, and the rotary cutter 300. The support structure 500 generally comprises a first end wall 505, a second end wall 506, and an elongated body 503. The elongated body 503, in the exemplified embodiment, is a tubular structure that forms a cavity 511. In other embodiments, the elongated body 503 may be a simple strut, bar, or frame structure that extends between the first and second end walls 505, 506. Additionally, while the first and second end walls 505, 506, in the exemplified embodiment are in the form of separate components that are coupled to the elongated body 503, in other embodiments, either or both of the first and second end walls 505, 506 may be integrally formed with the elongated body as a monolithic singular component.

The head portion 200 further comprises a first annular bearing 250 and a second annular bearing 251, which are used to rotatably mount the rotary cutter 300 to the support structure 500. More specifically, the first and second annular bearings 250, 251 respectively mount the rotary cutter 300 to the first and second end walls 505, 506. In certain other embodiments, one or both of the first and second annular bearings 250, 251 may be omitted and the rotary cutter 300 may be rotatably mounted to the support structure 500 in other manners, such as by utilizing posts, slots, or other features included in the first and second end walls 505, 506.

In the exemplified embodiment, the head 200 also comprises an inline drive train 600, a coupling element 700, a first rotary cutter end cap 480 and a second rotary cutter end cap 490. When the head 200 is assembled (discussed below with respect to FIG. 5), the head 200 is a compact structure, extending along longitudinal axis B-B.

The head 200 extends from a first end 207 to a second end 208 along the longitudinal axis B-B, thereby defining a maximum longitudinal width WL of the head 200. In an exemplary embodiment, the maximum longitudinal width WL of the head 200 is less than or equal to 60 mm. In another exemplary embodiment, the maximum longitudinal width WL of the head 200 is between 40 mm to 60 mm. In yet another embodiment, the maximum longitudinal width WL of the head 200 is between 45 mm to 55 mm. The head further comprises a maximum transverse width WT, extending from a lead face 209 of the head 200 to a trail face 210 of the head 200. In an exemplary embodiment, the maximum transverse width WT of the head 200 is less than or equal to 25 mm. In another embodiment, the maximum transverse width WT of the head 200 is between 5 mm to 25 mm. In yet another embodiment, the maximum transverse width WT of the head 200 is between 10 mm to 20 mm. In still, another embodiment, the maximum transverse width WT of the head 200 is between 5 mm to 15 mm. In still another embodiment, the maximum transverse width WT of the head 200 is between 5 mm to 10 mm.

In the exemplified embodiment, both the maximum longitudinal width WL of the head 200 and the maximum transverse width WT of the head 200 are measured on the front face 204 of the head 200. In the exemplified embodiment, the front face 204 of the head 200 is the working face of the head 200 in that it is the face of the head 200 that is put into contact with the user's skin so that the shaving apparatus 1000 can shear hairs between the rotary cutter 300 and the fixed blade 350 (as discussed in greater detail below). Thus, as discussed in greater detail below, the front face 204 defines a skin contact plane. In alternate embodiments, the maximum longitudinal width WL of the head 200 and/or the maximum transverse width WT of the head 200 may be dictated by other components of (or at other locations on) the head 200.

The elongated body 503, in the exemplified embodiment, comprises the internal cavity 511 for accommodating the rotary cutter 300, the motor 400, the inline drive train 600, the first annular bearing 250, the second annular bearing 251, the coupling element 700, the first rotary cutter end cap 480 and the second rotary cutter end cap 490. The internal cavity 511 of the tubular housing 202 is dimensioned so as to be capable of receiving and enclosing the aforementioned components as mentioned above (and described in greater detail below).

The elongated body 503 also comprises an elongated slot 514 that forms a passageway into the internal cavity 511 of the tubular housing 202. A portion of the rotary cutter 300 is exposed via the elongated slot 514. The elongated slot 514 allows hair bristles to enter the elongated body 503 and be sheared between the rotary cutter 300 and the fixed blade 350 as discussed in greater detail below. In the exemplified embodiment, the elongated slot 514 extends the entire longitudinal length of the elongated body 503 between the first and second end walls 505, 506 in a continuous and uninterrupted manner. However, in certain alternate embodiments, the elongated slot 514 may not extend the entire longitudinal length of the elongated body 503 and/or may be segmented and/or discontinuous in nature.

The elongated slot 514 is defined by a cutting edge 351 of the fixed blade 350 and an opposing edge 515 of the elongated body 503. In the exemplified embodiment, the opposing edge 515 of the elongated body 503, which is formed by a plurality of axially-spaced fingers 516 that collectively form a comb guard 517. The comb guard 517 is part of the elongated body 503 and can be pressed against the user's skin during a cutting operation to more effectively feed the hair bristles to the rotary cutter 300 and fixed blade 350 for shearing, while at the same time protecting the user from nicking or cutting the skin. In order to further achieve this purpose, the outer surfaces of the fingers 516 of the comb guard 517 are optionally flat or rounded to facilitate the movement of the head 200 over the user's skin. In certain other embodiment, the opposing edge 515 may be a continuous edge in which the comb guard 517 is eliminated by omitting the fingers 516.

In certain embodiments, the elongated body 503, the first end wall 505, and/or the second end wall 506 may comprise one or more openings for allowing removal of sheared hair bristle debris, soap residues, or other contaminations from the internal cavity 511 of the elongated body 503 and/or from the central cavity 304 of the rotary cutter 300. Finally, as can be seen in FIG. 3, the fastener elements 201 are also part of the elongated body 503. While the support structure 500 generally forms a housing that is tubular in shape, the invention is not so limited in all embodiments. In certain other embodiments, the support structure 500 may take on other structural arrangements and shapes. For example, the support structure 500, in certain such embodiments, may be in the form of an open frame, and may include a plurality of interconnected beams and plates.

Figure 5:
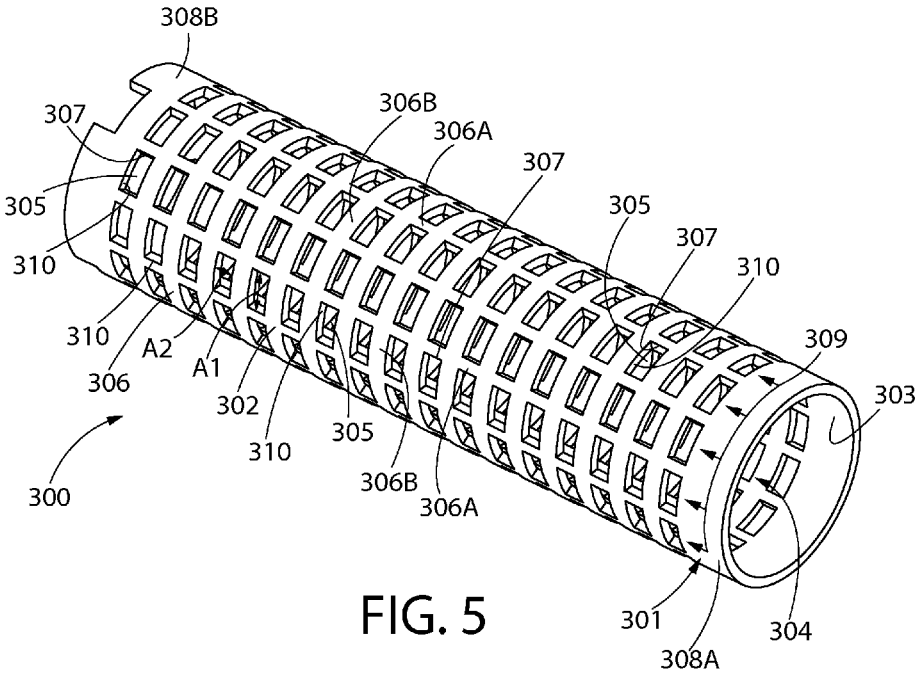
FIG. 5 is a perspective view of the rotary cutter of the shaving apparatus of FIG. 1 according to the present invention.

Referring still to FIGS. 4 and 5 concurrently, the rotary cutter 300, in the exemplified embodiment is of a hollow cylindrical configuration. The rotary cutter 300 comprises a hollow cutter tube 301 having an outer surface 302 and an inner surface 303. The rotary cutter 300 comprises a central cavity 304 which, in the exemplified embodiment, is formed by the inner surface 303 of the cutter tube 301 about a central axis, which is also the rotary axis R-R of the rotary cutter 300. The internal cavity 304 of the rotary cutter 300 is dimensioned to receive the motor 400 and the inline drive train 600.

The rotary cutter 300 further comprises a plurality of apertures 305 formed in the outer surface 302 of the cutter tube 301. The outer surface 302 of the cutter tube 301, in the exemplified embodiment, conceptually defines a reference cylinder that is concentric to the rotational axis R-R of the rotary cutter 300 and has a diameter. In an exemplary embodiment, the diameter of the reference cylinder is less than or equal to 20 mm. In another embodiment, the diameter of the reference cylinder is between 6 mm to 20 mm.

Each of the apertures 305 is defined by a cutting edge 307 having a closed-geometry. The cutting edges 307 of the cutting tube 301, in certain embodiments, may be formed by the intersection of the outer surface 302 of the cutter tube 301 and the radial walls 310 that circumscribe the apertures 305. The cutting edges 307, in certain embodiments, may lie either substantially flush with the outer surface 302 of the cutter tube 301 or between the outer and inner surfaces 302, 303 of the cutter tube 301. In certain embodiments, the cutter tube 301 may also comprises one or more apertures 305 defined by cutting edges 307 that have an open geometry, such as those that may be located near the edges of the cutter tube 301 (not illustrated).

When the rotary cutter 300 is mounted within the head 200 and rotated by the motor 400, the user's hairs extend into the apertures 305 and are sheared between the cutting edges 307 and the cutting edge 351 of the fixed blade 350 during a shaving operation.

Figure 6:
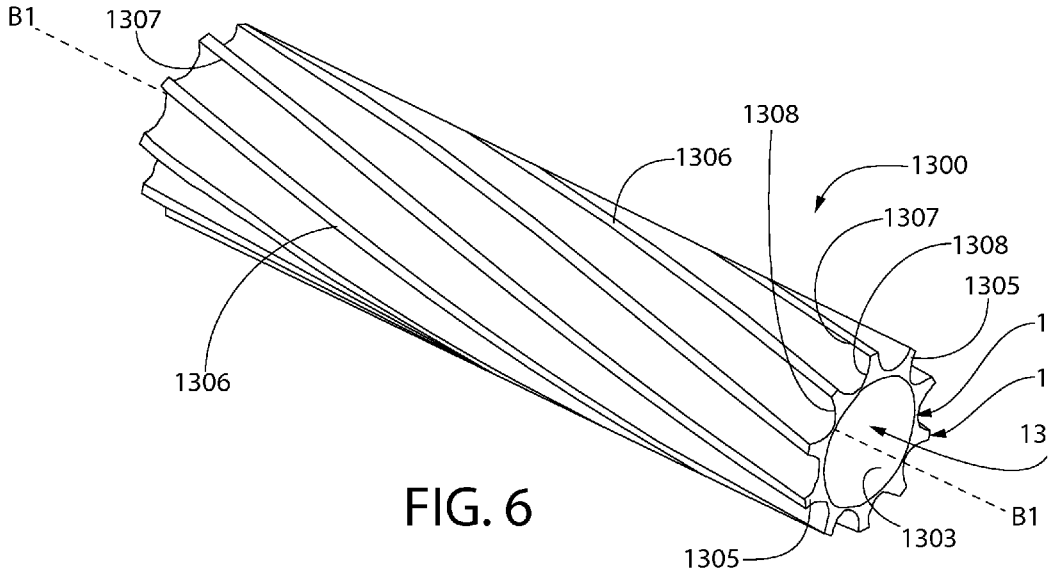
FIG. 6 is a perspective view of another embodiment of a rotary cutter that can be used in the shaving apparatus of FIG. 1.

The use of apertures 305 to form the cutting edges 307 of the rotary cutter 300, as opposed to protruding elongated ridges as shown in the rotary cutter 1300 of FIG. 6, may increase the safety of the shaving apparatus 1000. Utilizing apertures 305 to form the cutting edges 307 add the element of safety by keeping the skin almost completely out of the reference cylinder formed by the outer surface 302 of the rotary cutter 300, thereby reducing the chance of a skin-fold being caught and nicked. Nonetheless, the shaving apparatus 1000 may utilize a wide variety of rotary cutters, including those comprising protruding ridges elongated ridges that comprise the cutting edges of the rotary cutter, such the rotary cutter 1300 of FIG. 6.

Each of the apertures 305 extend through the cutter tube 301 from the outer surface 302 to the inner surface 303, thereby forming a plurality of radial passageways through the cutter tube 301. In certain other embodiments, however, the apertures 305 may be in the form of depressions in the outer surface 302 that do not go through the entire thickness of the cutter tube 301 such that the apertures 305 are "blind." The cutter tube 301, as exemplified, comprises a lattice structure 306 that defines the apertures 305. The lattice structure 306 comprises a plurality of axial members 306A and a plurality of circumferential members 306B that are arranged in an intersecting manner. In the exemplified embodiment, the plurality of axial members 306A extend substantially parallel to a reference line on the outer surface 302 of the cutter tube 301 that is parallel to the rotational axis R-R while the plurality of circumferential members 306B extend substantially perpendicular to such a reference line. In other embodiments, however, the plurality of axial members 306A may be inclined relative to such a reference line and, thus, have a circumferential component of extension. Similarly, in certain embodiments, however, the plurality of circumferential members 306B may be inclined relative to such a reference line and, thus, have an axial component of extension. In such instances, such members of the lattice structure 306 may be categorized as "circumferential" or "axial" based on its primary component of extension. For those members arranged at a 45°, the member can be categorized as either "circumferential" or "axial."

In the exemplified embodiment, the lattice structure 306 covers the entire circumference of the cutter tube 301 in a continuous manner, with the exception of the axial end portions 308A, 308B, which are free of the apertures 305. In the exemplified embodiment, the apertures 305 are rectangular in shape. In other embodiments, the apertures 305 may be round, triangular square, elongated oval, pentagonal, hexagonal, or other polygonal or irregular shapes that have a closed-geometry. All of the apertures 305 in the exemplified embodiment are the same size and shape. In other embodiments, however, the apertures 305 may comprise apertures of a plurality shapes and/or sizes that are different from one another. In a certain embodiment, each of the apertures 305 are preferably sized and shaped so as to be capable of accommodating at least one hair of the user, which may have a diameter in a range of 15 to 180 microns.

In the exemplified embodiment, the apertures 305 are provided in a pattern comprising a plurality of rows 309 of the apertures 305. The rows 309, in the exemplified embodiment are axial rows that extend substantially parallel to the rotational axis R-R of the rotary cutter 300. In certain other embodiments, the rows 309 may be inclined relative to the rotational axis R-R so as to form a partial helix about the outer surface 302 of the cutter tube 301. The apertures 305 can be created in a wide range of shapes and sizes, and can be applied to the cutter tube 301 in a wide range of patterns.

The cutter tube 301 may have a thickness in a range of 0.1 mm to 2.5 mm in certain embodiments. The cutter tube 301 may be formed of a metal or other suitable material. The cutter tube 301, in one embodiment, the cutter tube 301 is formed from a sheet metal that is rolled into shape and in which the edges are connected together. In other embodiments, the cutter tube 301 can be formed by other materials and other techniques, including machining, injection molding, casting, and combinations thereof with appropriate materials. In one embodiment, stock tube may be used in which, the apertures 305 are formed, such as by laser cutting.

Referring now to FIGS. 3-4, the assembly of the head 200, including certain components and the structural cooperation there between, will now be described. When the head 200 is assembled for operation, the fixed blade 350 is mounted adjacent the rotary cutter 300. In one embodiment, the fixed blade 350 is mounted adjacent the rotary cutter 300 so that the cutting edge 351 of the fixed blade 350 extends substantially parallel to the axis of rotation R-R of the rotary cutter 300 (which in the exemplified embodiment is coincident with the longitudinal axis B-B of the head 200). In the exemplified embodiment, such adjacent positioning is achieved by mounting the fixed blade 350 to the support structure 500 (and more specifically to the elongated body 503 of the support structure 500) so that the cutting edge 351 of the fixed blade 350 extends into the slot 514 and is adjacent the outer surface 302 of the rotary cutter 300 (which includes the cutting edges 307).

In one embodiment, the fixed blade 350 is "fixed" with respect to its radial distance from the axis of rotation B-B of the rotary cutter 300. As used herein, the term "fixed" is intended to cover embodiments where small vibrations may be imparted to the fixed blade 350 and/or wherein the fixed blade 350 may axially translate slightly in a manner that maintains the cutting edge 351 substantially parallel to axis of rotation B-B and its radial distance therefrom. In certain other embodiments, the fixed blade 350 may be completely stationary and immovable with respect to both the axis of rotation R-R and the support structure 500 and/or the rotary cutter 300.

The cutting edge 351 of the fixed blade 350 may extend along the entire length of the rotary cutter 300 in certain embodiments. The cutting edge 351 of the fixed blade 350 is sufficiently proximate the cutting edges 307 of the rotary cutter 300 so as to be effective in cooperating with the cutting edges 307 of the cutter tube 301 to shear hair bristles there between during a cutting operation when the motor 400 is activated and the front face 204 of the head 200 is pressed against and moved along the skin. In one embodiment, a tolerance, in the form of a cutting gap is designed to exist between the cutting edge 351 of the fixed blade 350 and the cutting edges 307 of the cutter tube 301 of the rotary cutter 300 during a cutting operation. This cutting gap will be discussed in greater detail below.

When the head 200 is assembled for use, the motor 400 is positioned in the central cavity 304 of the rotary cutter 300 and operably coupled thereto so as to be capable of rotating the rotary cutter 300 about the rotational axis R-R. According to some embodiments of the present invention, the motor 400 is an electric motor and is electrically coupled to the power source 105 housed in the handle 100 as described above. The motor 400 can be powered by alternating or direct current. In certain embodiments, the motor 400 may be a brushless type motor or a brushed motor type; and/or may be a cored or coreless type motor. In certain other embodiments, the motor 400 may be a stepper motor. As discussed in greater detail below, in certain embodiments, the motor 400 may be capable of selectively rotating in both the clockwise and counter-clockwise directions.

One suitable motor may be a brushless DC electric motor, which is a synchronous electric motor that is powered by direct-current electricity and has an electronically controlled commutation system (a "controller") instead of a mechanical commutation system based on brushes, as present in the brushed motors. It is noted herein that the term "motor" is intended to encompass the assembly of parts which transform electrical power to mechanical motion as a required output force/torque and speed.

The inline drive train 600, which may be omitted in certain embodiments, can be provided to control the output speed, and torque of the electric motor 400. The inline drive train 600 is a drive transmission device, such as a gear box, which is placed inline with the motor 400, namely the drive shaft 401 of the motor 400. The output shaft 601 of inline drive train 600 may share the same axis of rotation. The inline drive train 600 may include be epicyclic gearing, or planetary gearing. Such an inline gearing system can be selected so as to increase the torque of the motor and reduce its speed or the opposite, depending on the selected motor and desired terminal rotation output.

The coupling element 700 is coupled (directly or indirectly) to the electric motor 400 and to the cutter tube 301 of the rotary cutter 300 so that rotational output of the electric motor 400 is transmitted to the cutter tube 301 of the rotary cutter 300 by the coupling element 700. In the exemplified embodiment, the coupling element 700 is coupled to the output shaft 601 of the inline drive train 600 (which in turn is operably coupled to the motor 400) and the end portion 308B of the cutter tube 301 of the rotary cutter 300. In certain other embodiments, the coupling element 700 may be coupled to the electric motor 400 directly (for example, through the drive shaft 401 or other rotating output). In still other embodiments, additional intervening drive transmission devices may be utilized.

Once the motor 400, the inline drive train 600, and coupling element 700 are assembled, the first and second rotary cutter end caps 480, 490 are coupled thereto. The first rotary cutter end cap 480 fits within a first end of the cutter tube 301 and comprises an annular body and a hollow post. An axial passageway is formed through the first rotary cutter end cap 480 so that electrical connectors which, in the exemplified embodiment are wires, can pass therethrough to couple to the contacts 402 of the motor 400.

The second rotary cutter end cap 490 fits within a second end of the cutter tube 301 and comprises an annular body and a hollow post. The second rotary cutter end cap receives and engages the output shaft 601 of the inline drive train 600 and engages the coupling element 700. The second rotary cutter end cap 490 rotates with the rotary cutter 300, the coupling element 700, and the output shaft 601 of the inline drive train 600 about the rotational axis R-R. The second annular bearing 251 is slid over the hollow post of the second rotary cutter end cap 490 but remains outside of the cutter tube 301. The inner surface of the second annular bearing 251 engages the hollow post of the second rotary cutter end cap 490.

The aforementioned assembly is then mounted within the cavity 511 of elongated body 503 of the support structure 500. Specifically, the hollow post of the first rotary cutter end cap 480 engages the first end wall 505 of the support structure so as to be non-rotatable relative thereto. The outer surface of the second annular bearing 251 is likewise engaged to the second end wall 506 of the rotary cutter 500 so as to be non-rotatable relative thereto. However, rotation of the rotary cutter 300 by the motor 400 is possible due to the afforded free rotation of the inner portion of the second annular bearing 251 and the outer portion of the first annular bearing 250.

In the exemplified embodiment, both of the annular bearings 250, 252 are of the ball-bearing type. However, bearing types that can be used in the context of the present invention include, without limitation, plain bearings, also known as sliding or slipping bearings which are based on rubbing surfaces and typically a lubricant (implemented by use of hard metals or plastics such as PTFE which has coefficient of friction of about 0.05); rolling element bearing, also known as ball bearings which are based on balls or rollers (cylinders) and restriction rings; or magnetic bearings and flexure bearings. The term. "annular" may include segmentally annular in certain embodiments.

It is to be understood that various parts of the internally motorized shaving head presented herein are presented as discrete and separate parts for the sake of clarity and definition. However, some of the parts described herein can be manufactured as a union with other parts, forming a single continuous unit, while some parts described herein as single continuous units can be formed by a plurality of sub-parts.

Referring now to FIG. 6, another embodiment of a rotary utter 1300 that can be used in the shaving apparatus 1000 is exemplified. Similar to the rotary cutter 300, the rotary cutter 1300 is of a hollow cylindrical configuration. The rotary cutter 1300 comprises a cylindrical body 1301 having an inner surface 1303. The inner surface 1303 forms a cavity 1304 about the longitudinal axis B1-B1 (which is also both the central axis and rotational axis of the rotary cutter 1300 when operably mounted within the shaving apparatus 1000). The cavity 1304 of the rotary cutter 300 may be dimensioned to receive the motor 400 as discussed above.

Figure 10A:
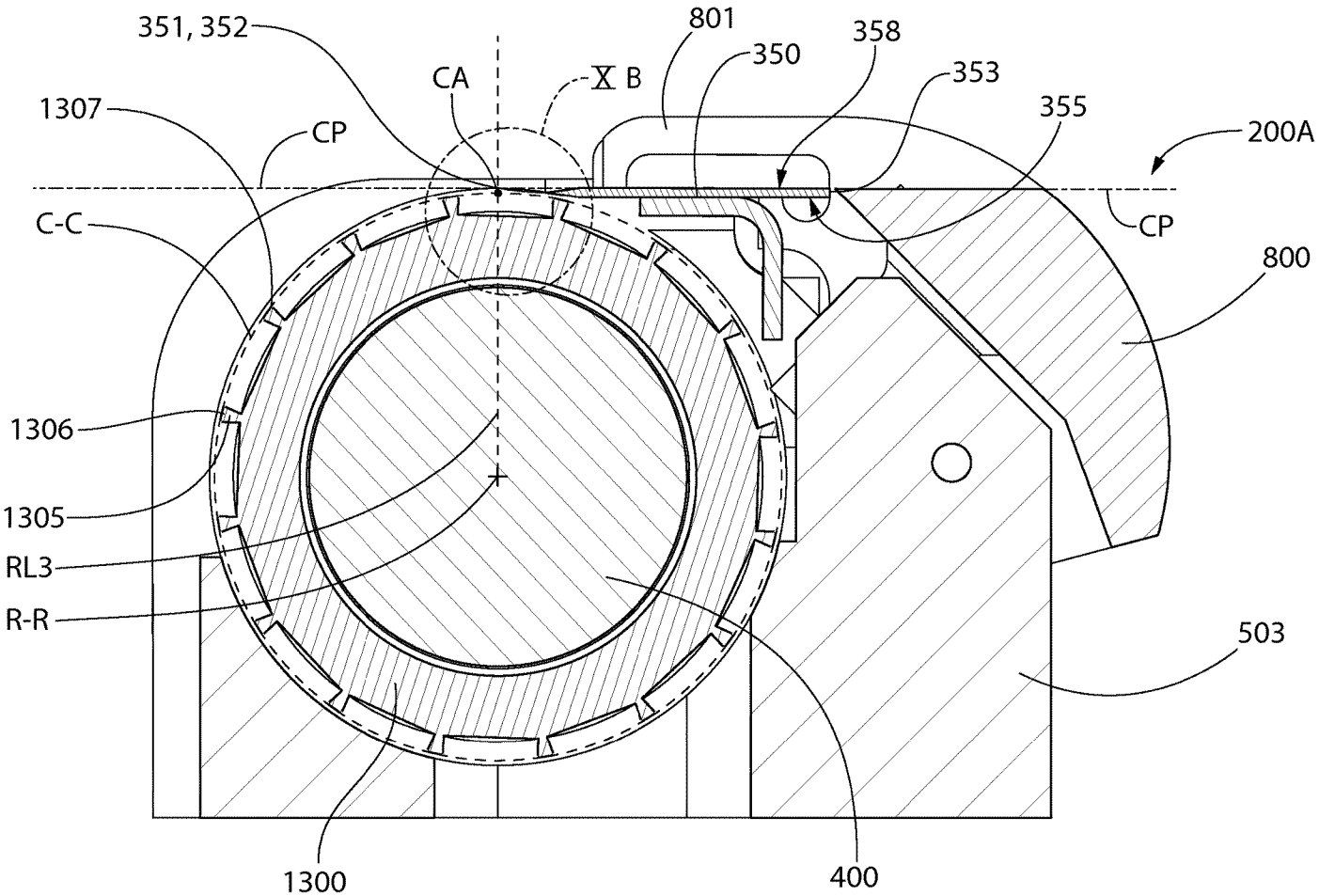
FIG. 10A is a transverse cross-sectional view of the head portion of FIG. 9.
Figure 10B:
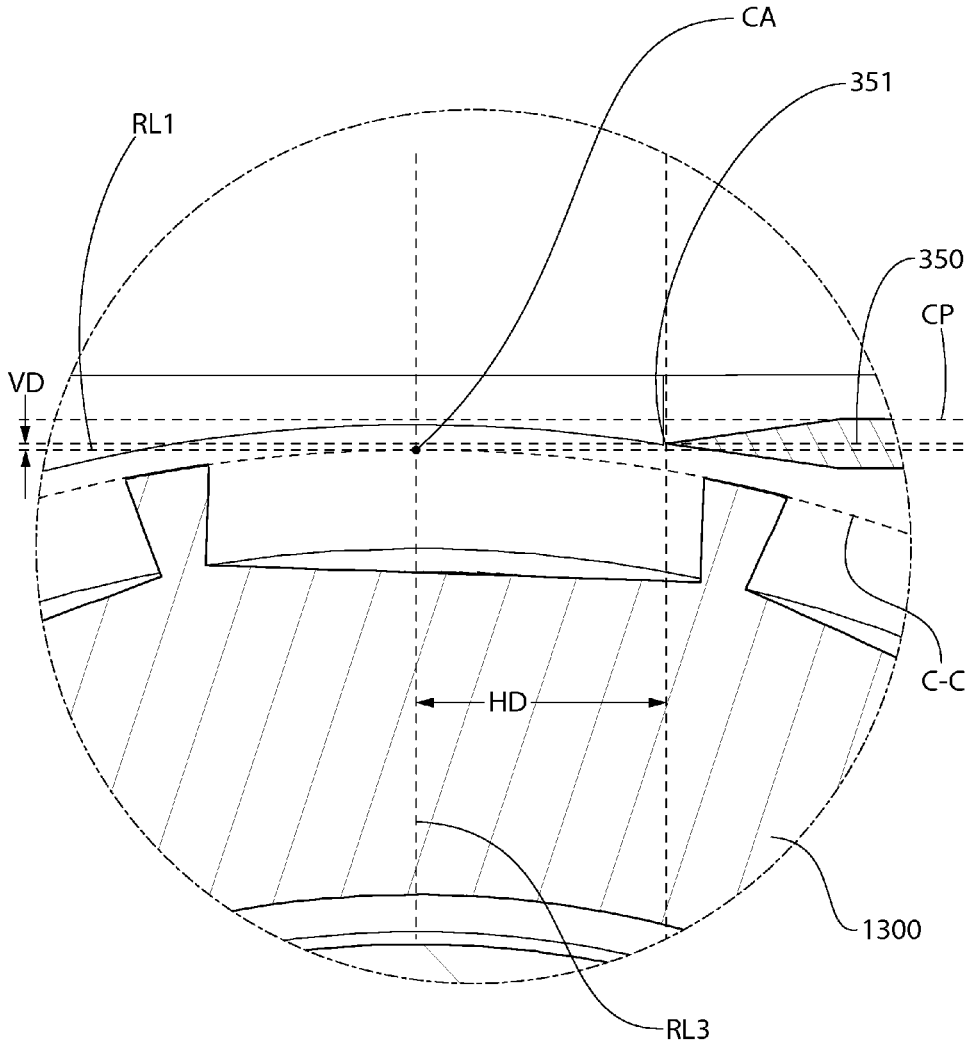
FIG. 10B is a close-up view of area XB of FIG. 10A.

The rotary cutter 1300 further comprises a plurality of spaced-apart ridges 1305 protruding from the cylindrical body 1301. The ridges 1305 extend radially outward from the cylindrical body 1301 and terminate in convex outer surfaces 1306 that collectively define a reference cylinder (see for example the dotted circle C-C of FIG. 10-11B) that is concentric to the longitudinal axis B1-B1. Each of the ridges 1305 includes a sharpened cutting edge 1307. In the exemplified embodiment, each of the cutting edges 1307 is formed by the sharp intersection of the convex outer surfaces 1306 of the ridges 1305 and concave sidewall surfaces 1308 of the ridges 1305. As a result of the aforementioned structure, the rotary cutter 1300 comprises a plurality of spaced-apart cutting edges 1307 extending from the outer surface 1302 of the cylindrical body 1301.

The rotary cutter 1300 can be mounted to the support structure 500 of the shaving apparatus 1000 in a manner similar to that described above for the rotary cutter 300, with certain structural modifications that should be apparent to those of skill in the art.

Fixed Blade Alignment

In shaving apparatus of the type described above with respect to FIGS. 1-4, accurate and consistent positioning of the fixed blade with respect to the rotary cutter is desired to facilitate a close, even and safe shave. This is true irrespective of whether a rotary cutter of the type of FIG. 5 (i.e., the rotary cutter 300) or a rotary cutter of the type of FIG. 6 (i.e., the rotary cutter 1300) is used. The fixed blade, in certain embodiments, should be positioned such that its cutting edge is at a desired location/position from the contact apex of the rotary cutter, and that this location/position is consistent throughout the length of the fixed blade in both the vertical and horizontal directions. As will be discussed in greater detail below, precise positioning of the fixed blade relative to the rotary cutter may be accomplished by configuring a component of the head, for example the rotary cutter or the support structure, to include one or more registration features to which the fixed blade can be put into operable engagement. In certain embodiments, operable engagement includes physical contact, such as abutment.

Figure 7A:
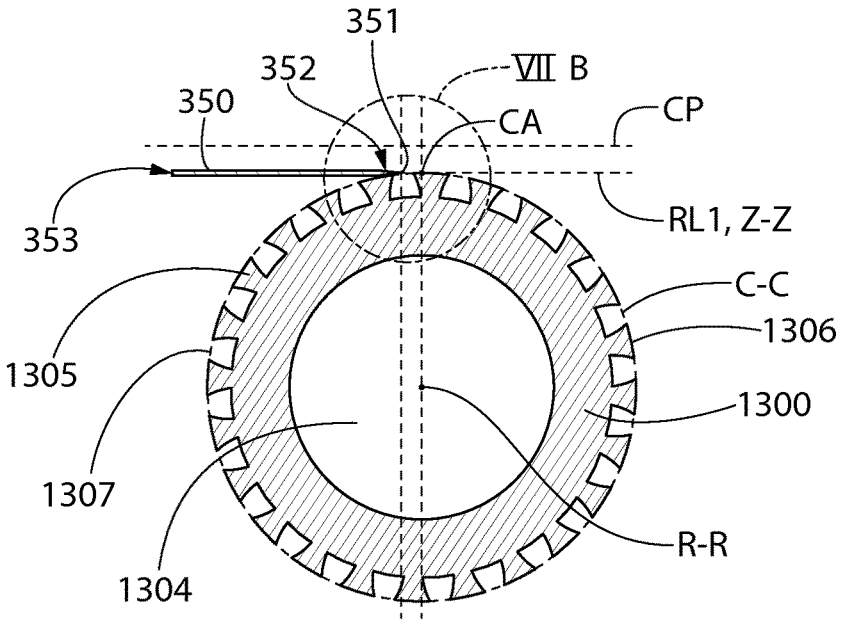
FIG. 7A is a schematic representation of the fixed blade being set in a desired position relative to the rotary cutter to achieve a desired horizontal and vertical distance between the cutting edge of the fixed blade and a contact apex of the rotary cutter in accordance with the present invention, wherein the fixed blade is oriented parallel to a tangent line of the contact apex.
Figure 7B:
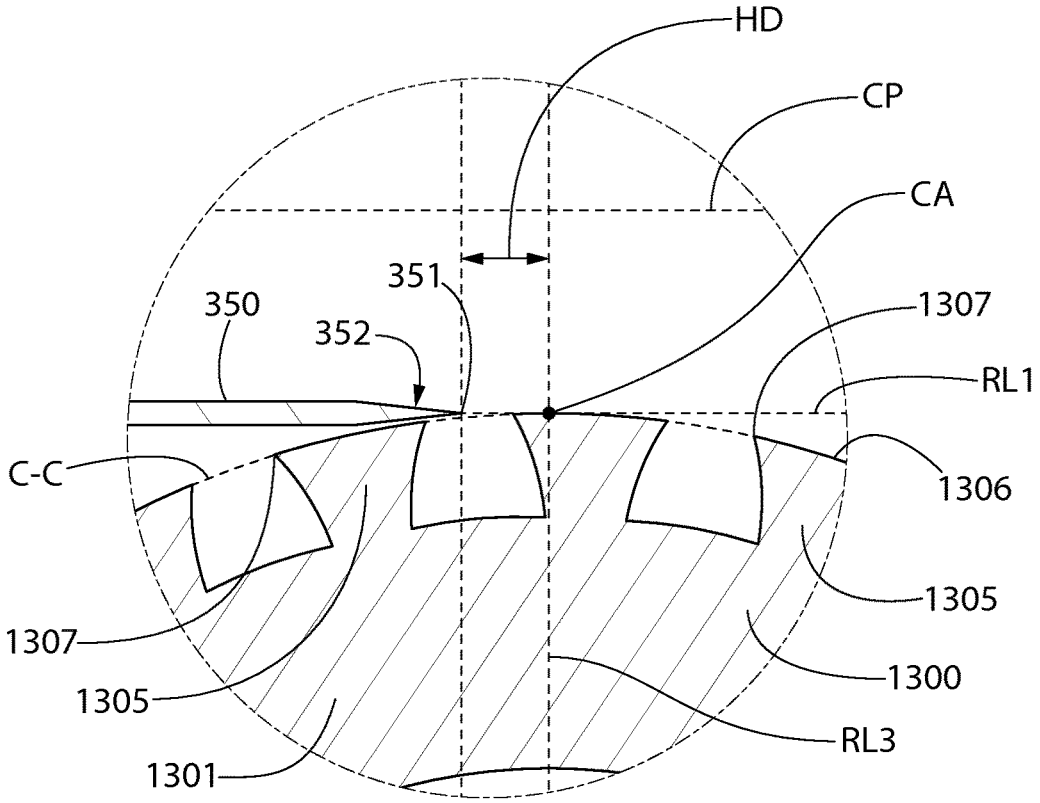
FIG. 7B is a close-up view of area VIIB of FIG. 7A.

Referring now to FIGS. 7A-B concurrently, the relevant parameters of the position of the cutting edge 351 of the fixed blade 350 relative to the cutting edges 1307 of the rotary cutter 1300 that are precisely controlled in the shaving apparatus 1000 according to the present invention will be described. As mentioned above, the rotary cutter 1300 comprises an outer surface 1306 that defines a reference cylinder C-C that is formed about (and centered upon) the rotational axis R-R. In the exemplified embodiment of the rotary cutter 1300, the cutting edges 1307 of the rotary cutter 1300 are located on the reference cylinder C-C. The reference cylinder C-C comprises a contact apex CA.

In one embodiment (such as the one exemplified in FIGS. 7A-8B), the contact apex CA is defined as the point at which a reference line RL3 intersects the reference cylinder C-C, wherein the reference line RL3 both: (1) extends radially from the rotational axis R-R; and (2) is perpendicular to a contact plane CP defined by the working surface of the head of the shaving apparatus 1000. Details regarding the determination of the contact plane CP in various embodiments of the head of the shaving apparatus 1000 will be discussed in greater detail below. It should be noted, however, that while the reference line RL1 is below the contact plane CP in the embodiments of FIGS. 7A-8B, in other embodiments the reference line RL1 may be located within or above the contact plane CP. In other words, in certain embodiments, the contact plane CP may comprise the reference line RL1 or may intersect the reference cylinder C-C In another embodiment, the contact apex CA of the rotary cutter is defined as the point of the rotary cutter 1300 located on the reference cylinder C-C that is the shortest distance from the contact plane, wherein the distance is measured orthogonal to the contact plane. When using this method of determining the contact apex CA, the contact may or may not be intersected by the reference line RL3.

Figure 20A:
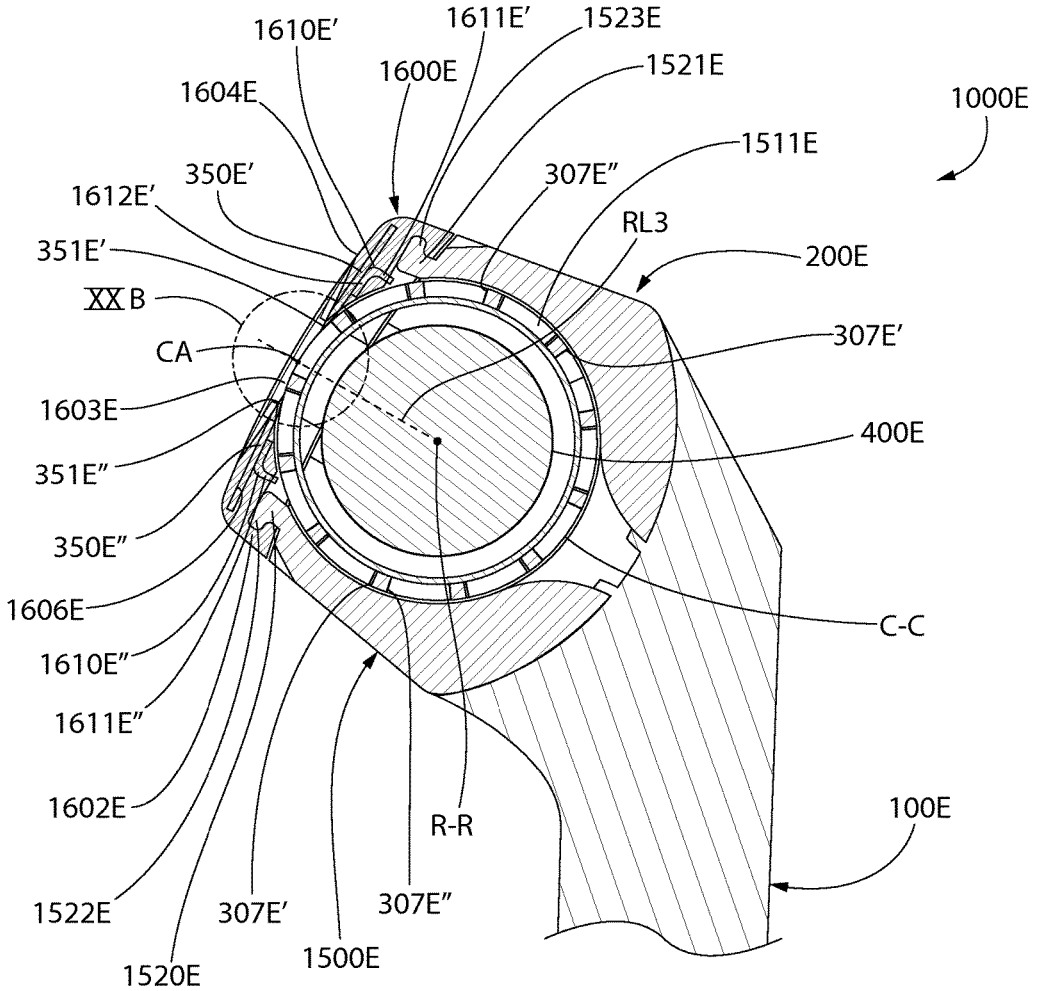
FIG. 20A is a transverse cross-sectional view of the head portion of the shaving apparatus of FIG. 17.
Figure 20B:
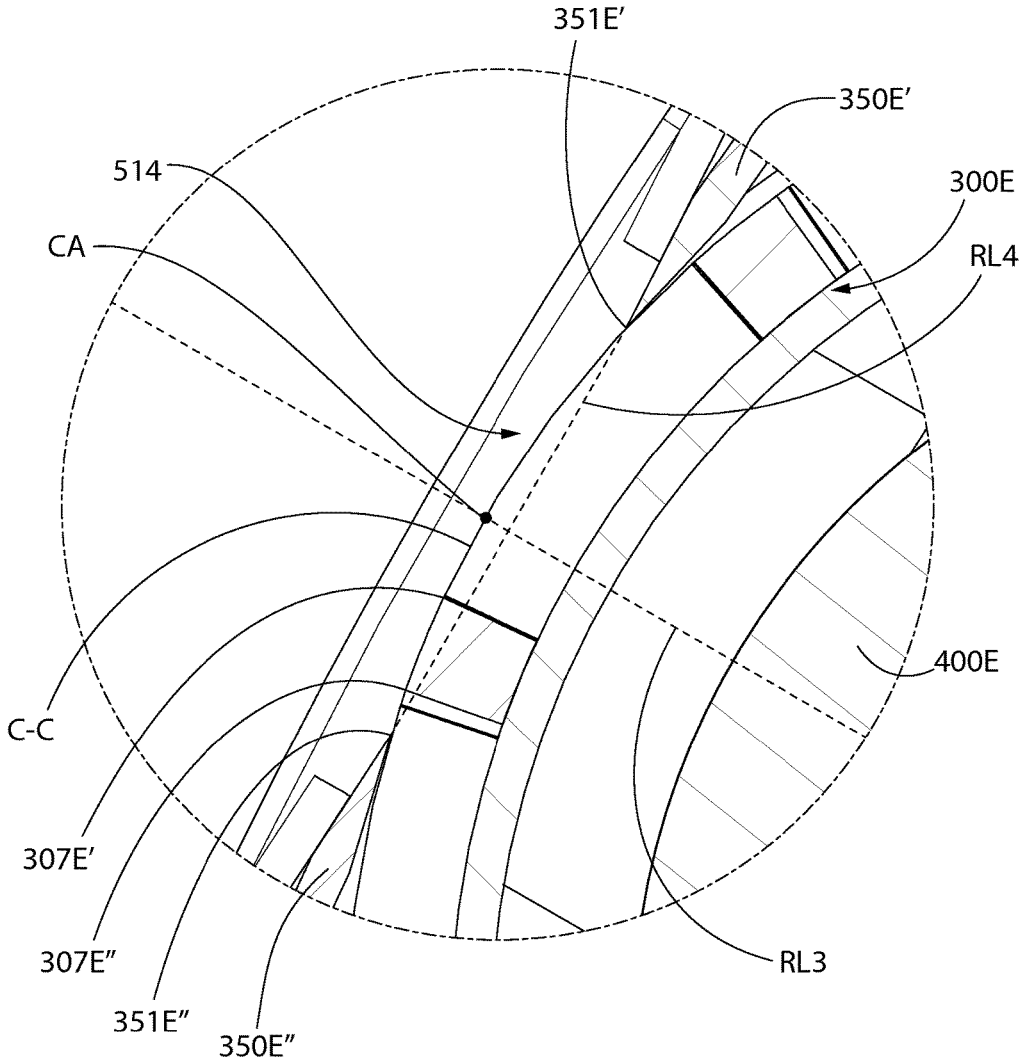
FIG. 20B is a close-up view of area XXB of FIG. 20A.
Figure 21:
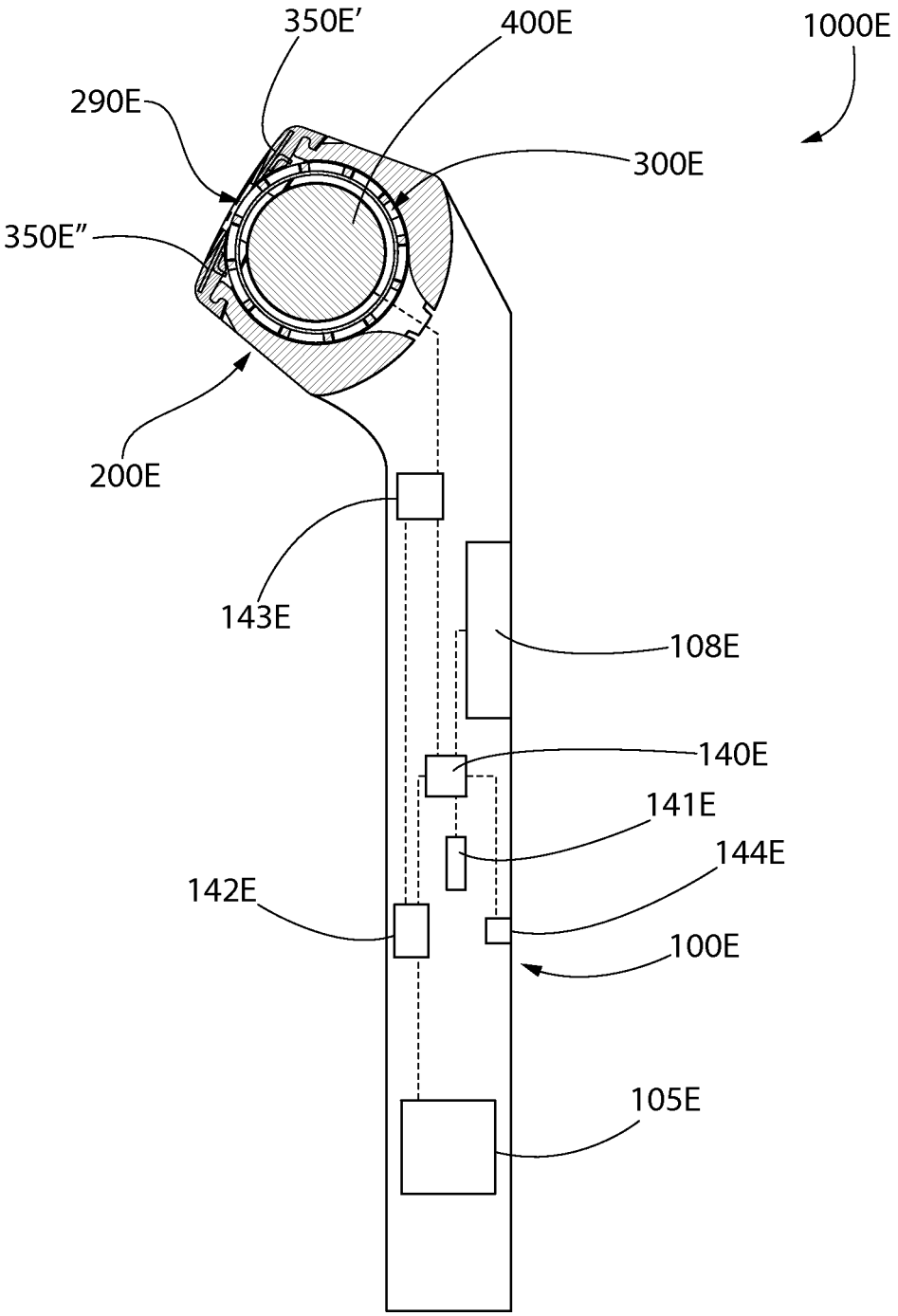
FIG. 21 is a schematic of the shaving apparatus of FIG. 17, wherein a control circuit is incorporated that allows selective rotation of the rotary cutter in either the clockwise or counter-clockwise directions of rotation according to the present invention.

Referring briefly to FIGS. 20A-20B, in certain other embodiments, the contact apex CA is defined independent of the contact plane CP. For example, in embodiments where the head 200, 200E of the shaving apparatus 1000, 1000E comprises a slot 514 through which a portion of the rotary cutter 300 is exposed for contact with the user's skin, the contact apex may be defined relative to a reference line RL4 that extends between opposing edges of the slot 514. In certain embodiments, on or more of these opposing edges may be formed by the cutting edge(s) 351E', 351E" of the fixed blade(s) 350E', 350E". In one embodiment, the reference RL4 extends perpendicular to the rotational axis R-R of the rotary cutter 300E. Specifically, in one such embodiment, the contact apex CA is defined as the point at which the reference line RL3 intersects the reference cylinder C-C (which is defined by the cutting edges 307E', 307E"), wherein the reference line RL3 both: (1) extends radially from the rotational axis R-R; and (2) is perpendicular to the reference line RL4 that extends between opposing edges of the slot 514.

Referring again to FIGS. 7A-B, in one embodiment, the position of the cutting edge 351 of the fixed blade 350 relative to the contact apex CA can be defined as having two parameters: (1) the horizontal component; and (2) the vertical component. The horizontal component (also referred to herein as the horizontal distance HD between the cutting edge 351 of the fixed blade 350 and the contact apex CA), in one embodiment, is the distance between the reference line RL3 and the cutting edge 351 of the fixed blade 350, measured along a direction that is parallel to a reference line RL1 that is tangent to reference cylinder C-C at the contact apex CA. In one embodiment, the fixed blade 350 is positioned so that the horizontal distance HD is in a range of 0 mm to 2 mm.

The vertical component (also referred to herein as the vertical distance VD between the cutting edge 351 of the fixed blade 350 and the contact apex CA), in one embodiment, is the distance between the cutting edge 351 of the fixed blade 350 and the reference line RL1 measured in a direction perpendicular to the reference line RL1. In the example of FIGS. 7A-B, the vertical distance VD is zero and, thus, is not illustrated. The example of FIGS. 8A-B, however, exemplifies a non-zero vertical distance VD.

In the embodiments of FIGS. 7A-B, the fixed blade 350 is a flat blade that extends from a first end 352 comprising the cutting edge 351 and a second end 353 opposite the first end 352 along a blade axis Z-Z. The fixed blade 350, in the embodiment of FIGS. 7A-B, is oriented so that the blade axis Z-Z extends parallel to the reference line RL1. In this specific embodiment, because the vertical distance VD is zero, the blade axis Z-Z and the reference line RL1 are coincident. In other embodiments, however, the fixed blade 350 is oriented so that the blade axis Z-Z extends at an incline relative to the reference line RL1. In one such embodiment, the fixed blade 350 is oriented so that the blade axis Z-Z is inclined to have a positive slope (measured from the second end 353 to the first end 352) relative to the reference line RL1. In another such embodiment, the fixed blade 350 is oriented so that the blade axis Z-Z is inclined to have a negative slope (measured from the second end 353 to the first end 352) relative to the reference line RL1.

Figure 8A:
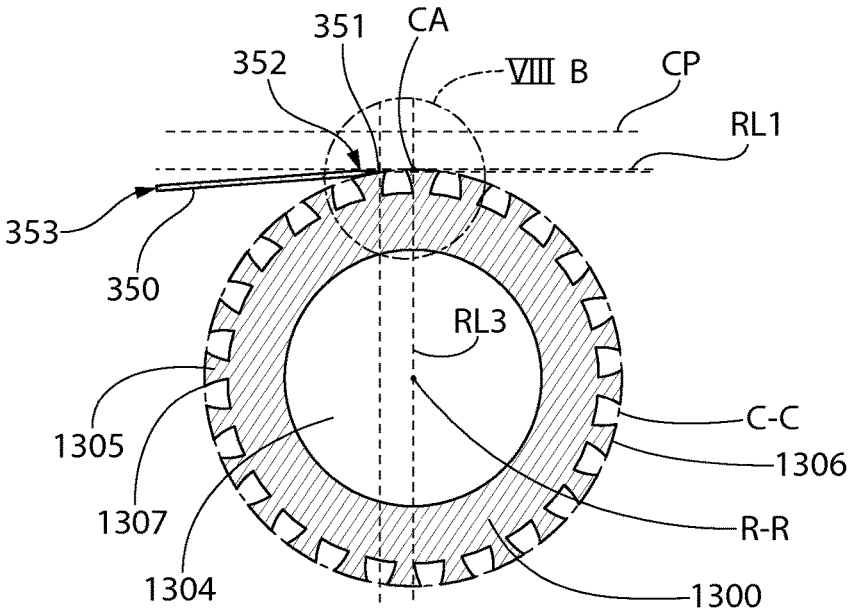
FIG. 8A is a schematic representation of the fixed blade being set in a desired position relative to the rotary cutter to achieve a desired horizontal and vertical distance between the cutting edge of the fixed blade and a contact apex of the rotary cutter in accordance with the present invention, wherein the fixed blade is oriented at an incline to a tangent line of the contact apex.
Figure 8B:
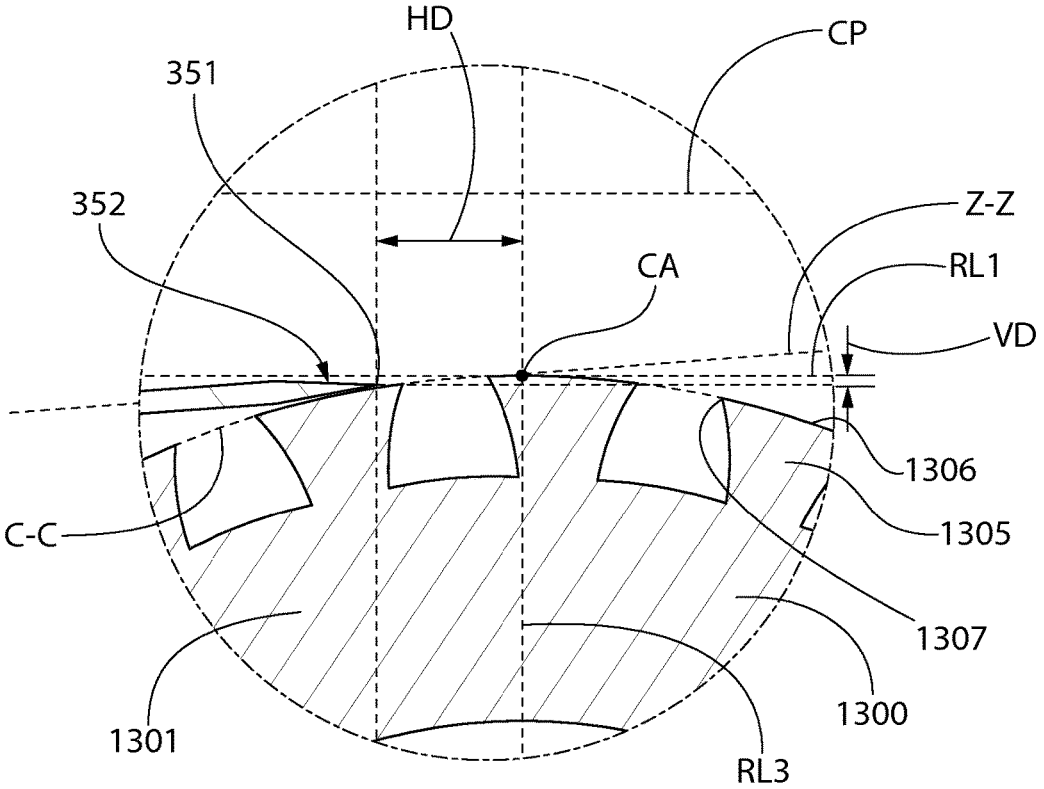
FIG. 8B is a close-up view of area VIIIB of FIG. 8A.

Referring now to FIGS. 8A-8B, an embodiment of the present invention in which the parameters of the position of the cutting edge 351 of the fixed blade 350 relative to the contact apex CA are precisely controlled according to the present invention is illustrated, and in which the fixed blade 350 is mounted so that the blade axis Z-Z—is inclined relative to the reference line RL1. In this embodiment, the blade axis Z-Z is inclined to have a positive slope (measured from the second end 353 to the first end 352) relative to the reference line RL1. Additionally, in this embodiment, both the cutting edge 351 of the fixed blade 350 and the second end 353 of the fixed blade 350 are located on the same side of the reference line RL1, namely the same side on which the rotary cutter 1300 is located. In other embodiments, the cutting edge 351 of the fixed blade 350 and the second end 353 of the fixed blade 350 are located on the opposite sides of the reference line RL1. In one such embodiment, the cutting edge 351 of the fixed blade 350 is above reference line RL1 while the second end 353 of the fixed blade 350 is below the reference line RL1. In still certain other embodiments, the fixed blade 350 is mounted so that the blade axis Z-Z—is inclined relative to the reference line RL1 to have a negative slope (measured from the second end 353 to the first end 352) relative to the reference line RL1.

As can be seen from FIGS. 8A-B, the vertical distance VD in this embodiment is non-zero. Specifically, in this embodiment, the cutting edge 351 of the fixed blade 350 is located a non-zero vertical distance VD from the contact apex CA below the reference line RL1. In another embodiment, the cutting edge 351 of the fixed blade 350 is located a non-zero vertical distance VD from the contact apex CA above the reference line RL1.

Referring now to FIGS. 9-12 concurrently, an embodiment of a head portion (i.e., head) 200A that can be used in the shaving apparatus 1000 instead of the head 200 of FIGS. 1-4 is illustrated. The head portion 200A is identical to the head 200 of FIGS. 1-4 in many structural and functional aspects. Thus, like reference numbers are used to identify like elements. Furthermore, the discussion of the head 200A will be limited to those aspects that differ from the head 200 with the understanding that the above discussion of the head 200 is applicable to the head 200A. Moreover, any of the structural and/or functional aspects discussed above for the head 200 of FIGS. 1-4 can be incorporated into the head 200A if not already present.

For purposes of this discussion, the primary difference between the head 200A and the head 200 is that the head 200A includes registration features for the fixed blade 350 that accomplish accurate, consistent, and reproducible positioning of the fixed blade 350 relative to the rotary cutter 1300. Thus, when the fixed blade 350 is put into operable engagement with the registration features of the head 200A (discussed in greater detail below), the positioning of the cutting edge 351 of the fixed blade 350 relative to the contact apex CA can be reliably controlled in terms of the parameters discussed above with respect to FIGS. 7A-8B, namely: (1) a predetermined horizontal distance between the cutting edge 351 of the fixed blade 350 and the contact apex CA of the rotary cutter 1300; and/or (2) a predetermined vertical distance between the cutting edge 351 of the fixed blade 350 and the contact apex CA of the rotary cutter 1300. Additionally, the registration features of the head 200 can dictate the orientation of the fixed blade 350 relative to the reference line RL1, as also discussed above with respect to FIGS. 7A-8B.

The head 200A generally comprises a support structure 500, a rotary cutter 1300 (the type of which is described above with respect to FIG. 6), a fixed blade 350, and a blade retaining member 800. The support structure 500 comprises a first end wall 505, a second end wall 506, and an elongate body 503 extending between and connecting the first and second end walls 505, 506 together. In the exemplified embodiment, the first end wall 505 is integrally formed with the elongated body 503 while the second end wall 506 is a separate structure that is detachably coupled to the elongated body 503 via fastener 507. In other embodiments, the first end wall 505 is also a separate structure that is subsequently coupled to the elongated body 503 so as to be detachable or permanently fixed.

The elongated body 503 comprises a cavity 511 that sized and shaped so that the rotary cutter 1300 can be nested therein. While not visible, the electric motor 400 is disposed within and operably coupled to the rotary cutter 1300 of the head 200A in a manner similar to that discussed above for the head 200. More specifically, the electric motor 400 is operably coupled to rotary cutter 1300 so as to be capable of rotating the rotary cutter 1300 about the rotational axis R-R. In other embodiments, the electric motor 400 is located outside of the rotary cutter 1300 in either the head 200A or in the handle of the shaving apparatus 1000 to which the head 200A is coupled.

The rotary cutter 1300, which comprises a plurality of cutting edges 1307, is mounted to the support structure 500 so as to be rotatable relative to the support structure about a rotational axis R-R. More specifically, each of the ends of the rotary cutter 1300 is rotatably supported respectively by each of the first and second end walls 505, 506 via the first and second bearings 250, 251 as discussed above for the head 200 (only bearing 251 is visible in FIG. 8). Thus, the first end wall 505 comprises a first bearing mounting recess 508 on its inner surface while the second end wall 560 comprises a second bearing mounting recess 509 on its inner surface. When mounted to the support structure 500 as disclosed herein, the rotary cutter 1300, comprises an outer surface 1306 defining a reference cylinder C-C that is centered about the rotational axis R-R and comprises a contact apex CA (shown in FIG. 10).

Figure 12:
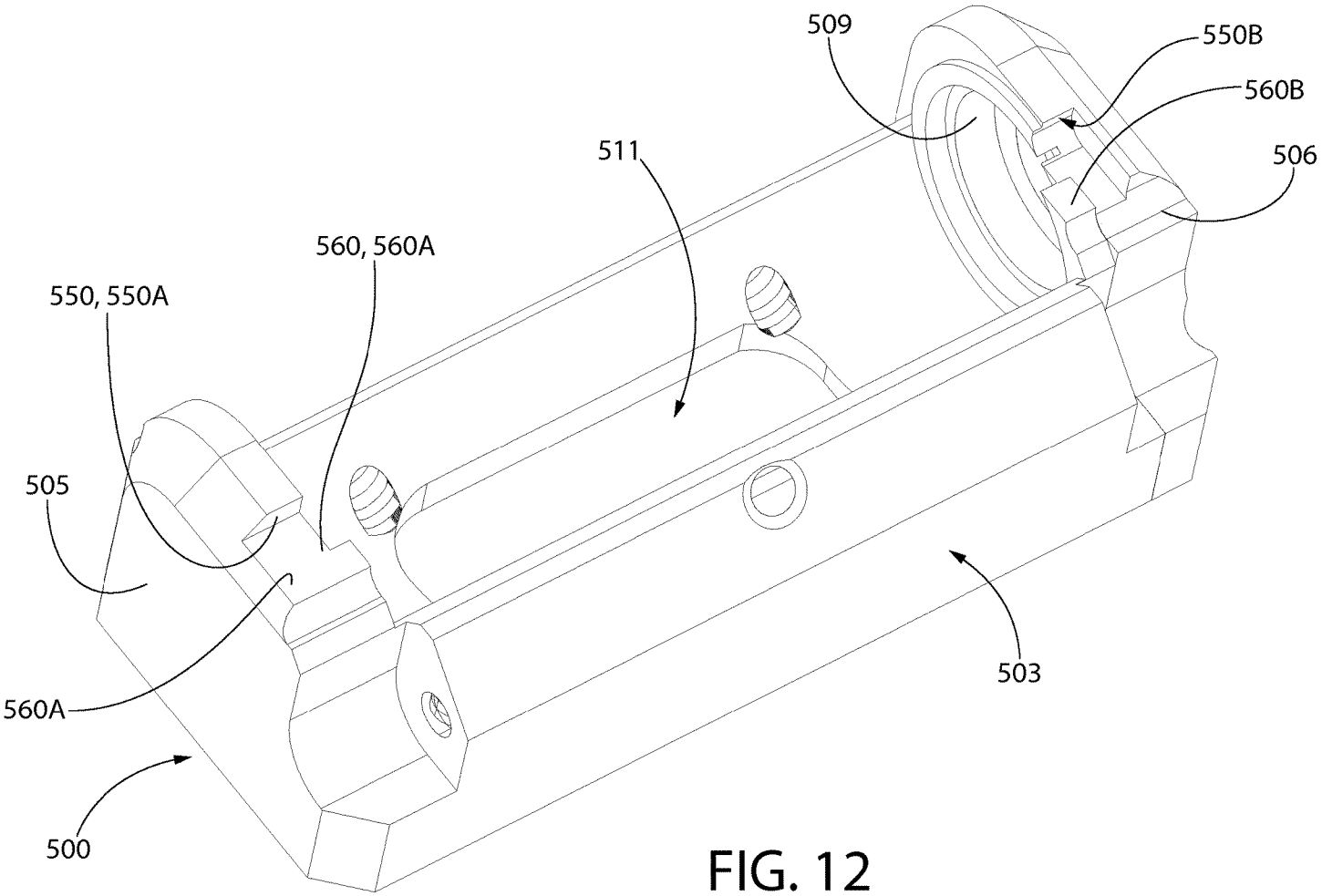
FIG. 12 is a rear perspective view of the support structure of the head portion of FIG. 9.

Of relevance to the accurate positioning of the fixed blade 350 relative to the rotary cutter 300, the support structure 500 of the head 200A comprises a horizontal registration feature 550 and a vertical registration feature 560 (best visible in FIG. 12). In the exemplified embodiment, the vertical registration feature 560 comprises: (1) a first upper surface 560A for engaging a bottom surface 355 of the fixed blade 350 at or near a third end 356 of the fixed blade 350; and (2) a first upper surface 560B for engaging the bottom surface 355 of the fixed blade 350 at or near a fourth end 357 of the fixed blade 350. The first upper surface 560A of the vertical registration feature 560 is located on the first end wall 505 while the second upper surface 560B is located on an arm 508 of the elongated body 503 that is located adjacent the second end wall 506. In other embodiments, the second upper surface 560B is located on the second end wall 506 in a manner similar to how the first upper surface 560A is located on the first end wall 505. In still other embodiments, the vertical registration feature 560 is located entirely on the elongate body 503 in the form of one or more upper surfaces to which the bottom surface 355 of the fixed blade 350 can be put into engagement therewith.

In the exemplified embodiment, the horizontal registration feature 550 comprises: (1) a first upstanding sidewall surface 550A for engaging the first end 352 of the fixed blade 350 at or near the third end 356 of the fixed blade 350; and (2) a second upstanding sidewall surface 550B for engaging the first end 352 of the fixed blade 350 at or near the fourth end 357 of the fixed blade 350. The first upstanding sidewall surface 550A of the horizontal registration feature 550 is located on the first end wall 505 while the second upstanding sidewall surface 550B of the horizontal registration feature 550 is located on the second end wall 506. In other embodiments, the horizontal registration feature 550 is located entirely on the elongate body 503 in the form of one or more upstanding sidewall surfaces to which the second edge 353 of the fixed blade 350 can be put into engagement therewith.

As can best be seen in FIG. 12, the first upstanding sidewall surface 550A of the horizontal registration feature 550 is substantially perpendicular to the first upper surface 560A of the vertical registration feature 560. Moreover, because each of the first upstanding sidewall surface 550A and the first upper surface 560A is located on the first end wall 505, the first upstanding sidewall surface 550A intersects and extends upward from the first upper surface 560A. As exemplified, each of the first upstanding sidewall surface 550A and the first upper surface 560A are planar in nature. In other embodiments, however, either or both of the first upstanding sidewall surface 550A and the first upper surface 560A may be contoured.

Similarly, the second upstanding sidewall surface 550B of the horizontal registration feature 550 is substantially perpendicular to the second upper surface 560B of the vertical registration feature 560. However, because the second upstanding sidewall surface 550B is located on the second end wall 506 and the second upper surface 560B is located on the elongate body 503, the second upstanding sidewall surface 550B and the second upper surface 560B do not intersect but are rather spatially isolated from one another. As exemplified, each of the second upstanding sidewall surface 550B and the second upper surface 560B are planar in nature (at least at the area at which contact with the fixed blade 250 is made). In other embodiments, however, either or both of the second upstanding sidewall surface 550B and the second upper surface 560B may be contoured.

Referring now to FIGS. 9, 10A-B, and 12 concurrently, it can be seen that the fixed blade 350 is mounted to the support structure 500 so that: (1) the fixed blade 350 is in operable engagement with the horizontal registration feature 560 to position the cutting edge 351 of the fixed blade 350 at a predetermined horizontal distance HD from the contact apex CA of the reference cylinder C-C; and (2) the fixed blade 350 is in operable engagement with the vertical registration 550 feature to position the cutting edge 351 of the fixed blade 350 at a predetermined vertical distance VD from the contact apex CA of the reference cylinder C-C. In the exemplified embodiment, the operable engagement between the fixed blade 350 and the horizontal registration feature 560 comprises abutment of the cutting edge 351 of the fixed blade 350 with the first and second upstanding sidewall surfaces 550A, 5501B. Similarly, in the exemplified embodiment, the operable engagement between the fixed blade 350 and the vertical registration feature 550 comprises abutment of the bottom surface 355 of the fixed blade 350 with the first and second upper surfaces 560A, 560B.

In other embodiments, the operable engagement between the fixed blade 350 and the horizontal registration feature 560 comprises abutment of the second end 353 of the fixed blade 350 with one or more upstanding sidewall surfaces located on the elongated body 503, the first end wall 505, and/or the second end wall 506.

In one embodiment, operable engagement between the fixed blade 350 and the horizontal and vertical registration features 550, 560 is achieved by simply bringing the desired portions of the fixed blade 350 into abutment with the horizontal and vertical registration features 550, 560 and fixedly coupling the fixed blade 350 to the support structure 500. Such fixed coupling can be accomplished by an adhesive, a fastener, or other means of fixed coupling. In other embodiments, such as the exemplified one, the fixed blade 350 is fixedly mounted to the support structure 500 through the use of the retaining member 800. The retaining member 800 is coupled to the elongated body 503 of the support structure 500 via a fastener 510. When the retaining member 800 is coupled to the support structure 500, the fixed blade 350 is captured between the retaining member 800 and the support structure 500. In one embodiment, the retaining member 800 will simply maintain the fixed blade 350 in the position it is when the retaining member 800 is coupled to the support structure 500. In such an embodiment, it should be ensured that the fixed blade 350 is in operable engagement with the vertical and horizontal registration features 550, 560 prior to coupling of the retaining member 800. In another embodiment, such as the exemplified one, the retaining member may comprise one or more resilient elements 801, which are in the form of arms, that contact the fixed blade 350 when the retaining member 800 is coupled to the support structure 500 and bias the fixed blade 350 into operable engagement with the vertical and horizontal registration features 550, 560. In such an embodiment, the retaining member 800 it is not necessary that the fixed blade 350 be in operable engagement with the vertical and horizontal registration features 550, 560 prior to coupling of the retaining member 800 to the support structure 500 as the retaining member itself will move the fixed blade 350 into said operable engagement.

The horizontal and vertical registration features 550, 560 are precisely located on the support structure 500 so as to be aligned relative to the rotational axis R-R, taking into consideration the diameter of the reference cylinder C-C. Thus, the positioning of the cutting edge 351 of the fixed blade 350 relative to the contact apex. CA can be reliably established to predetermined values by simply ensuring that the fixed blade 350 is mounted to the support structure 500 so that the fixed blade 350 is in operable engagement with both the horizontal and vertical registration features 550, 560. Thus, the operable engagement of the fixed blade 350 with both the horizontal and vertical registration features 550, 560 will result in the cutting edge 351 of the fixed blade 350 being: (1) at a predetermined horizontal distance HD from the contact apex CA of the reference cylinder C-C; and (2) at a predetermined vertical distance VD from the contact apex CA of the reference cylinder C-C.

As discussed above, the predetermined horizontal distance HD is the distance between the reference line RL3 and the cutting edge 351 of the fixed blade 350, measured along a direction that is parallel to the reference line RL1. The predetermined vertical distance VD is the distance between the cutting edge 351 of the fixed blade 350 and the reference line RL1 measured in a direction perpendicular to the reference line RL1. In the exemplified embodiment of FIGS. 9-12, the head portion comprises a working surface 290 that defines a skin contact plane CP. In this embodiment, the working surface 290 and the skin contact plane CP are coincident and are formed by the combination of the top surface 358 of the fixed blade 350 and the top surface 805 of the retaining member 800.

In the exemplified embodiment, the vertical and horizontal registration features 550, 560 are positioned and oriented so that the blade axis Z-Z of the fixed blade 350 (see discussion above from FIGS. 7A-8B for determination of the blade axis Z-Z) extends substantially parallel to the reference line RL1. However, in other embodiments, the vertical and horizontal registration features 550, 560 are positioned and oriented so that the blade axis Z-Z of the fixed blade 350 is inclined relative to the reference line RL1. The inclination may have a positive slope or a negative slope as discussed above with respect to FIGS. 7A-8B.

Figure 9:
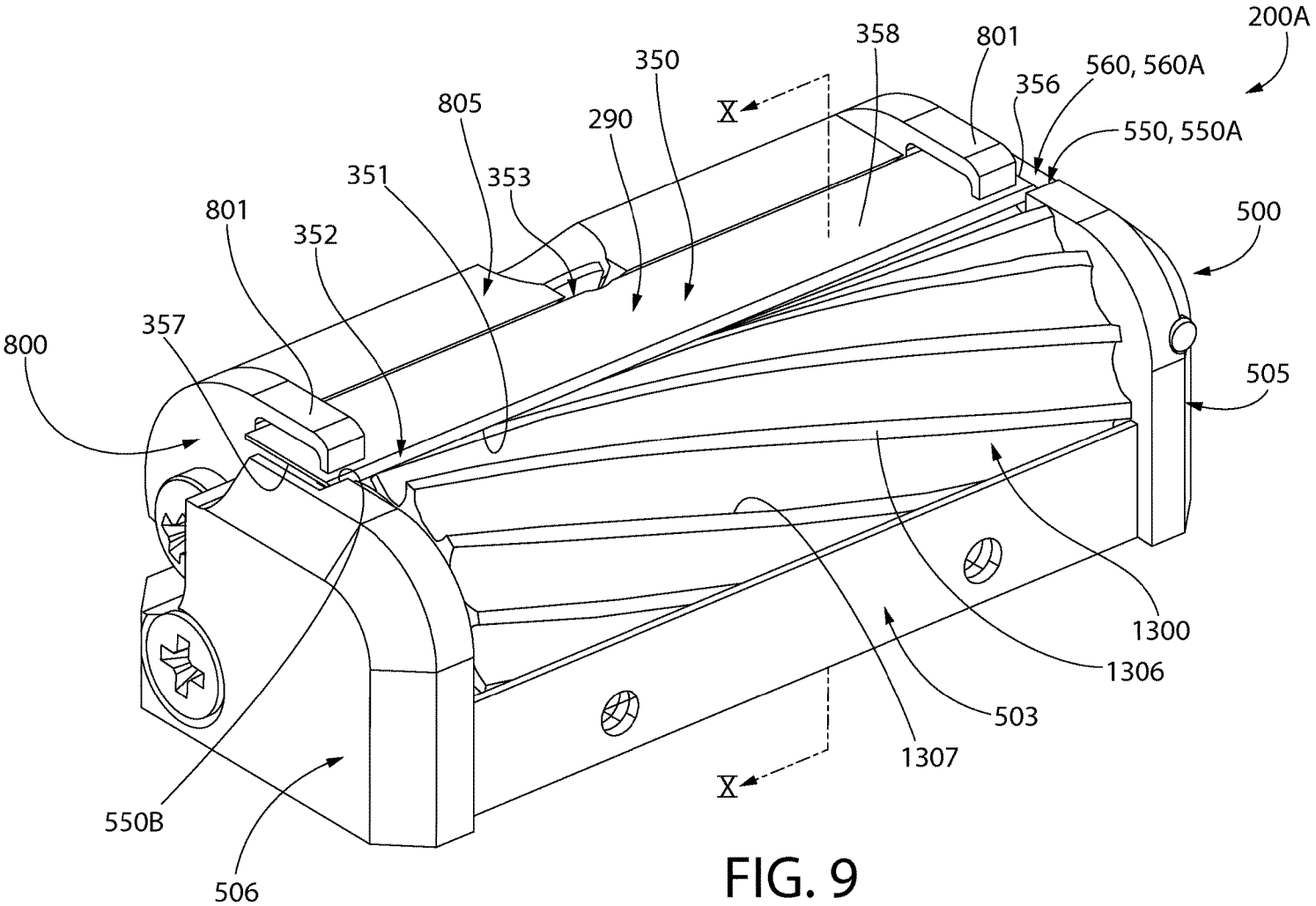
FIG. 9 is a front perspective view of a head portion of a shaving apparatus according to an embodiment of the present invention, wherein a support structure of the head portion includes a vertical registration feature and a horizontal registration feature for benching the fixed blade in a desired position relative to the rotary cutter.
Figure 11:
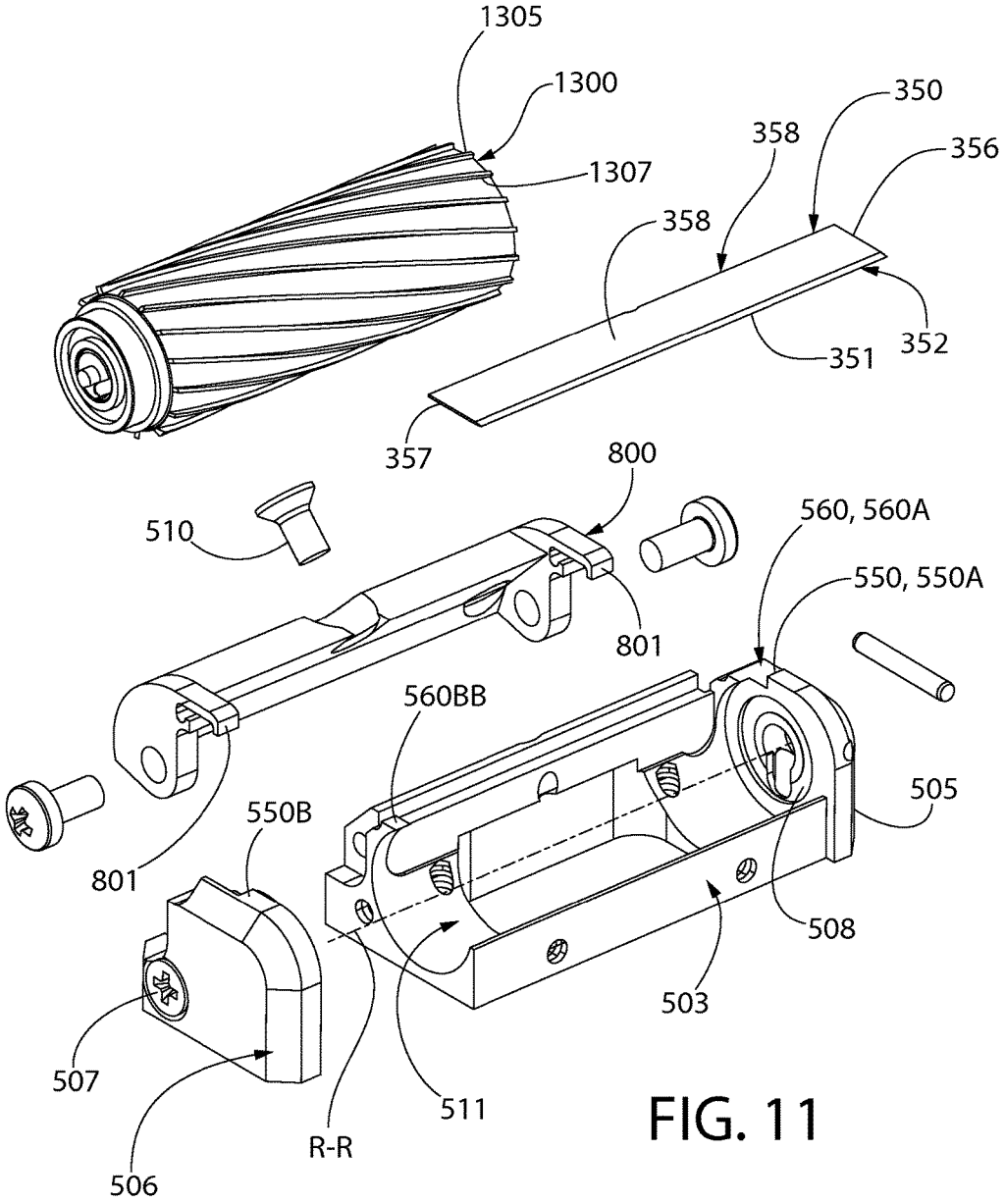
FIG. 11 is an exploded view of the head portion of FIG. 9.
Figure 13:
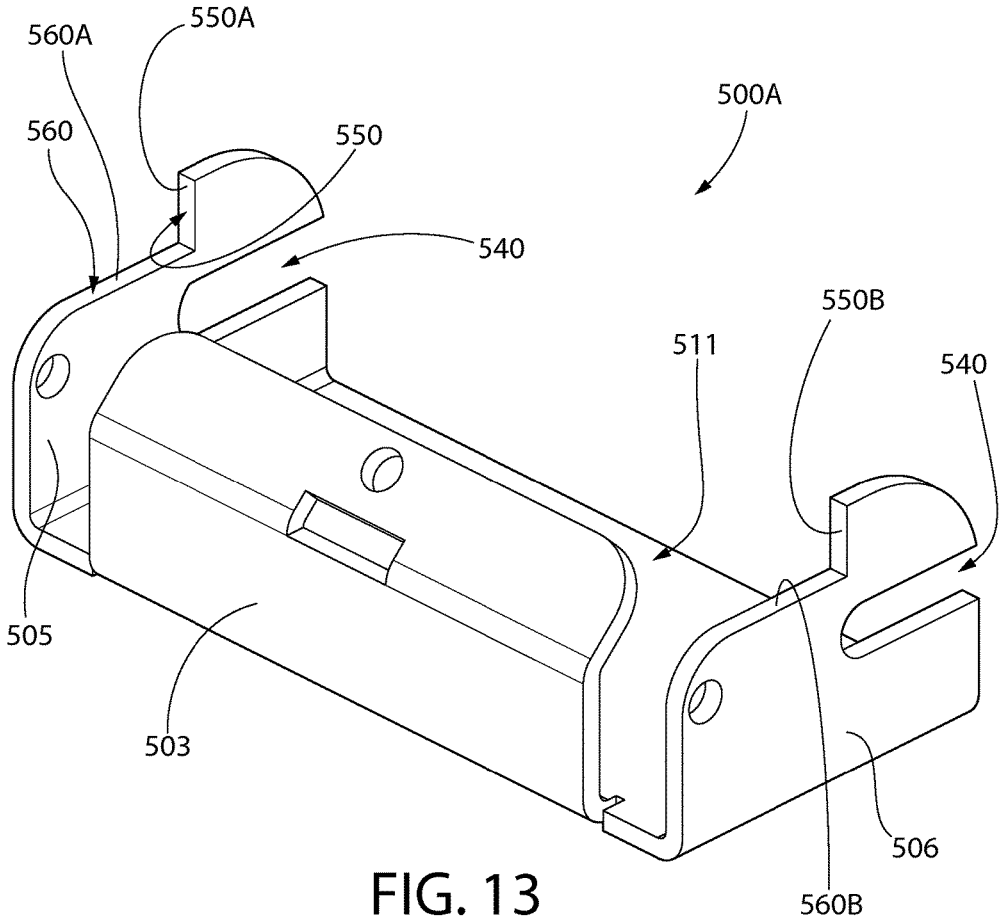
FIG. 13 is a rear perspective view of another embodiment of a support structure that can be used in a head portion of a shaving apparatus according to the present invention, wherein the support structure includes a vertical registration feature and a horizontal registration feature for benching the fixed blade in a desired position relative to the rotary cutter.

Turning now to FIG. 13, a further embodiment of a support structure 500A is exemplified that can be used in place of the support structure 500 of FIGS. 9-11 to provide registration for the fixed blade. The support structure 500A is identical to the support structure 500 of FIGS. 9-11 in many structural and functional aspects. Thus, like reference numbers are used to identify like elements. Furthermore, the discussion of the support structure 500A will be limited to those aspects that differ from the support structure 500 with the understanding that the above discussion of the support structure 500 is applicable to the support structure 500A.

The support structure 500A generally comprises a first end wall 505, a second end wall 506, and an elongate body 503 extending between and connecting the first and second end walls 505, 506 together. The support structure 500A is an integrally formed unitary component, which may be formed, for example, by cutting and bending a metal sheet or metal plate. Each of the first and second end walls 505, 506 of the support structure 500A comprise a slot 540 in which the assembly of the motor 400 and the rotary cutter 1300 can be inserted and rotatably mounted. In an embodiment, each of the slots 540 is open at one end. In one such embodiment, securing the assembly of the motor 400 and rotary cutter 1300 in place may requires a pin or wedge that does not have to be precise in its placement.

The support structure 500A also includes horizontal and vertical registration features 550, 560 for the fixed blade 350. In this embodiment, the vertical registration feature 560 comprises a first upper surface 560A located on the first end wall 505 and a second upper surface 560B located on the second end wall 506. Similarly, the horizontal registration feature 560 comprises a first upstanding sidewall surface 550A located on the first end wall 505 and a second upstanding sidewall surface 550B located on the second end wall 506. The first upstanding sidewall surface 550A of the horizontal registration feature 550 is substantially perpendicular to the first upper surface 560A of the vertical registration feature 560. Similarly, the second upstanding sidewall surface 550 of the horizontal registration feature 550 is substantially perpendicular to the second upper surface 560B of the vertical registration feature 560.

When the fixed blade 350 is mounted to the support structure 500A, the bottom surface 355 of the fixed blade 350 operably engages the first and second upper surfaces 560A, 560B while the cutting edge 351 of the fixed blade 350 operably engages the first and second upstanding sidewalls 350A, 350B.

In the support structure 500A, the only dimension requiring high accuracy is the distance between the ends of the slots 540 that define the position of the rotational axis and the surfaces defining the horizontal and vertical registration features 550, 560.

Figure 14:
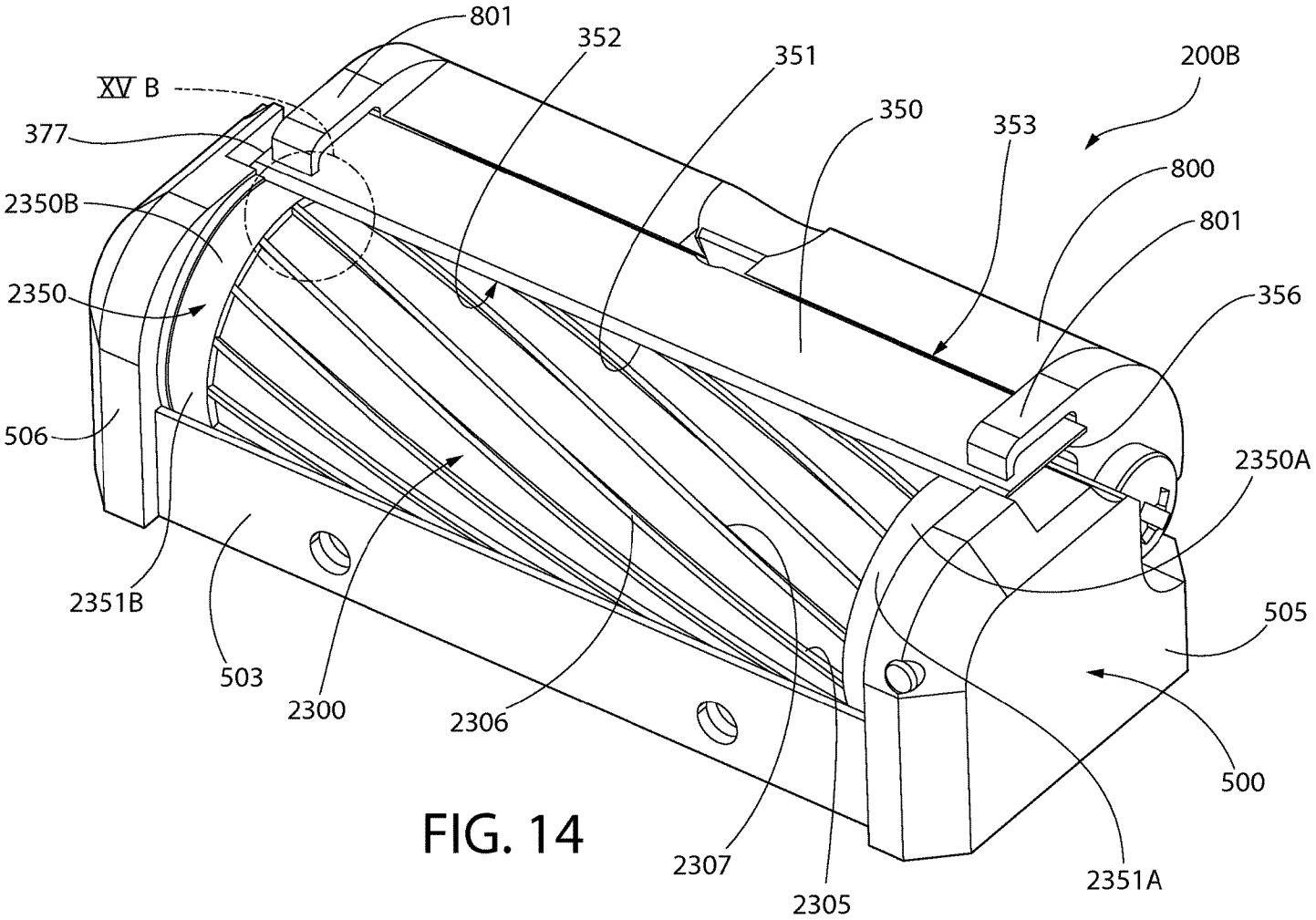
FIG. 14 is a front perspective view of a head portion of a shaving apparatus according to a further embodiment of the present invention, wherein the fixed blade is benched against a registration feature of the rotary cutter that fixes the fixed blade in a desired position relative to the rotary cutter.
Figure 15A:
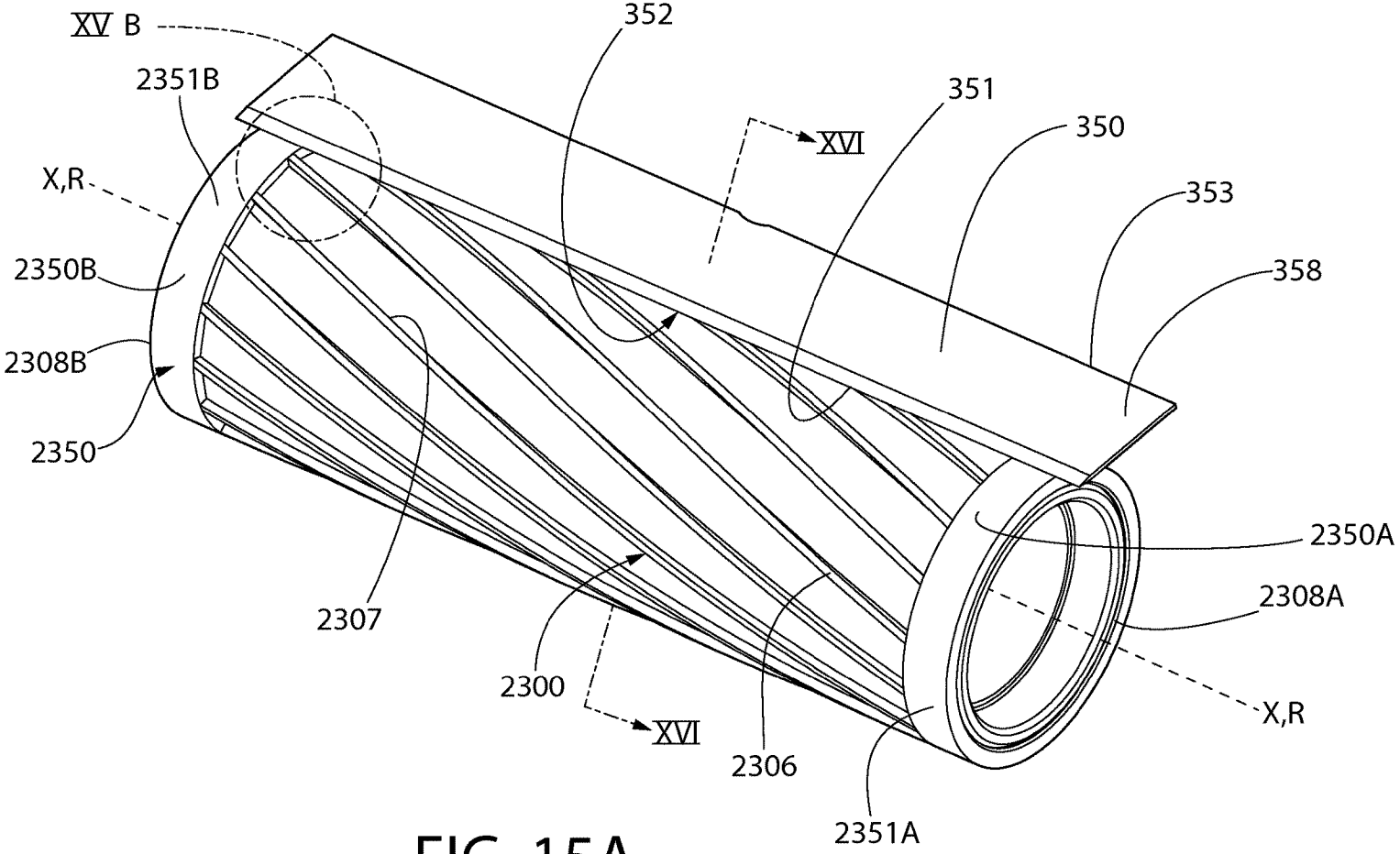
FIG. 15A is a perspective view of the rotary cutter and fixed blade of the head portion of FIG. 14, wherein the fixed blade is benched against a registration feature of the rotary cutter.
Figure 15B:
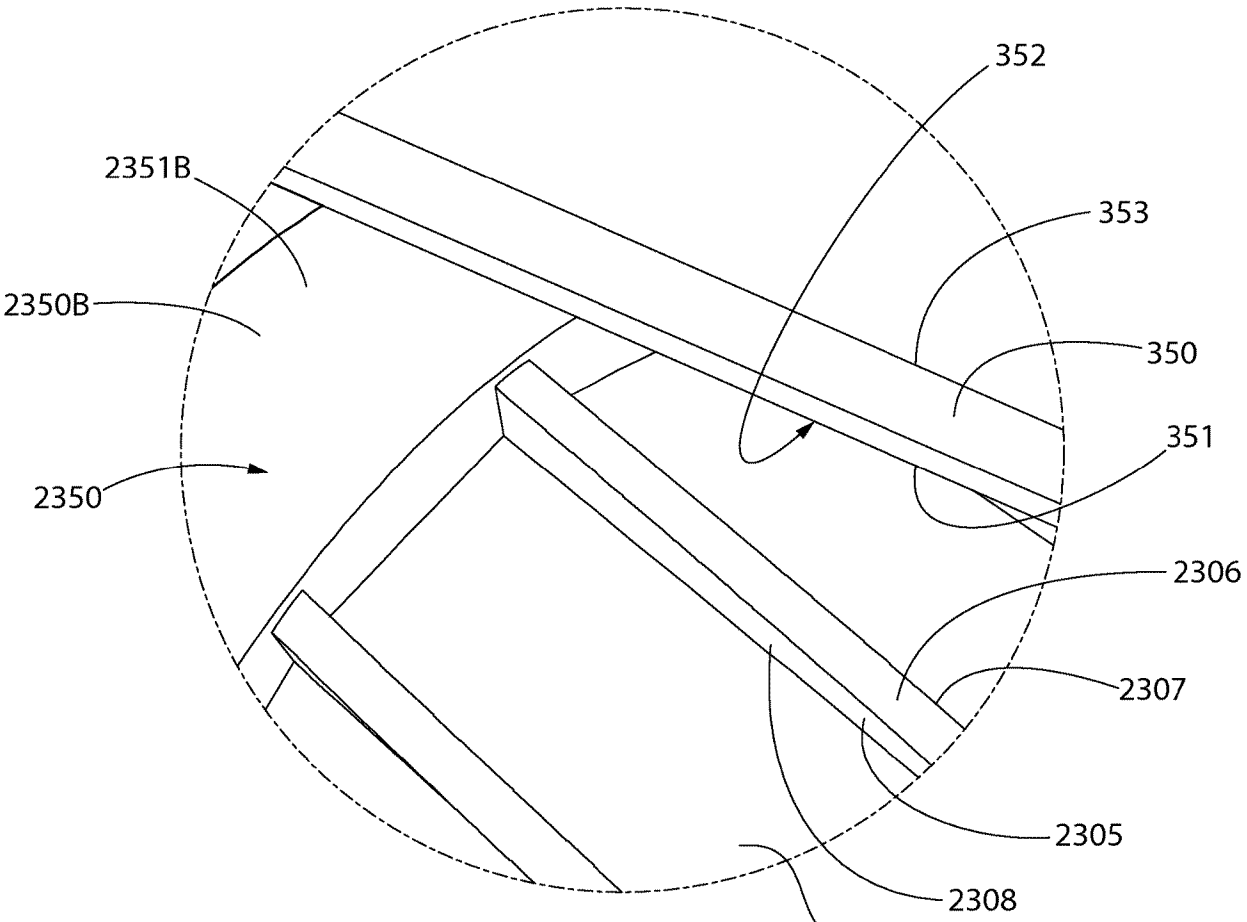
FIG. 15B is a close-up view of area XVB of FIG. 15A.
Figure 16:
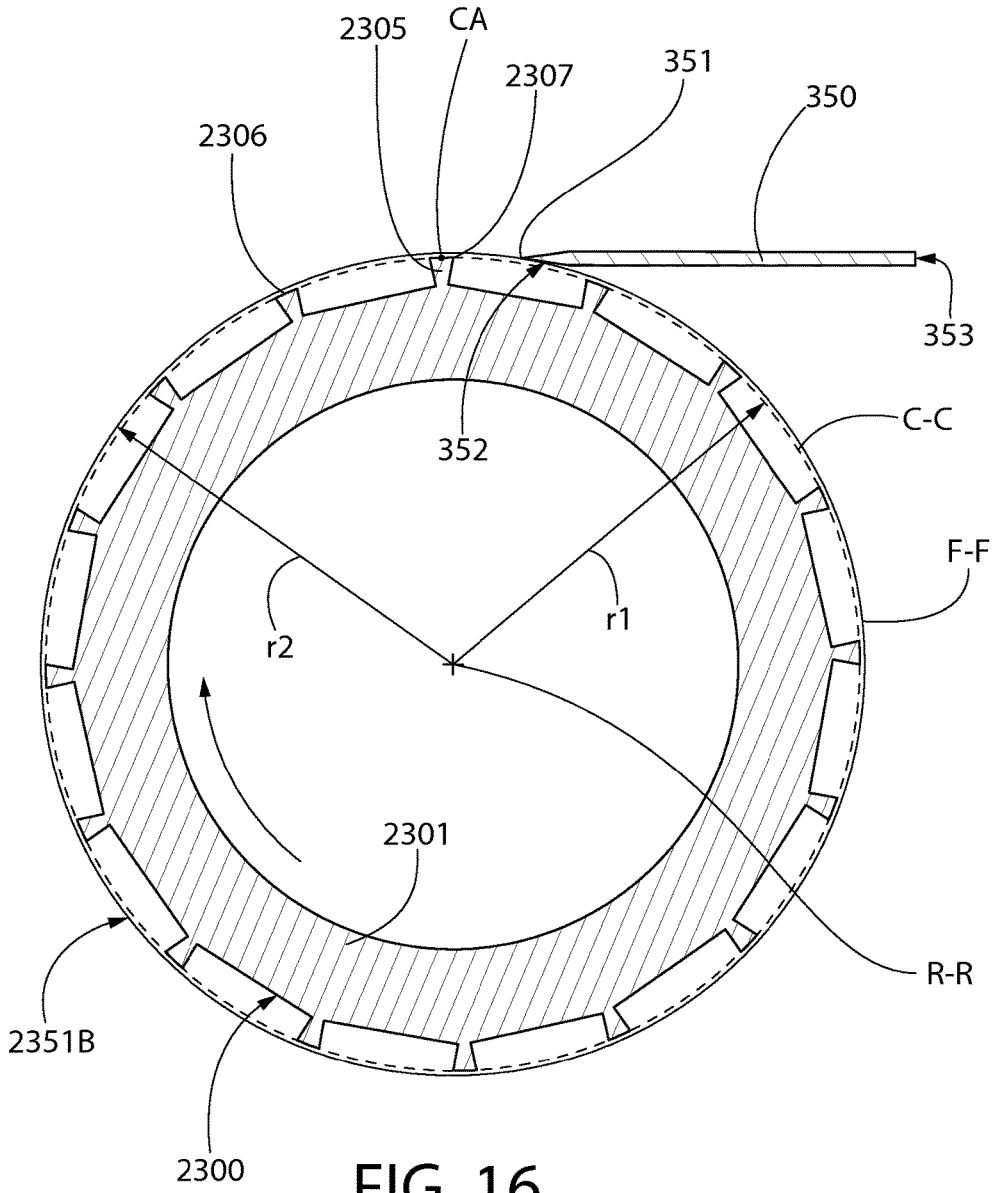
FIG. 16 is a transverse cross-sectional view of the rotary cutter and the fixed blade of FIG. 15A.
Figure 17:
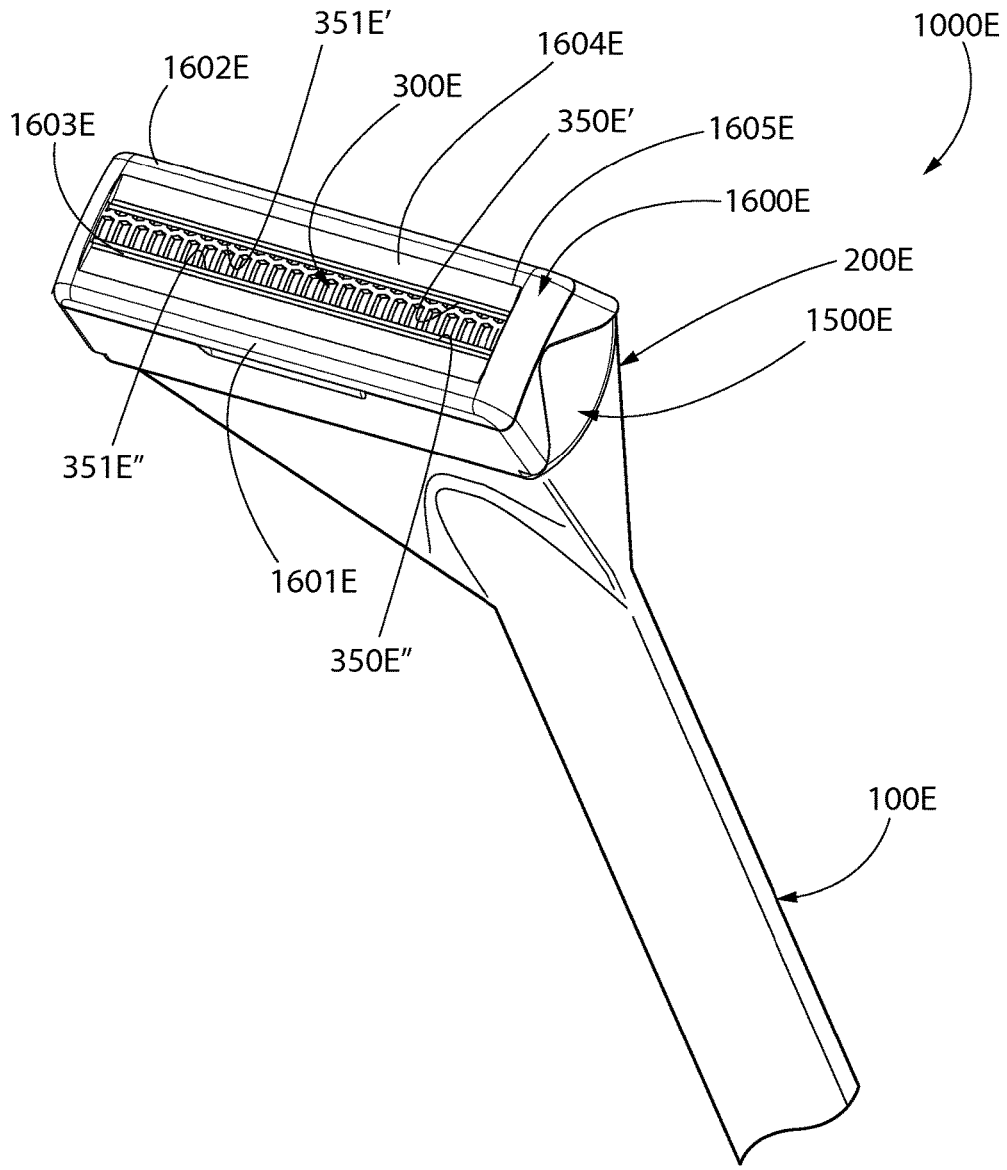
FIG. 17 is a front perspective view of a shaving apparatus according to a further embodiment of the present invention, wherein the head portion comprises a detachable cover-blade assembly.
Figure 18:
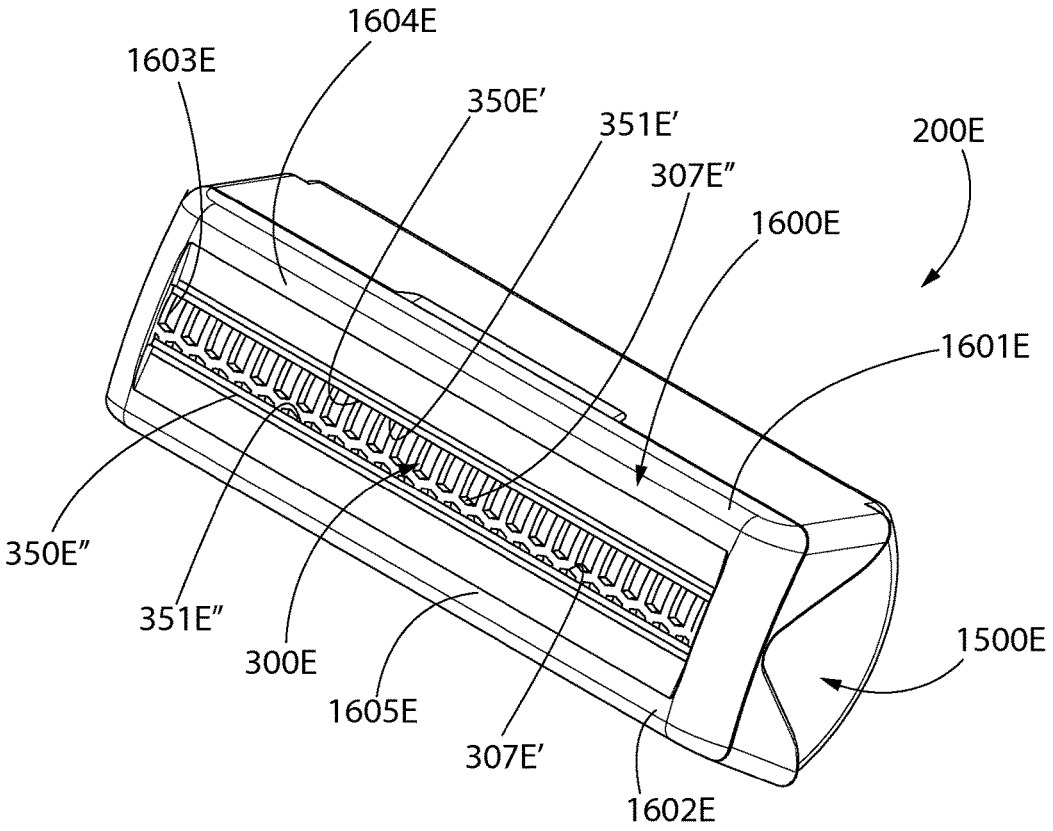
FIG. 18 is a front perspective view of the head portion of the shaving apparatus of FIG. 17.

Referring now to FIGS. 14-16 concurrently, an embodiment of a head portion (i.e., head) 200B that can be used in the shaving apparatus 1000 instead of the heads 200, 200A is illustrated. The head 200B is identical to the head 200A in many structural and functional aspects. Thus, like reference numbers are used to identify like elements. Furthermore, the discussion of the head 200B will be limited to those aspects that differ from the head 200A with the understanding that the above discussion of the head 200A is applicable to the head 200B. Moreover, any of the structural and/or functional aspects discussed above for the heads 200, 200A can be incorporated into the head 200B if not already present.

As with the head 200A, the head 200B includes a registration feature in which the fixed blade 350 is brought into operable engagement to accurately control positioning of the cutting edge 351 of the fixed blade 350 relative to the contact apex CA. However, unlike the head 200A, the registration feature of the head 200B is formed on the rotary cutter 2300 rather than (or in addition to) being formed on the support structure.

As with the rotary cutter 1300, the rotary cutter 2300 comprises a plurality of spaced-apart ridges 2305 protruding from the cylindrical body 2301. The ridges 2305 extend radially outward from the cylindrical body 2301 and terminate in convex outer surfaces 2306 that collectively define a reference cylinder C-C that is concentric to the rotational axis R-R (which is also coincident with the longitudinal central axis X-X of the rotary cutter 2300). Each of the ridges 2305 includes a sharpened cutting edge 2307. In the exemplified embodiment, each of the cutting edges 2307 is formed by the sharp intersection of the convex outer surfaces 2306 of the ridges 2305 and sidewall surfaces 2308 of the ridges 2305. As a result of the aforementioned structure, the rotary cutter 2300 comprises a plurality of spaced-apart cutting edges 2307.

However, unlike the rotary cutter 1300, the rotary cutter 2300 further comprises a registration feature 2350 to which the first end 352 that comprises the cutting edge 351 of the fixed blade 350 can be brought into operable engagement with to establish accurate positioning of the cutting edge 351 of the fixed blade 350 relative to the contact apex CA. The registration feature 2350, in the exemplified embodiment, is in the form of first and second portions 2350A, 2350B. Each of the portions 2350A, 2350B comprises a smooth outer annular surface 2351A, 2351B, respectively, that circumscribes the rotational axis R-R (which is also coincident with the central longitudinal axis X-X).

In the exemplified embodiment, the first and second portions 2350A, 2350B are raised relative to the ridges 2305 of the rotary cutter 2300. Conceptually, and as is best visible in FIGS. 15B and 16, the convex outer surfaces 2306 of the ridges 2305 collectively define a first reference cylinder C-C about the rotational axis R-R. The first reference cylinder C-C has a first radius r1 measured from the rotational axis R-R (which is also coincident with the central longitudinal axis X-X). Similarly, each of the outer annular surfaces 2351A, 2351B are located on (i.e., lie within and/or define) a second reference cylinder F-F that is concentric about the rotational axis R-R. The second reference cylinder F-F has a second radius r2 measured from the rotational axis R-R (which is also coincident with the central longitudinal axis X-X). The second radius r2 is greater than the first radius r1. In one embodiment, the difference between the second and first radii (r2−r1) is in a range of 0.01 to 50 microns. In certain embodiments, the difference between the second and first radii defines a gap (having a predetermined size) between the cutting edge 351 of the fixed blade 351 and the cutting edges 2307 of the rotary cutter 2300.

In another embodiment, is possible that the registration feature 2350 is designed such that the outer annular surfaces 2351A, 2351B are not raised relative to the ridges 2305 but rather flush therewith. In such an embodiment, the first and second reference cylinders C-C, F-F would be concentric to one another such that the difference between the second and first radii (r2−r1) is substantially zero.

In the exemplified embodiment, the first portion 2350A is located at a first axial end 2308A of the rotary cutter 2300 while the second portion 2350B is located at a second axial end 2308B of the rotary cutter 2300. As a result, when the head 200B is assembled, the portion of the first end 352 of the fixed blade 350 adjacent the third end 356 of the fixed blade 350 is in contact with the first portion 2350A of the registration feature 2350 of the rotary cutter 2300 while the portion of the first end 352 of the fixed blade 350 adjacent the fourth end 357 of the fixed blade 350 is in contact with the second portion 2350B of the registration feature 2350 of the rotary cutter 2300.

Contact between the first end 352 of the fixed blade 350 and the registration feature 2350 of the rotary cutter 2300 is maintained, in one embodiment, by the retaining member 800. When coupled to the elongate body 503, the retaining member 800 presses the first end 352 of the fixed blade 350 into contact with the registration feature 2350 of the rotary cutter 2300. In one embodiment, the retaining member 800 comprises one or more resilient elements 801 that continually bias the first end 352 of the fixed blade 350 into contact with the registration feature 2350 of the rotary cutter 2300.

It should be noted that the registration feature 2350 of the rotary cutter 2300, in certain embodiments, is used in combination with one or the other of the horizontal registration feature 550 or the vertical registration feature 560 of the support structure 500. In one such embodiment where the registration feature 2350 of the rotary cutter 2300 is used in combination with the horizontal registration feature 550, the registration feature 2350 of the rotary cutter 2300 will act as a vertical registration feature, thereby establishing the vertical distance VD between the contact apex CA of the reference cylinder C-C and the cutting edge 351 of the fixed blade 350 (wherein the horizontal distance HD between the contact apex CA of the reference cylinder C-C and the cutting edge 351 of the fixed blade 350 is established by the horizontal registration feature 550 of the support structure 500). Conversely, in another such embodiment where the registration feature 2350 of the rotary cutter 2300 is used in combination with the vertical registration feature 560, the registration feature 2350 of the rotary cutter 2300 will act as a horizontal registration feature, thereby establishing the horizontal distance HD between the contact apex CA of the reference cylinder C-C and the cutting edge 351 of the fixed blade 350 (wherein the vertical distance VD between the contact apex CA of the reference cylinder C-C and the cutting edge 351 of the fixed blade 350 is established by the vertical registration feature 560 of the support structure 500).

While the registration feature 2350 of the rotary cutter 2300 is exemplified as including two portions 2350A, 2350B in the form of outer annular surfaces 2351A, 2351B, more or less portions can be utilized on the rotary cutter 2300 as needed.

In further embodiments, the rotary cutter 300 of FIG. 5 can be utilized in this aspect of the invention. In such an embodiment, the fixed blade 350 will be mounted to the support structure 500 so that the first end 352 of the fixed blade 350 is in contact with the outer surface 306 of the cutter tube 301.

Finally, depending on the location of the cutting edge 351 of the fixed blade 350 relative to the bottom surface 355 of the fixed blade 350 (and the location of the cutting edges 2307 of the rotary cutter relative to the outer surfaces 2306), a gap will exist in certain embodiments between the cutting edge 351 of the fixed blade 350 and the cutting edges 2307 of the rotary cutter 2300, despite the first end 352 of the fixed blade 350 being in contact with an embodiment of the registration feature 2350 that is not raised relative to the outer surfaces 2306.

Shaving Head with Replaceable Cover-Blade Assembly

Referring now to FIGS. 17-20B concurrently, a further embodiment of a shaving apparatus 1000E according to the present invention is presented. The shaving apparatus 1000E is identical to the shaving apparatus 1000 in many structural and functional aspects. Thus, like reference numbers are used to identify like elements with the exception that the alphabetical suffix "E" will be added to the reference numerals. Furthermore, the discussion of the shaving apparatus 1000E will be limited to those aspects that differ from the head 200 with the understanding that the above discussion of the head 200 is applicable to the head 200A. Moreover, any of the structural and/or functional aspects discussed above for the head 200 of FIGS. 1-4 can be incorporated into the head 200A if not already present.

Figure 22:
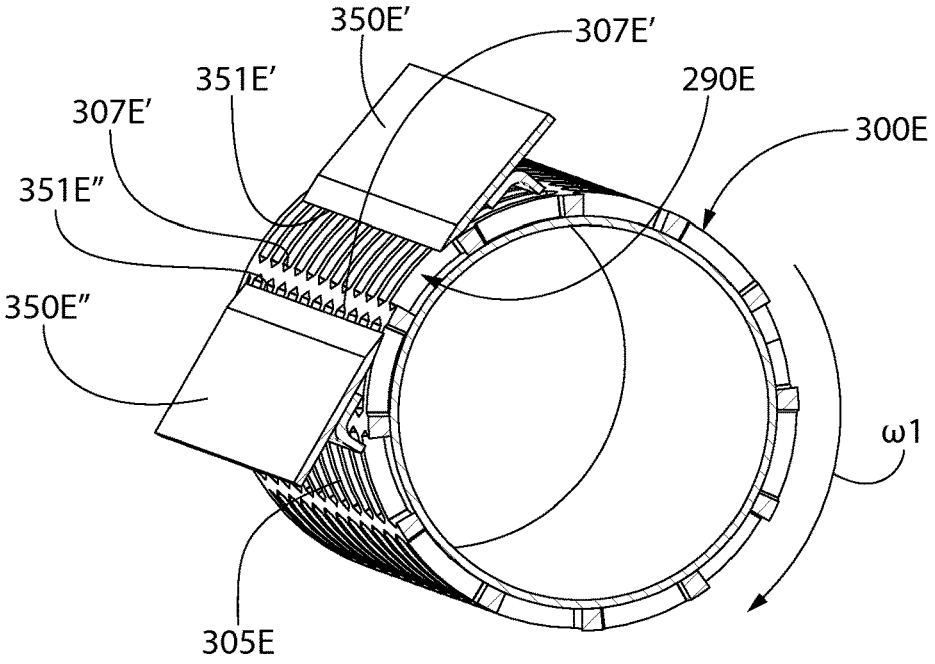
FIG. 22 is a perspective view of the rotary cutter and the first and second fixed blades of the shaving apparatus of FIG. 17, wherein the rotary cutter is rotating in a first rotational direction.
Figure 23:
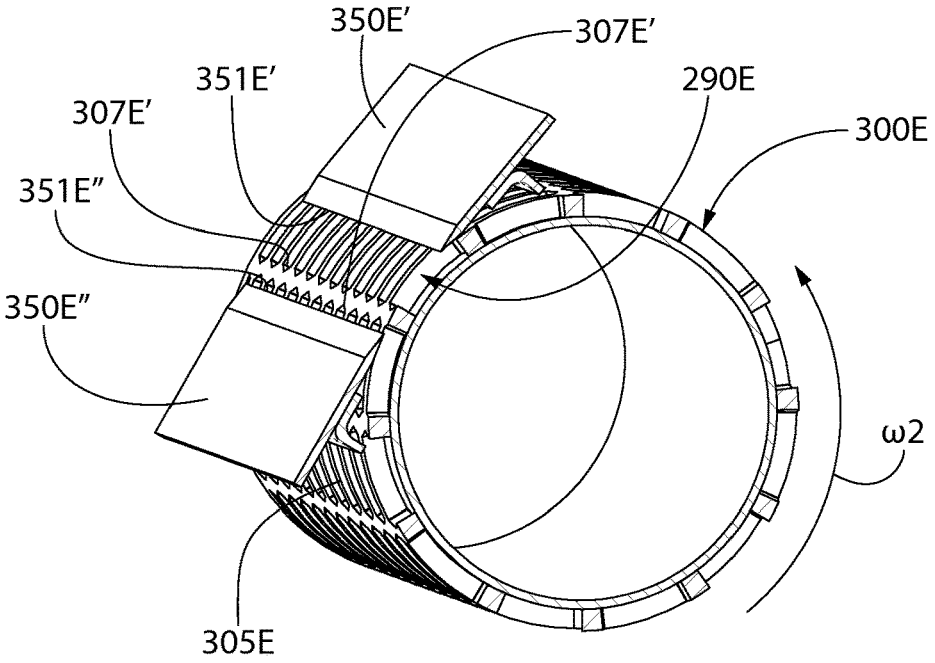
FIG. 23 is a perspective view of the rotary cutter and the first and second fixed blades of the shaving apparatus of FIG. 17, wherein the rotary cutter is rotating in a second rotational direction.
Figure 24:
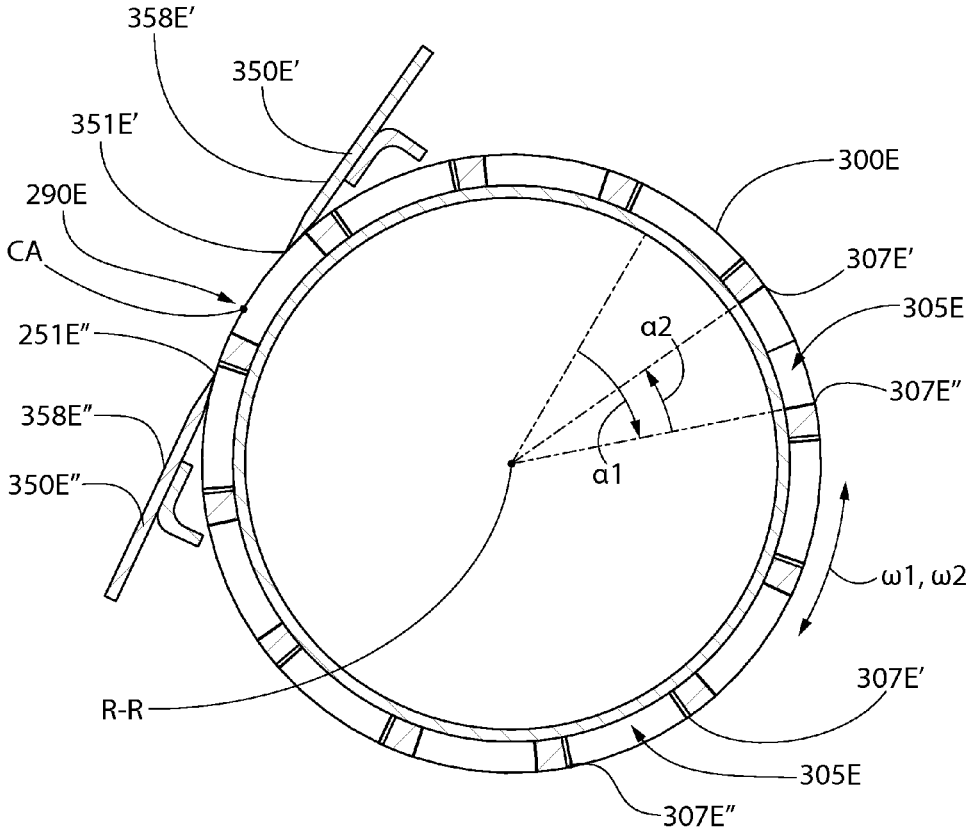
FIG. 24 is a side view of the rotary cutter and the first and second fixed blades of the shaving apparatus of FIG. 17.
Figure 25:
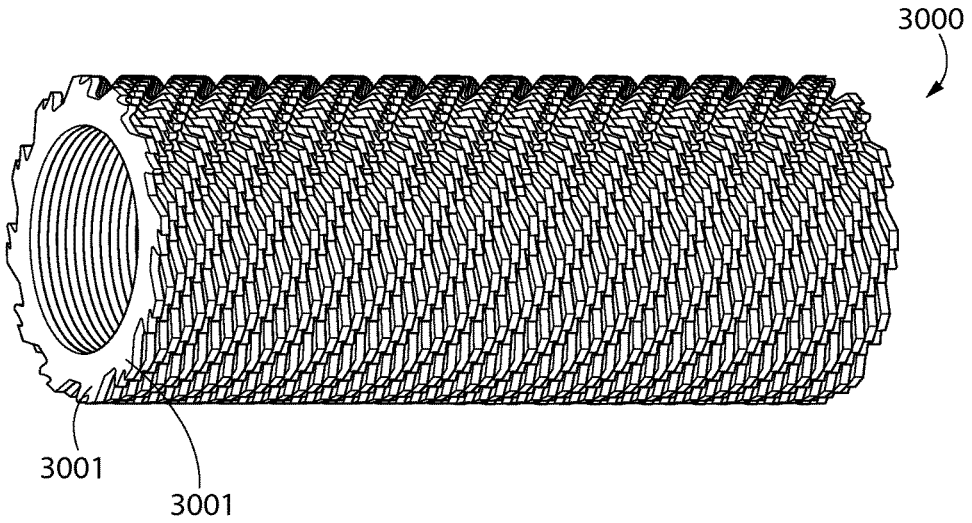
FIG. 25 is a perspective view of a rotary cutter according to a further embodiment of the present invention, the rotary cutter configured to perform a pinch-and-pull of a user's hair prior to shearing the hair in cooperation with the fixed blade.

For purposes of this discussion, the primary difference between the shaving apparatus 1000E and the shaving apparatus 1000 is the construction of the head 200E so as to include a base component 1500E and a cover-blade assembly 1600E that is detachably coupled to the base component 1500E for replacement, cleaning, and/or other repetitive coupling and decoupling. Similar to the head 200 of the shaving apparatus 1000, the head 200E includes the rotary cutter 300E and the electric motor 400E. The rotary cutter 300E is identical to the rotary cutter 300. However, because the head 200E is designed for bi-directional shaving (discussed below), the rotary cutter 300E can be said to include a plurality of first cutting edges 307E' facing in a clockwise direction and a plurality of second cutting edges 307E" facing in a counter-clockwise direction. The electric motor 400E is operably coupled to the rotary cutter 300E so as to be capable of rotation the rotary cutter 300E about the rotational axis R-R. However, in the shaving apparatus 1000E, the electric motor 400E can rotate the rotary cutter 300E in both the clockwise direction (as shown in FIG. 23) and the counterclockwise direction (as shown in FIG. 22). The bi-directional rotation capabilities will be described in greater detail below in the next section.

The base component 1500E of the head 200E is coupled to the handle 100E. The coupling of the base component 1500E to the handle 100E can be a detachable coupling or a permanent coupling as described above with respect to the handle 100 and head 100 of the shaving apparatus 1000. The base component 1500E comprises a cavity 1511E that is sized to accommodate at least a portion of the rotary cutter 300E. The base component 1500E is further configured to include the necessary features for rotatably mounting the rotary cutter 300E within the internal cavity 1511E for rotation about the rotational axis R-R and the supply of electricity to the motor 400E. The details of such features are omitted in view of the disclosure above.

The cavity 1511E of the base component 1500E has an open top end 1512E. The open top end 1512E forms a passageway into the cavity 1511E from the exterior. In one embodiment, the open top end 1512E is configured so that the assembly of the rotary cutter 300E and the electric motor 400E (along with the mounting components) can be translated through the open top end 1512E and into the cavity 1511E. In the exemplified embodiment, when the rotary cutter 300E is rotatably mounted to the base component 1500E within the cavity 1511E, at least a portion of the rotary cutter 300E protrudes from the open top end 1512E.

The cover-blade assembly 1600E comprises a cover component 1601E and first and second fixed blades 350E', 350E". While the exemplified embodiment of the cover component 1600E includes two fixed blades 350E', 350E", in other embodiments only a single fixed blade 350E' is included. Each of the first and second fixed blades 350E', 350E" is identical to the fixed blade 350 discussed above for FIGS. 1-16. Generally, each of the first and second fixed blades 350E', 350E" respectively comprises a first end 352E', 352E" that comprises the cutting edge 351E', 351E", a second end 353E', 353E" a third end 356E', 356E", a fourth end 357E', 3571", a bottom major surface 355E', 355E", and a top major surface 358E', 358E".

In one embodiment, each of the first and second fixed blades 350E', 350E" is a separate and distinct component than the cover component 1601E. In one embodiment, each of the first and second fixed blades 350E', 350E" is formed a first material and the cover component 1601E is formed a second material that is different than the first material. For example, the first material may be metal and the second material may be plastic.

The cover component 1601E comprises a body portion 1602E. In the exemplified embodiment, the body portion 1602E is an annular structure having rectangular shape that defines an opening 1603E having a closed-geometry. In other embodiments, the body portion 1602E is an open-geometry structure, such as a U-shaped structure or bar structure. In certain such embodiments, such as the U-shaped structure, the body portion 1602E defines the opening 1603E so as to have an open-geometry.

Each of the first and second fixed blades 350E', 350E" is fixedly mounted to the cover component 1601E. More specifically, each of the first and second fixed blades 350E', 350E" is fixedly mounted to the cover component 1601E so its cutting edge 1351E', 1351E" remains exposed so it can perform its shearing function with the cutting edges 307E of the rotary cutter 300E. In the exemplified embodiment, each of the first and second fixed blades 350E', 350E" is fixedly mounted to the cover component 1601E so that the cutting edge 1351E', 1351E" extends across the opening 1603E and oppose one another. The opening 1603E is an elongated slot in the illustrated embodiment and each of the cutting edges 351E', 351E" is a linear edge that extends parallel to the rotational axis.

The cover component 1601E further comprises a faceplate 1604E. The faceplate 1604 comprises the opening 1603E. The faceplate 1604E comprises a top surface 1605E (which in the exemplified embodiment forms a portion of the working surface of the head 200E) and a bottom surface 1606E. In the exemplified embodiment, each of the first and second fixed blades 350E', 350E" is fixedly mounted to the bottom surface 1606E of the faceplate 1604E. Thus, when the cover-blade assembly 1600E is coupled to the base component 1500E to form the head 200E, each of the first and second fixed blades 350E', 350E" is positioned between the rotary cutter 300E and the faceplate 1604E. In other embodiments, each of the first and second fixed blades 350E', 350E" is fixedly mounted to the top surface 1605E of the faceplate 1604E. Thus, when the cover-blade assembly 1600E is coupled to the base component 1500E to form the head. 200E, the faceplate 1604E is positioned between each of the first and second fixed blades 350E', 350E" and the rotary cutter 300E. In such an embodiment, the top major surfaces 358E', 358E" of the first and second fixed blades 350E', 350E" will form portions of the working surface of the head 200E.

Of further note, the cover-blade assembly 1600E also comprises first and second blade stiffeners 1610E', 1610E". The first and second blade stiffeners 1610E', 1610E" are respectively in contact with the bottom surfaces 355E', 355E" of the first and second fixed blades 350E', 350E" to reduce or prohibit flexure of the first and second fixed blades 350E', 350E" in a direction perpendicular to their top major surfaces 358E', 358E'. In their exemplified form, each of the first and second blade stiffeners 1610E', 1610E" respectively comprises a coupling section 1611E', 1611E" in contact with the bottom major surface 355E', 355E" and a reinforcement section 1612E', 1612E" protruding downward from the bottom major surface 355E', 355E". In the exemplified embodiment, each of the first and second blade stiffeners 1610E', 1610E" has an L-shaped transverse cross-section. In other embodiments, the first and second blade stiffeners 1610E', 1610E" have T-shaped transverse cross-sections or V-shaped transverse cross-sections.

In the exemplified embodiment, the first and second blade stiffeners 1610E', 1610E" are separate components that are respectively coupled to the first and second fixed blades 350E', 350E". In other embodiments, the first and second blade stiffeners 1610E', 1610E" can be integrally formed as monolithic components with the respective one of the first and second fixed blades 350E', 350E". The first and second blade stiffeners 1610E', 1610E" may, for example, be formed of a metal or plastic material.

The cover-blade assembly 1600E is a unitary structure that is detachably coupled to the base component 1500E. When the cover-blade assembly 1600E is coupled to the base structure 1500E, the cover-blade 1600E assembly at least partially encloses the open top end 1512E of the cavity 1511E of the base component 1500E. However, a portion of the rotary cutter 300E is exposed via the opening 1603E of the cover component 1601E. Additionally, when the cover-blade assembly 1600E is coupled to the base structure 1500E, each of the cutting edges 351E', 351E" of the first and second fixed blades 350E', 350E" is adjacent the rotary cutter 300E so that, depending on the direction of rotation of the rotary cuter 300E, hairs will be sheared between the plurality of first cutting edges 307E' of the rotary cutter 300E and the cutting edge 351E' of the first fixed blade 350E', or between the plurality of second cutting edges 307E" of the rotary cutter 300E and the cutting edge 351E" of the second fixed blade 350E"

In one embodiment, the base component 1500E and the cover component 1601E comprises corresponding mechanical features for snap-fit or other detachable mating that allows for repetitive coupling and decoupling of the cover-blade assembly 1600E from the base component 1500E. In the exemplified embodiment (best shown in FIG. 20A), the base component 1500E comprises first and second ridges 1520E, 1521E that each respectively include a bead 1522E, 1523E. The cover component 1601E, on the other hand, includes first and second channels that respectively receive the first and second 1520E, 1521E. The first and second channels respectively include first and second undercut surfaces. When the first and second ridges 1520E, 1521E are inserted into the first and second channels, the beads 1522E, 1523E snap-fit and engage the undercut surfaces. While one example of a snap-fit mechanical mating structure is exemplified, many other embodiments can be used. Other mechanical features that allow for detachable mating include a latch assembly, an interference fit, tang-groove structure, threaded surfaces, and combinations thereof. By making the cover-blade assembly 1600E detachable relative to the base component 1500E, the cover-blade assembly is replaceable and, thus, can be a consumable.

As a final note, in embodiments where the body portion 1602E of the cover component 1601E is a bar or simple linear structure, the body portion 1602E may be considered to not include an opening. In such an embodiment (which is considered to be within the scope of the invention), the first fixed blade 350E' is fixedly mounted to the bar-shaped (or linear) body portion 1602E of the cover component 1601E so that the cutting edge 351E' of the first fixed blade 350E' remains exposed. The cover-blade assembly 1600E is then coupled to the base component 1500E so that: (1) the cover-blade assembly at least partially encloses the open top end of the cavity of the base component to form a work window; (2) the first cutting edge of the first fixed blade is adjacent the rotary cutter and at least partially defines the work window; and (3) a portion of the rotary cutter is exposed via the work window.

Bi-Directional Rotation of the Rotary Cutter

Referring now to FIGS. 21-24 concurrently, the shaving apparatus 1000E of FIGS. 17-20B is exemplified in which a control circuit has been included therein to facilitate selective bi-directional rotation of the rotary cutter 300E according to an embodiment of the present invention is illustrated. The ability to selectively rotate the rotary cutter 300E in both the clockwise and counter-clockwise directions (i.e., bi-directional rotation) can be utilized for a variety of end goals, including without limitation bi-directional shaving, the preparation of hairs for shearing, safety, and combinations thereof.

The shaving apparatus 1000E generally comprises a handle 100E and the head 200E (which is described above in relation to FIGS. 17-20B). The shaving apparatus 1000E also includes a power source 105E, an electric motor 400E, and a control circuit. The electric motor 400E is operably coupled to the power source 105E and to the rotary cutter 300E. The control circuit is operably coupled to the electric motor 400E and the power source 105E. The electric motor 400E may be a DC motor. In one embodiment the electric motor 400E may be a stepper motor. Of course, other motor types can be used.

The control circuit, in the exemplified embodiment, generally comprises, in operable coupling and communication, a user-operated actuator 108E, a controller 140E, a memory device 141E, a current sensing circuit 142E, a switch 143E, and a user-perceptible output device 144E. In the exemplified embodiment, the control circuit is sufficiently sophisticated so as to be capable of automated control of the rotational direction of the rotary cutter 300E (via the electric motor 400E) to accomplish bi-directional shaving using an automated oscillating action of the rotary cutter 300E, an automated safety routine that is carried out upon the electric motor 400E drawings too much current, and an automated safety routine that is carried out upon the shaving apparatus 1000E being powered down or when the power source 105E reaches a discharged state. However, in other embodiments, the control circuit does not need to be so sophisticated. For example, in an embodiment where only manual switching of the rotational direction of the rotary cutter 300E is desired through user manipulation of the user-operated actuator, the control circuit can be quite simple. In such an embodiment, the control circuit may simply include an integrated element that combines both the user-operated actuator 108E and the switch 143E, such as a double-pole, double-throw (DPDT) center-off toggle switch. The exact layout of the control circuit in any embodiment will be dictated by the desired functionality of the shaving apparatus 1000E.

The control circuit is configured to selectively: (1) rotate the rotary cutter 300E about the rotational axis R-R in a first rotational direction ω1 (such as the counter-clockwise direction of FIG. 22); and (2) rotate the rotary cutter about the rotational axis in a second rotational direction ω2 (such as the clockwise direction of FIG. 23). The second rotational direction ω2 is opposite the first rotational direction ω1. As discussed in greater detail below, depending on the desired functionality to which this bi-directional rotation of the rotary cutter 300E is to be put, the control circuit can be configured to select between the first and second either automatically or manually by the user manipulation of the user-operated actuator 108E.

Additionally, and also depending on the desired functionality to which this bi-directional rotation of the rotary cutter 300E is to be put, the head 200E may comprise only the first fixed blade 350E' (the being second fixed blade 350E" being omitted) or may comprise both the first and second fixed blades, 350E', 350E". For example, if the desired functionality to which the bi-directional rotation of the rotary cutter 300E is to be put is bi-directional shaving (discussed in greater detail below), the head 200E will include both the first and second fixed blades, 350E', 350E" and the rotary cutter 300E will include both first cutting edges 307E' and second cutting edges 307E". However, if the desired functionality to which the bi-directional rotation of the rotary cutter 300E is to be put is a safety function (discussed in greater detail below), the head 200E may include only the first fixed blade, 350E' and the rotary cutter 300E may include only the first cutting edges 307E'.

In one embodiment, the control circuit is configured so that the selection between rotating the rotary cutter 300E in the first rotational direction ω1 and rotating the rotary cutter 300B in the second rotational direction ω2 is in response to a user manipulating the user-operated actuator 108E. The user-operated actuator 108E may be a manual slide switch, a depressible button, a capacitance touch-control screen, a rotatable knob, a toggle switch, and/or combinations thereof. In one such embodiment, the user operated actuator 108E has selectable states. When the user operated actuator 108E is in (or has been manipulated to activate to) a first state, the electric motor 400E is normally activated and the rotary cutter 300E is rotated about the rotational axis R-R in the first rotational direction ω1. This can be achieved, for example, by supplying the electric energy from the power source 105E to the electric motor 400E with a normal polarity. When the user operated actuator 108E is in (or has been manipulated to activate to) a second state, the electric motor 400E is reversely activated and the rotary cutter 300E is rotated about the rotational axis R-R in the second rotational direction ω2. This can be achieved, for example, by supplying the electric energy from the power source 105E to the electric motor 400E with a reversed polarity. When the user operated actuator 1081E is in (or has been manipulated to activate to) a third state, the electric motor 400E is deactivated and the rotary cutter 300E does not rotate. This can be achieved, for example, by disconnecting the electric motor 400E from the power source 105E.

In one such embodiment, when the user operated actuator 108E is in (or has been manipulated to activate to) the first state, the rotary cutter 300E continues to rotate in the first rotational direction ω1 until the user operated actuator 108E is again manipulated to be in (or activate) one of the other second or third states. Similarly, when the user operated actuator 108E is in (or has been manipulated to activate to) the second state, the rotary cutter 300E continues to rotate in the second rotational direction ω1 until the user operated actuator 108E is again manipulated to be in (or activate) one of the other first or third states. Conceptually, the first and second states of the user operated actuator 108E can be considered modes of operation and are referred to as such herein.

If the head 200E were designed to include the first and second fixed blades 350E', 350E" mounted adjacent the rotary cutter 300E, and the rotary cutter 300E were designed to include first and second cutting edges 307E', 307E" (as in the exemplified embodiment), the aforementioned functionality of the control circuit could be used to afford the shaving apparatus 1000E with bi-directional shaving capabilities. As such, the user can select the desired mode of operation (i.e., rotation of the rotary cutter 300E in the first rotational direction ω1 or rotation of the rotary cutter 300E in the second rotational direction ω2) based on the direction of movement of the head 200E relative to the skin being shaved.

In bi-directional shaving embodiments, such as the one that is exemplified, the rotary cutter 300E comprises a plurality of the first cutting edges 307E' and a plurality of the second cutting edges 307E". The first cutting edges 307E" face the first rotational direction ω1 so that they can cooperate with the first cutting edge 351E' of the first fixed blade 350E' to shear hairs therebetween when the rotary cutter 300E is rotating in the first rotational direction ω1. The second cutting edges 307E" face the second rotational direction ω2 so that they can cooperate with the second cutting edge 351E" of the second fixed blade 350E" to shear hairs therebetween when the rotary cutter 300E is rotating in the second rotational direction ω2. In the rotary cutter 300E, this is accomplished by the fact that the first and second cutting edges 307E', 307E" are located on opposite sides of the apertures 305E in the cutter tube 301E. In embodiments where a rotary cutter of the type exemplified as the rotary cutter 1300 is utilized for bi-directional shearing, the first and second cutting edges 307E', 307E" are located on opposite sides of the ridges 305 and thus, can respectively cooperate with the cutting edges 351E', 351E" in the same manner.

As exemplified, the first and second cutting edges 351E', 351E" oppose one another in the head 200E. Moreover, an elongated slot 290E is formed between the first and second cutting edges 351E', 351E". A portion of the rotary cutter 300E is exposed vie the elongated slot 290E. Additionally, each of the first and second cutting edges 351E', 351E" is linear and extends parallel to the rotational axis R-R.

In the exemplified embodiment, the first and second blades 350E', 3501E" are identical to one another and symmetrically positioned and oriented to one another in a mirror image to one another about the contact apex CA of the rotary cutter 300E. Thus, a user's hairs are sheared to the same length whether they are sheared between the first cutting edge 351E' of the first fixed blade 350E' and the first cutting edges 307E" of the rotary cutter 300E during rotation of the rotary cutter 300E in the first rotation direction ω1 or are sheared between the second cutting edge 351E" of the second fixed blade 350E" and the second cutting edges 307E" of the rotary cutter 300E during rotation of the rotary cutter 300E in the second rotation direction ω2. In another embodiment, the first fixed blade 350E" is configured to shear the user's hairs to a first length measured from the user's skin when the rotary cutter 300E is rotating in the first rotational direction ώ1 while the second fixed blade 350E" is configured to shear the user's hairs to a second length measured from the user's skin when the rotary cutter 300E is rotating in the second rotational direction ώ2. The first and second lengths are different. Thus, in such an embodiment, the bi-directional shaving capability of the shaving apparatus 1000E, can be used to achieve different levels of a shave (e.g., a "clean shave" verses a "trim") by simply selecting the desired mode of operation. The difference between the first length and the second length can be achieved in a variety of ways. For example, the cutting edges 351E', 351E" may be located at different depths respectively from the top surface 358E', 358E" of the first and second, blades 350E', 350E". In another example, the first and second blades 350E', 350E" may be positioned and/or oriented differently relative to the rotary cutter 300E so that the cutting gap formed between the first cutting edge 351E' of the first fixed blade 350E' and the first cutting edges 307E' of the rotary cutter 300E is different (e.g., larger or smaller) than the cutting gap formed between the second cutting edge 351E" of the second fixed blade 350E" and the second cutting edges 307E" of the rotary cutter 300E.

In a further embodiment of the shaving apparatus 1000E, the control circuit may be configured to automatically select between rotation of the rotary cutter 300E in the first rotational direction ώ1 and rotating the rotary cutter 300E in the second rotational direction ώ2. The automatic selection can be triggered by the controller 140E under a variety of conditions. In one embodiment, the controller 140E can switch the rotational direction of the rotary cutter 300E in response to a signal from current sensing circuit 142E. In another embodiment, the controller 140E can switch the rotational direction of the rotary cutter 300E in accordance with a control scheme that is programmed and stored in the memory device 141E as computer implementable instructions. In such an embodiment, the controller 140E can select and execute the control scheme in response to a selection made by the user using the user-operated actuator 108E.

In one embodiment, the control circuit is configured to oscillate the rotary cutter 300E about the rotational axis R-R by automatically and repetitively switching between: (1) rotating the rotary cutter 300E in the first rotational direction ώ1 a first predetermined angle of rotation α1; and (2) rotating the rotary cutter 300E in the second rotational direction ώ2 a second predetermined angle of rotation α2.

This type of oscillatory rotation of the rotary cutter 300E can be used to achieve a variety of desired effects. In one embodiment, the oscillatory rotation of the rotary cutter 300E can be used to achieve bi-directional shaving (the shearing mechanics of which are discussed in greater detail above). In another embodiment, the oscillatory rotation of the rotary cutter 300E can be used as a hair lifting/prepping technique and could be used in embodiments of the shaving apparatus 1000E having only a the first fixed blade 350E'. Assuming that in such an embodiment the hairs are sheared between the first cutting edge 351E' of the first fixed blade 350E' and the first cutting edges 307E' of the rotary cutter 300E during rotation of the rotary cutter 300E in the first rotational direction ώ1 the first predetermined angle of rotation α1, the hairs which have not yet reached the first cutting edge 351E' of the first fixed blade 350E' (but are in contact with the rotary cutter 300E) will be lifted, during the rotation of the rotary cutter 300E in the second rotational direction ώ2 the second predetermined angle of rotation α2.

Whether or not the oscillatory rotation of the rotary cutter 300E is used for bi-directional shaving or hair lifting/prepping, the first and second angles of rotation α1, α2 are selected to optimize the desired purpose. In one embodiment, each of the first and second angles of rotation α1, α2 is in a range of 0.5 to 90 degrees, more preferably in a range of 1 to 45 degrees, even more preferably in a range of 1 to 25 degrees, and most preferably in a range of 1 to 10 degrees.

In one embodiment, the first and second angles of rotation α1, α2 are equal. One benefit of having the first and second angles of rotation α1, α2 equal is that only a section of the rotary cutter 300E is used during operation and, thus, only a section of the rotary cutter 300E needs to include cutting edges. In another embodiment, the first and second angles of rotation α1, α2 are not equal to one another. One benefit of having the first and second angles of rotation α1, α2 not being equal to one another is the fact that the different sections of the rotary cutter 300E will be active during successive periods of oscillation. Thus, over a period of time, the rotary cutter 300E will fully rotate. As a result, the life of the rotary cutter 300E may be extended.

In another embodiment, the oscillating rotation of rotary cutter 300E can be controlled in terms of periods of time rather than angles of rotation. In one such embodiment, the control circuit is configured to oscillate the rotary cutter 300E about the rotational axis R-R by automatically and repetitively switching between: (1) rotating the rotary cutter 300E in the first rotational direction ώ1 a first predetermined period of time; and (2) rotating the rotary cutter 300E in the second rotational direction ω2 a second predetermined period of time. In one embodiment, each of the first and second predetermined periods of time is in a range of 0.01 second to 1 second. Further, the first and second predetermined periods are equal to one another in one embodiment while, in a different embodiment, the first and second predetermined periods of time are not equal to one another.

As mentioned above, in an embodiment of the shaving apparatus 1000E, the control circuit may be configured to automatically select between rotation of the rotary cutter 300E in the first rotational direction ώ1 and rotating the rotary cutter 300E in the second rotational direction ω2 in response to a signal from current sensing circuit 142E. In this embodiment, the current sensing circuit 142E is operable coupled to the electric motor 400E and the power source 105E so that current being drawn by the electric motor 400E from the power source 105E is sensed (i.e., monitored).

As is generally known, the current drawn by an electric motor increase with increased load. The increased current being drawn by the electric motor 400E may be the result of an increased load caused by: (1) dulling of the cutting edges 307E', 351E' (of the fixed blade 350E' and/or the rotary cutter 300E); (2) the rotary cutter 300E and the first fixed blade 350E' not being set up correctly; (3) hair being only pinched rather than sheared effectively or completely; (4) the build-up of soap residue or hairs in the head 200A in sections of the head 200E that affect the ability of the rotary cutter 300E to rotate.

In one embodiment, the current sensing circuit 142E continuously monitors the current being drawn and upon detecting a surge in the current being drawn by the electric motor 400E, the controller 140E can stop rotation of the rotary cuter 3001 by, for example opening a switch to cut off power from going to the electric motor 400E. In one embodiment, a surge is detected if a current level being exceeds a predetermined current level threshold. In another embodiment, a surge can be detected if there is a rapid increase in the current being drawn by the electric motor 400E (irrespective of the empirical value). In one embodiment, the value (whether empirical or slope) that qualifies as surge can be set by the user.

In one embodiment, upon the current sensing circuit 142E detecting that the current being drawn from the power source 105E by the electric motor 400E surges while the rotary cutter 400E is rotating in a current rotational direction, the control circuit will reverse rotation, thereby rotating the rotary cutter 300E in the opposite rotational direction a predetermined angle. Changing motor direction would alleviate any pinching of the skin or hair, and may also release residue buildup. The control circuit may then shut down the electric motor 400E.

The control circuit further comprises a user-perceptible output device 144E operably coupled to the controller 140E. In one embodiment, when the current sensing circuit 142E detects that a surge has occurred, the controller 140E activates the user-perceptible output device 144E. The user-perceptible output device 144E can be a light, a display screen, or other device that creates sound, vibration, and/or a visual cue. This can be an indication to the user that the shaving head should be cleaned, maintained, and/or the fixed blade and/or the rotary cutter replaced.

Rotary Cutter Configured to Pinch, Pull and Shear

A superior shave with typical shaving systems often requires repeated motions in the same area including multiple direction changes of the shaving device motion. One of the reasons that repeated motions are believed to be necessary is that not all of the hair gets caught and or cut by the shaving system on the first pass. Another reason is that some hairs rotate and or roll away from the cutting blade during the shaving process. This problem is aggravated in areas where there is hair whose growth is in directions that are at an angle to the shaving direction, or when the hair growth is not primarily perpendicular to the skin. In some cases, hair growth is at a sharp angle to the skin. Thus, shaving may require numerous passes until the hair is caught and cut at the desired length, typically at skin level, or below skin level.

Additionally, in order to provide a superior shave, it is desirable that the hair be pulled slightly prior to cutting. Once sheared, the hair that was pulled retreats back into the skin, thereby giving a "below the skin level" shave. Shaving below the skin level provides skin level smoothness for many hours.

Referring now to FIGS. 25-27B concurrently, a rotary cutter 3000 that is designed to pinch, pull, and then shear a user's hairs in combination with a fixed blade 350 is disclosed herein. The rotary cutter 3000 can be incorporated into any of the shaving apparatus 1000, 1000E described above. In the exemplified embodiment, the rotary cutter 3000 is formed by a plurality of identical segments (or plates) 3001 that are stacked together in axial alignment along the rotational axis R-R to collectively form a cylindrical structure. Adjacent ones of the segments 3000 in the stack are angularly offset from one another so that the plurality of the cutting elements and the plurality of the pulling elements form a helical configuration about the rotary cutter 3000. Positioning the segments 3001 at different angles creates a continuous cutting process, wherein not all of the segments 3001 are pulling and cutting hair at the same time. In other embodiments, the rotary cutter 3000 can be a singular machined structure.

The rotary cutter 3000 comprises a plurality of cutting elements 3002 and a plurality of pulling elements 3003 protruding radially from an outer surface 3004 of base tube portion 3005. The plurality of cutting elements 3002, in the exemplified embodiment, are in the form of cutting teeth. Similarly the plurality of pulling elements 3003, in the exemplified embodiment, are in the form of pulling teeth.

The plurality of cutting elements 3002 collectively define a first reference cylinder K-K centered about the rotational axis R-R. The first reference cylinder K-K has a first diameter. Similarly, the plurality of pulling elements 3003 collectively define a second reference cylinder L-L centered about the rotational axis R-R. The second reference cylinder L-L has a second a second diameter that is less than the first diameter of the first reference cylinder K-K. In one embodiment, a difference between the first diameter of the first reference cylinder K-K and the second diameter of the second reference cylinder L-L is in a range of 20 to 40 microns, more preferably in a range of 25 to 35 microns, and most preferably about 30 microns or 30% of the diameter of the average hair being sheared.

Figure 26A:
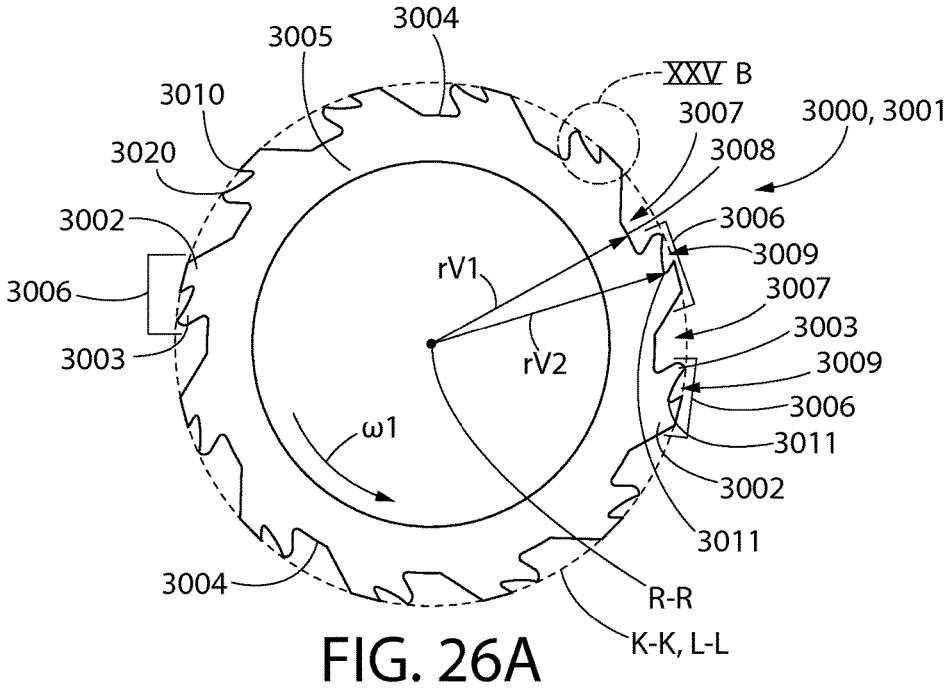
FIG. 26A is a side profile view of a segment of the rotary cutter of FIG. 25.
Figure 26B:
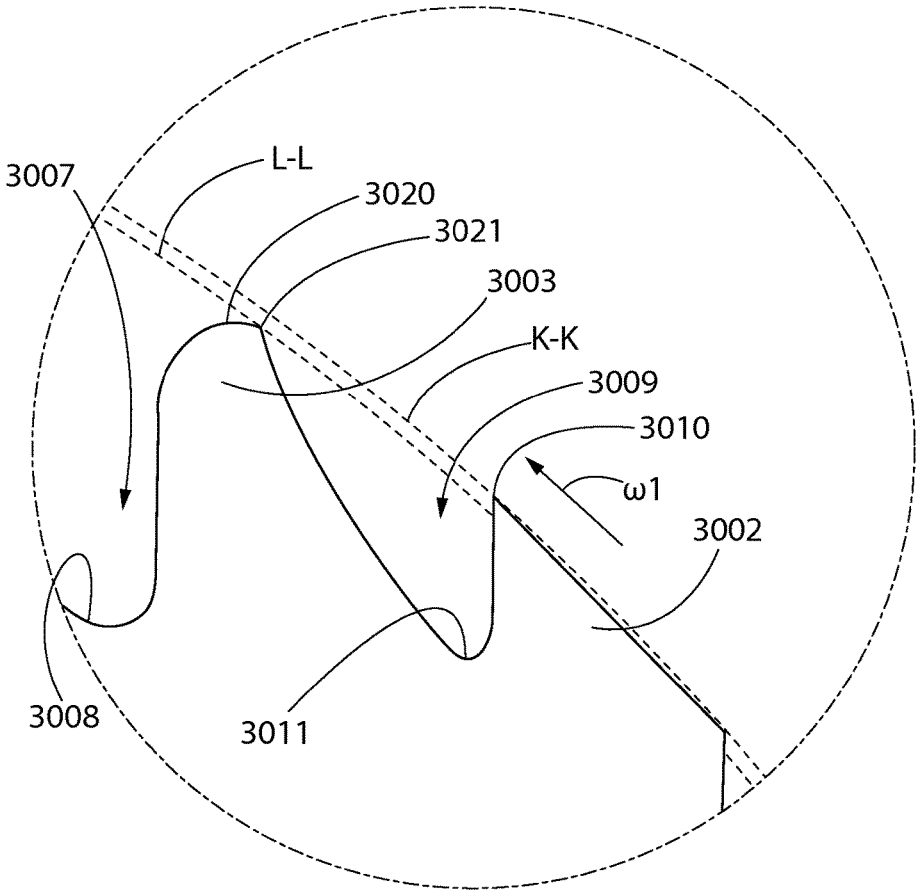
FIG. 26B is a close-up view of area XXVIB of FIG. 26A.

It should be noted that while the first and second reference cylinders K-K, L-L appear as coincident in FIG. 26A, this is merely due to the small size differential in the first and second diameters. It can be clearly seen from FIG. 26B that the first and second reference cylinders K-K, L-L are not coincident and that the first diameter is larger than the second diameter.

As can be seen, the cutting elements 3002 and the pulling elements 3003 are arranged in alternating pattern about the circumference of the rotary cutter 3000. The purpose of the alternating pattern will become apparent from the discussion below. In the exemplified embodiment, the cutting elements 3002 and the pulling elements 3003 are arranged in functional pairs 3006 such that the pulling element 3003 and the cutting element 3002 of pair work together in a coordinated manner during the shaving process (discussed in greater detail below). Each of the functional pairs 3006 comprise one of the pulling elements 3003 located adjacent to the cutting elements 3002. For each of the functional pairs 3006, the pulling element 3003 leads the cutting element 3002 during rotation of the rotary cutter 3000E about the rotational axis R-R in the intended rotational direction $\acute{\omega}$1.

Adjacent ones of the functional pairs 3006 are separated from one another by a first valley 3007. The first valley 3007 comprises a first valley floor 3008 located a first radial distance rV1 from the rotational axis R-R. More specifically, in one embodiment, at its deepest point, the first valley floor 3008 of each of the first valleys 3007 is a first radial distance rV1 from the rotational axis R-R. Furthermore, within each of the functional pairs 3006, the pulling element 3003 is separated from the cutting element 3002 by a second valley 3009. The second valley 3009 comprises a second valley floor 3009 located a second radial distance rV2 from the rotational axis R-R. More specifically, in one embodiment, at its deepest point, the second valley floor 3008 of each of the second valleys 3008 is a second radial distance r2 from the rotational axis R-R. The second radial distance rV2 is greater than the first radial distance rV1. In one embodiment, the depth of the first valley 3007, measured radially from the first reference cylinder K-K to the lowest point of the first valley floor 3008, is greater than the length of the hair being sheared. In one embodiment, the depth of the first valley 3007, measured radially from the first reference cylinder K-K to the lowest point of the first valley floor 3008 is smaller than 50% of the base tube portion 3005 width. In one embodiment, the depth of the first valley 3007 is in a range of 50 to 500 microns, with 100 microns being most preferred for a base tube portion 3005 width greater than 1 mm.

Each of the cutting elements 3002 comprises a cutting edge 3010 and each of the pulling elements 3003 comprises a rounded apex 3020. In one embodiment, the cutting edges 3010 of the cutting elements 3002 are located on the first reference cylinder K-K while the high points 3021 of the rounded apexes 3020 of the pulling elements 3003 are located on the second reference cylinder L-L.

Figure 27B:
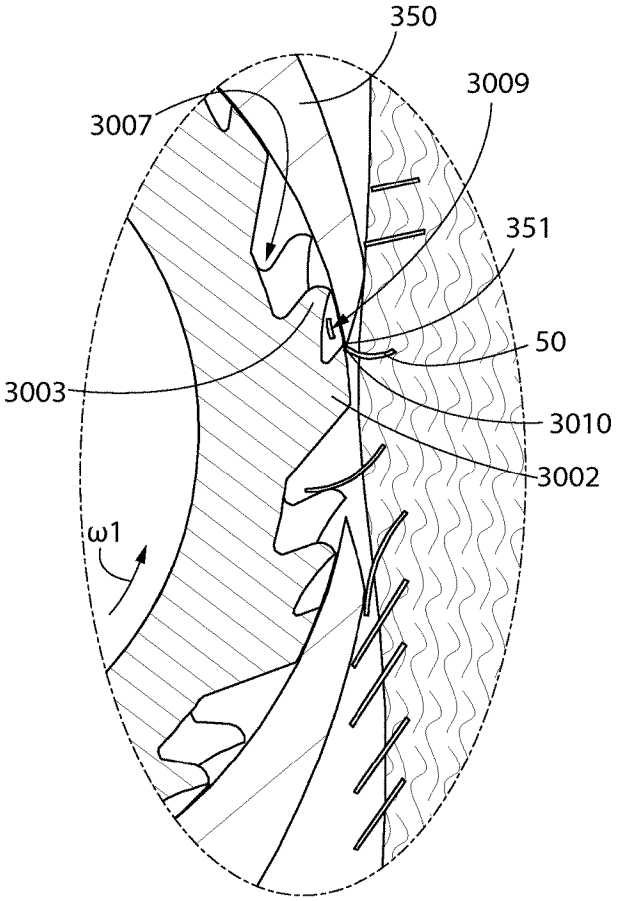
FIG. 27B is a schematic representation of one of the cutting elements of the rotary cutter of FIG. 25 performing a hair shearing function subsequent to the pinching and pulling function.
Figure 27A:
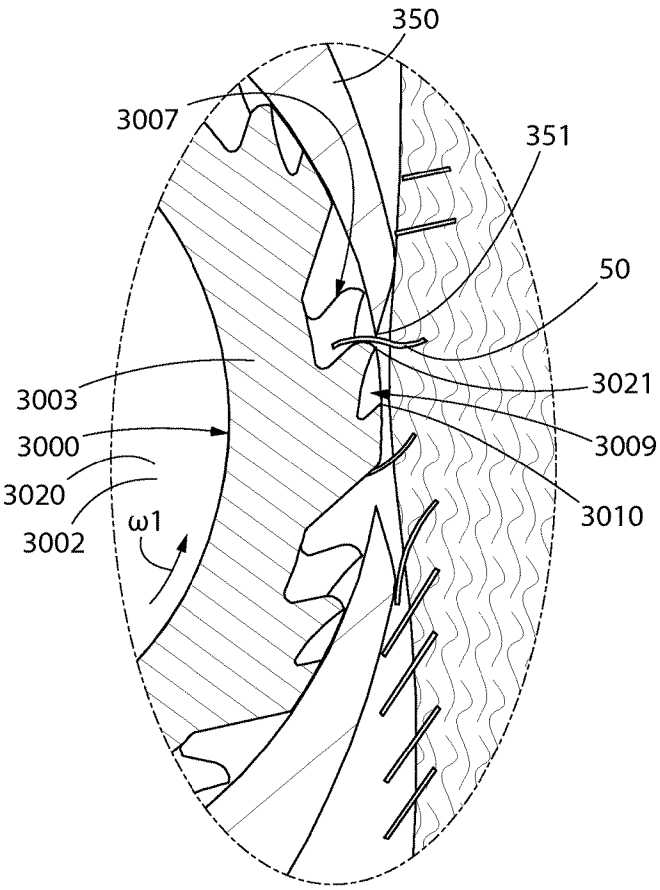
FIG. 27A is a schematic representation of one of the pulling elements of the rotary cutter of FIG. 25 performing a hair pinching and pulling function.

Referring now specifically to FIGS. 27A-B, for each of the pulling elements 3003, a first minimum gap is formed between the pulling element 3003 and the cutting edge 351 of the fixed blade 350 when that pulling element 3003 is at its closest possible position to the cutting edge 351 of the fixed blade 350. In one embodiment, this first minimum gap is formed between the cutting edge 351 of the fixed blade 350 and the rounded high point 3020 of the rounded apex 3020 of the pulling element 3003. In one embodiment, the first minimum gap is designed to be approximately 50% of the diameter of the average hair 50 (or 50 microns), such that the hair 50 is pinched between the pulling element 3003 and the cutting edge 351 of the fixed blade 350, and pulled by further rotation of the pulling element 3003, but not cut.

For each of the cutting elements 3002, a second minimum gap is formed between the cutting element 3002 and the cutting edge 351 of the fixed blade 350 when that cutting element 3002 is at its closest possible position to the cutting edge 351 of the fixed blade 350. In one embodiment, this second minimum gap is formed between the cutting edge 351 of the fixed blade 350 and the cutting edge 3010 of the cutting element 3002. The second minimum gap is sufficiently small such that the hair 50 is sheared between the cutting edge 3010 of the cutting element 3002 and the cutting edge 351 of the fixed blade 350 as the cutting edge 3010 of the cutting element 3002 passes the cutting edge 351 of the fixed blade 350. In one embodiment, the second minimum gap is 20% or less than the diameter of the average hair 50 being sheared (20 microns or less).

Irrespective of the exact size chosen for the first and second minimum gaps, in certain embodiments, the first minimum gap is larger than the second minimum gap. In one such embodiment, the difference between the first minimum gap and the second minimum gap is in a range of 10 to 50 microns, more preferably in a range of 25 to 35 microns.

As should be apparent form the above, during operation of a shaving apparatus in which the rotary cutter 3000 has been incorporated and is rotating in the rotational direction ω1, the pulling elements 3002 are designed to pinch hair between it and the fixed blade 350. During continued rotation of the rotary cutter 3000 in the rotational direction ω1, the hair 50 is pinched and pulled. During continued rotation of the rotary cutter 3000 in the rotational direction ω1, the pulling element 3003 disengages the hair 50, and the hair 50 is now located in the second valley 3009. The brief time the hair 50 is in the second valley 3009, is not sufficient for the hair 50 to recede back into the skin. Thus, during continued rotation of the rotary cutter 3000 in the rotational direction ω1, the hair 50 is sheared between the cutting edge 3010 of the cutting element 3002 and the cutting edge 351 of the fixed blade 350.

The rotary cutter 3000 may align hair with the direction of the motion of the shaving apparatus during use. The rotary cutter 3000 may also lift hair that is at a sharp angle to the skin. The rotary utter 3000 may also limit the hair's ability to rotate and or roll away from the cutting blade during the shaving process.

Shaving Head with Roller

Figure 28:
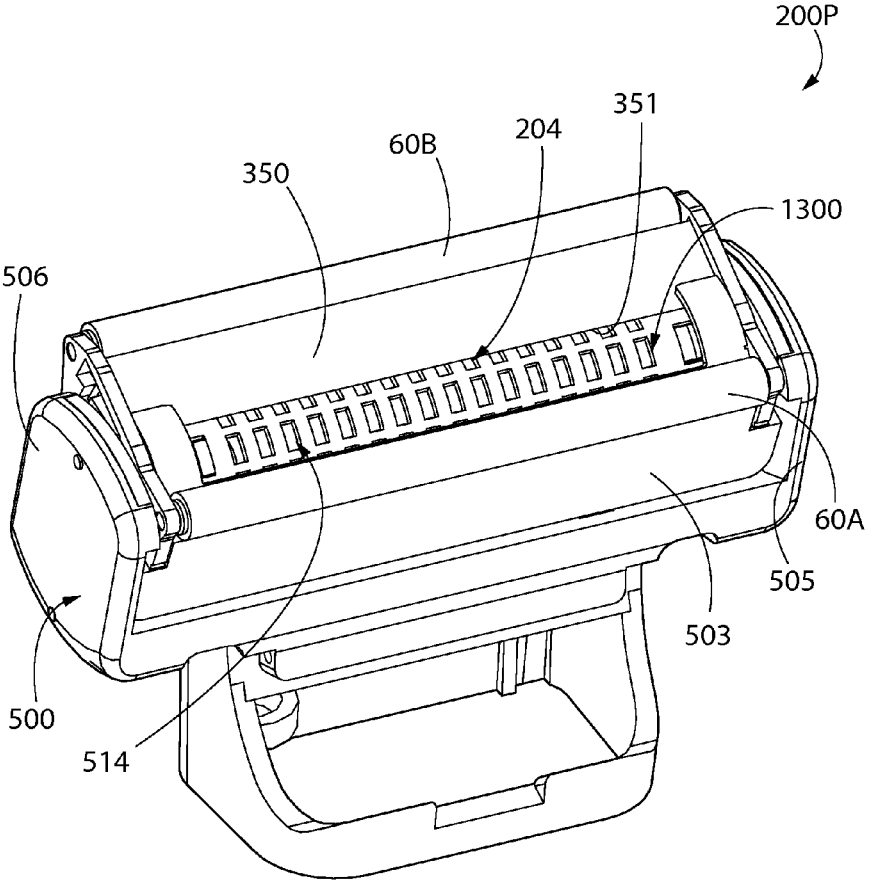
FIG. 28 is a front perspective view of a head portion of a shaving apparatus according to a further embodiment of the present invention, wherein the head portion includes a plurality of rollers rotatably mounted to the support structure on opposite sides of the rotary cutter.
Figure 29:
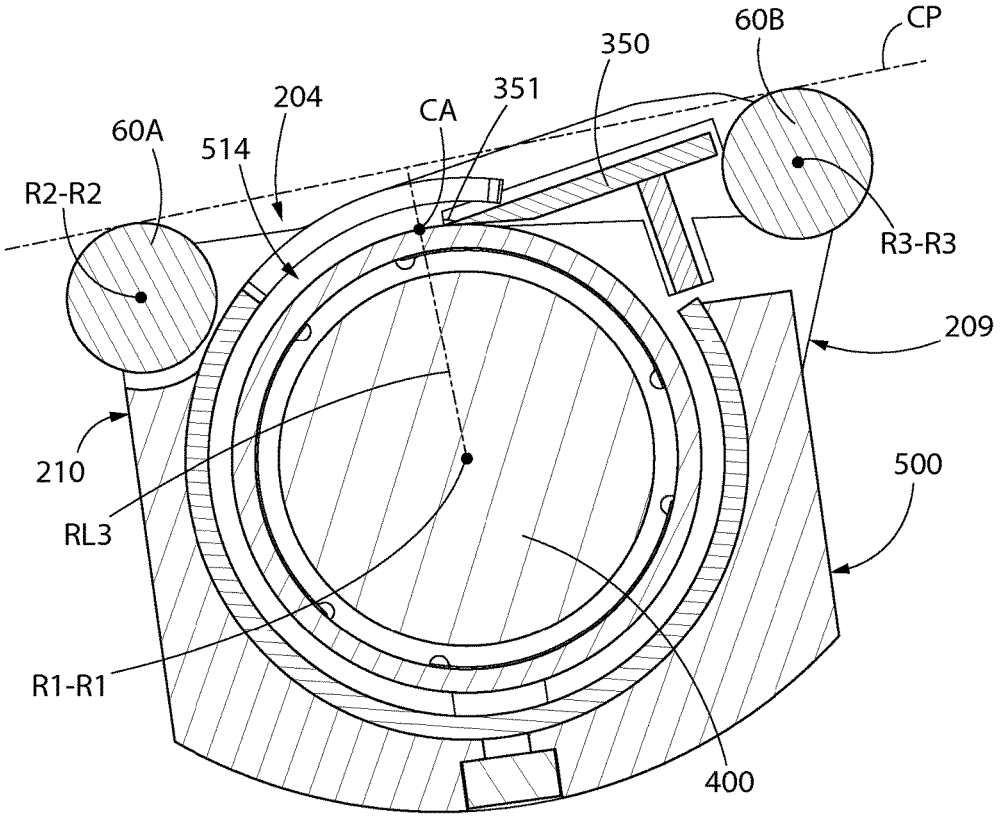
FIG. 29 is a transverse cross-section of the head portion of FIG. 28.

Referring now to FIGS. 28-29, an embodiment of a head portion (i.e., head) 200P that can be used in the shaving apparatuses 1000, 1000E discussed above instead of the head 200, 200E is illustrated. The head portion 200P is identical to the heads 200, 200E in many structural and functional aspects. Thus, like reference numbers are used to identify like elements. Furthermore, the discussion of the head 200P will be limited to those aspects that differ from the heads 200, 200E with the understanding that the above discussion of the heads 200, 200E is applicable to the head 200P. Moreover, any of the structural and/or functional aspects discussed above for the heads 200, 200E can be incorporated into the head 200P if not already present.

For purposes of this discussion, the primary difference between the head 200P and the heads 200, 200E is that the head 200P includes first and second rollers 60A, 60B rotatably coupled to the support structure 500. As discussed in greater detail below, and depending on the desired effect, the first and second rollers 60A, 60B can be configured to provide a variety of functional benefits and/or advancements. While in the exemplified embodiment the head 200P comprises two rollers 60A, 60B, in other embodiment only on roller 60A may be included. In still other embodiments more than two rollers 60A, 60B may be included.

As with the other head, the head 200P generally comprises a support structure 500, a rotary cutter 300 mounted to the support structure 500 for rotation about a first rotational axis R1-R1, and a fixed blade 350 mounted to the support structure 500 adjacent the rotary cutter 300. An electric motor 400 is also included that is operably coupled to the power source and the rotary cutter 300 to rotate the rotary cutter 300 about the first rotational axis R1-R1 so that the user's hairs are sheared between the cutting edge 351 of the fixed blade 350 and the cutting edges of the rotary cutter 300.

The head 200P, however, also includes a first roller 60A rotatably mounted to the support structure 500 for contact with a user's skin. The first roller 60A is rotatable about a second rotational axis R2-R2. In the exemplified embodiment, the second rotational axis R2-R2 is parallel to the first rotational axis R1-R1. In other embodiments, the second rotational axis R2-R2 is not parallel to the first rotational axis R1-R1.

The first roller 60A is located adjacent the lead face 209 of the head 200P. Thus, from the perspective of the working face 204 of the head 200P, the rotary cutter 300 is located between the first roller 60A and the fixed blade 350. More specifically, in the exemplified embodiment, the portion of the rotary cutter 300 that remains exposed via the slot 514 is between the first roller 60A and the fixed blade 350. As used herein, the rotary cutter 300 is still considered to be located between the first roller 60A and the fixed blade 350 even if they are vertically offset relative to one another.

The head 200P further comprises a second roller 60B rotatably mounted to the support structure 500 for rotation about a third rotational axis R3-R3. In the exemplified embodiment, the third rotational axis R3-R3is parallel to the first rotational axis R1-R1. In other embodiments, the third rotational axis R3-R3is not parallel to the first rotational axis R1-R1. In another embodiment, the third rotational axis R3-R3is parallel to the second rotational axis R2-R2irrespective of the relation with the first rotational axis R1-R1.

The second roller 60B is located adjacent the trail face 210 of the head 200P. Thus, from the perspective of the working face 204 of the head 200P, the fixed blade 350 is located between the second roller 60B and the rotary cutter 300. As used herein, the fixed blade 350 is still considered to be located between the second roller 60B and the rotary cutter blade 350 even if they are vertically offset relative to one another. The second roller 60B is also located on an opposite of the rotary cutter 300 than the first roller 60A and is positioned for contact with the user's skin. Moreover, in the exemplified embodiment, the contact plane CP of the head 200 is tangent to both of the apexes of the first and second contact rollers 60A, 60B.

In the exemplified embodiment, each of the first and second rollers 60A, 60B are configured for free rotation. In other words, rotation of each of the first and second rollers 60A, 60B is not driven by the electric motor 400, either directly or indirectly, but rather is driven by relative movement between the head 200P and the user's skin when the first and second rollers 60A, 60B is in contact with the skin. In other embodiments, however, either or both of the first and second rollers 60A, 60B can be driven by the electric motor 400 either directly or indirectly (such as will be discussed in the embodiments of FIGS. 30-32).

The first and second roller 60A, 60B can be configured to serve a specific function. This function may be different or the same for each of the first and second rollers 60A, 60B. In one embodiment, either or both of the first and second rollers 60A, 60B can include a lubricating outer surface. In such an embodiment, a lubricant is provided on or within the first and second rollers 60A, 60B. As the first and second rollers 60A contact the user's skin, the lubricant is applied to the skin.

In one embodiment, the first and second rollers 60A, 60B may comprise a matrix material that carries a desired fluidic lubricant suitable for shaving. The matrix material may take the form of a porous material, a fibrous material, or other materials capable of absorbing, retaining, and subsequently releasing the selected lubricant. One example of a matrix material comprises a water-insoluble polymer matrix, such as polystyrene. Suitable lubricants include, without limitation, dermal lotions, lanolins, oils, moisturizers, emollients, and the like. Additional ingredients in the lubricant, may comprise, for example, (1) skin health-related ingredients such as dermatologic agents (acne, flaky, itchy), balancing agents (dry or oily skin, pH correct, moisturizers, seasonal solution), rejuvenation/revitalization agents (vitamin therapy, herbal, conditioners, acids, cell renewal), cleansing agents (antibacterial, natural, hypoallergenic, botanical-derived, fragrant or fragrance free), or skin-protective agents (UV, anti-aging, anti-wrinkle); (2) skin sensation agents such as menthol, or pain-relief (aspirin); (3) soothing agents including neosporin; (4) hair treating agents such as beard softeners, hair growth inhibitors, hair outer layer degradants, hair hydrating agents, hair conditioners, or hair thinning agents; (5) cosmetics such as tanning agents; (6) aromatherapeutants including perfumes or essences; and (7) other agents such as oil, milks, honey, gels, creams, balms, catalysts, or effervescents.

In other embodiments, the first roller 60A (and the second roller 60B if desired) can be configured to perform a hair lifting/prepping function. In such an embodiment, the first roller 60A may take the form of a brush that includes a plurality of projecting filaments. This concept will be discussed in greater detail with respect to the embodiments of FIGS. 30-32.

Figure 30:
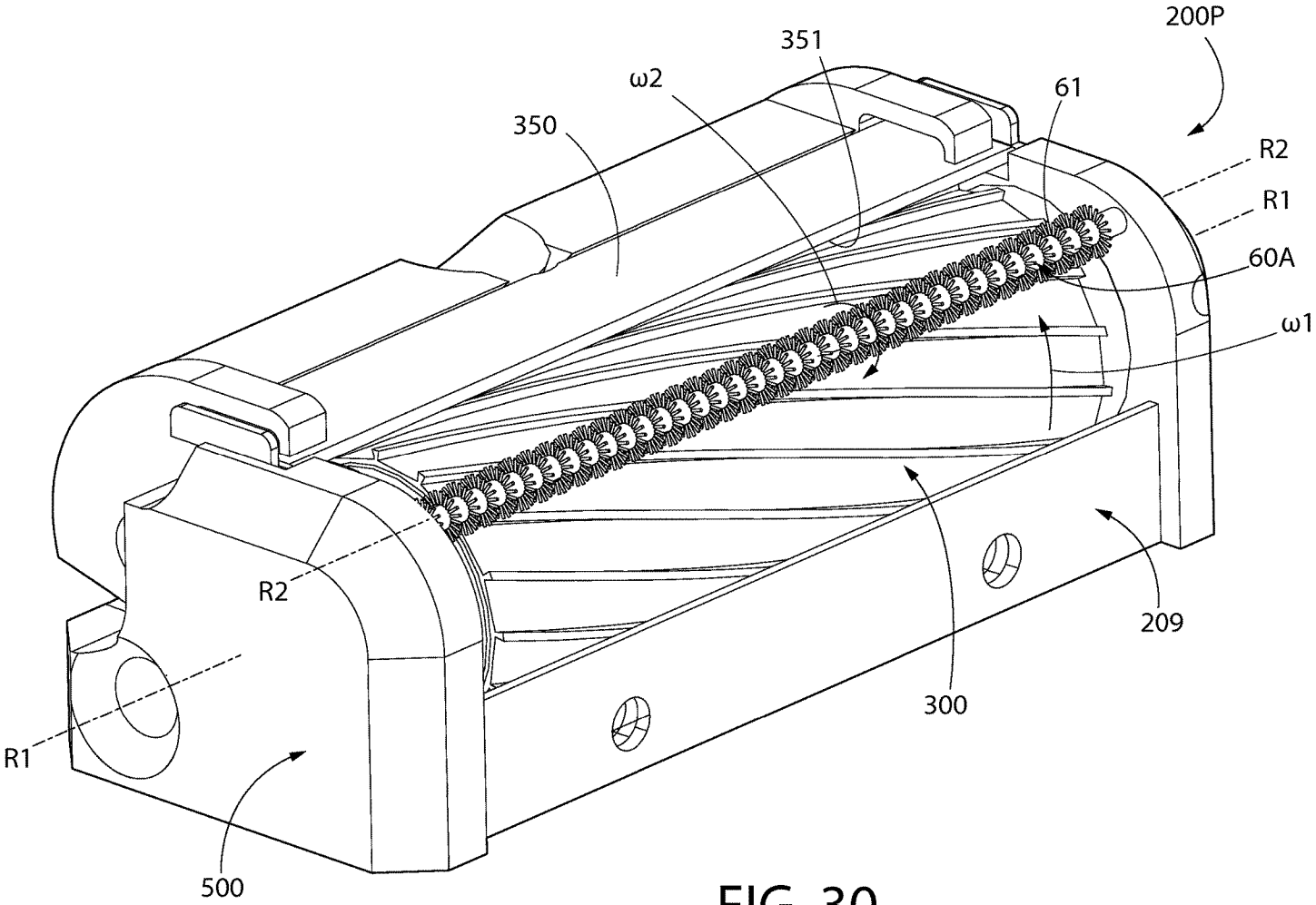
FIG. 30 is a front perspective view of a head portion of a shaving apparatus according to a yet further embodiment of the present invention, wherein the head portion includes a roller.

Referring now to FIG. 30, a head 200R is illustrated according to the present invention. The head 200R is identical to the head 200P in many structural and functional aspects. Thus, like reference numbers are used to identify like elements. Furthermore, the discussion of the head 200R will be limited to those aspects that differ from the head 200P with the understanding that the above discussion of the heads 200, 200E, 200P is applicable to the head 200R.

For purposes of this discussion, the primary difference between the head 200R and the head 200P is the location of the first roller 60A, the purpose for which the first roller 60A is configured, and the fact that rotation of the first roller 60A about its rotational axis R2-R2is driven indirectly by the electric motor 400 through the rotary cutter 300.

During operation of the head 200R, the electric motor 400 rotates the rotary cutter 300 about the first rotational axis R1-R1in a first rotational direction ώ1 while simultaneously rotating the first roller 60A in a second rotational direction ώ2 that is opposite the first rotational direction ώ1. In the exemplified embodiment, the first roller 60A is operably coupled to the rotary cutter 300 so that rotation of the rotary cutter 300 by the motor 400 about the first rotational axis R-1 rotates the first roller 60A about the second rotational axis R2-R2. More specifically, in the embodiment shown, the first roller 60A is in contact with the rotary cutter 300. Thus, as a result of this contact, the first roller 60A is naturally rotated in the opposite rotational direction than the rotary cutter 300. The first roller 60A, again, is located adjacent the lead face 209.

As exemplified, the roller 60A of the head 200R is configured to lift/prep hairs for shearing between the rotary cutter 300 and the fixed blade 351. Thus, in one embodiment, the first roller 60A comprises a plurality of filaments 61 protruding from its outer surface to form a brush. The filaments 61, in one embodiment, are selected for different types of hair or skin. In an embodiment the first roller 60A stretches the skin ahead of the rotary cutter 300. In another embodiment, the first roller 60A may be configured to exfoliate the skin. In a further embodiment, a second roller 60B, which can also be a brush, can also be added that is in contact with the rotary cutter 300 in manner similar to the first roller 60A and driven by the rotary cutter 300.

Figure 31:
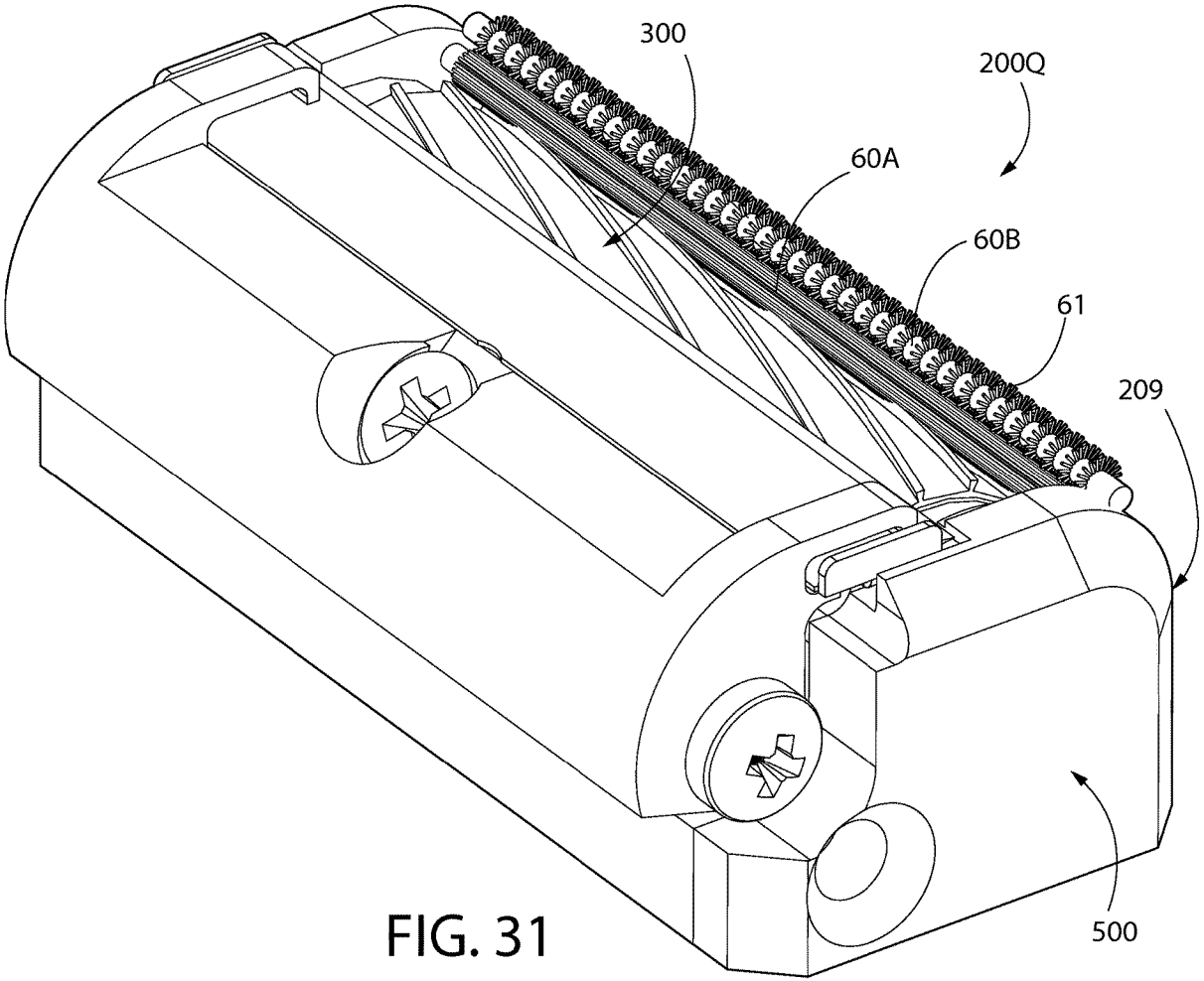
FIG. 31 is a front perspective view of a head portion of a shaving apparatus according to a yet further embodiment of the present invention, wherein the head portion includes two adjacent rollers.
Figure 32:
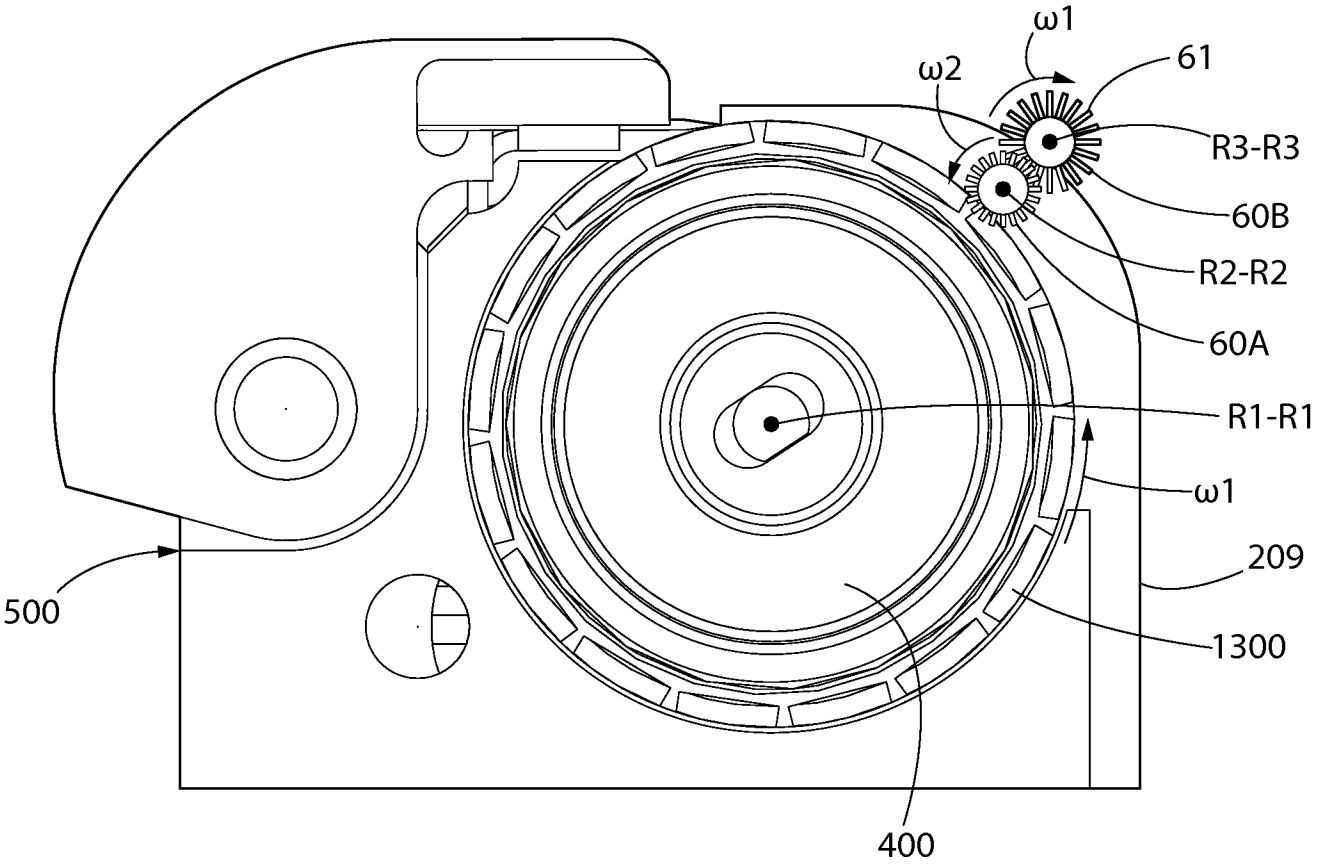
FIG. 32 is a transverse cross-section of the head portion of FIG. 31.

Referring now to FIGS. 31-32 concurrently, a head 200Q is illustrated according to the present invention. The head 200Q is identical to the head 200R in many structural and functional aspects. Thus, like reference numbers are used to identify like elements. Furthermore, the discussion of the head 200Q will be limited to those aspects that differ from the head 200R with the understanding that the above discussion of the heads 200, 200E, 200P, 200R is applicable to the head 200Q.

For purposes of this discussion, the primary difference between the head 200P and the head 200Q is the addition of a second roller 60B, the interoperability between the rotary cutter 300, the first roller 60A, and the second roller 60B, and the purpose for which the first roller 60A is configured.

The first roller 60A is rotatably mounted to the support structure 500 for rotation about the second rotational axis R2-R2. Similarly, the second roller 60B is rotatably mounted to the support structure 500 for rotation about the third rotational axis R3-R3. In this embodiment, rotation of each of the first and second rollers 60A, 60B is driven by the motor 400. Specifically, the motor 400 indirectly drives the rotation of the first and second rollers 60A, 60B through the rotary cutter 300. In this embodiment, the motor 400 rotates the rotary cutter 300 about the first rotational axis R1-R1in a first rotational direction ώ1. The rotary cutter 300, by nature of being in contact with the first roller 60A in turn drives rotation of the first roller 60A about the second rotational axis R2-R2in the second rotational direction ώ2 (which is opposite the first rotational direction ώ1). In turn, due to the second roller 60B being in contact with the first roller 60A, the first roller 60A drives rotation of the second roller 60B about the third rotational axis R3-R3in the first rotational direction ώ1.

In one embodiment, each of the first and second rollers 60A, 60B may be configured to be brushes as described above. In the exemplified embodiment, however, the first roller 60A is a cylinder and the second roller 60B is a brush. In one such embodiment, the outer surface is of the cylinder (i.e., the first roller 60A) is made from a relatively flexible material, such as rubber or silicone. The outer surface of the cylinder (i.e., the first roller 60A) can include topographical features, such as indentations, protuberances, grooves, ridges, nubs, domes, or combinations thereof, that increase the exposed surface area of the cylinder (i.e., the first roller 60A). Thus, the cylinder (i.e., the first roller 60A) may be effective in stretching the skin ahead of the rotary cutter.

Finally, while embodiments are disclosed in which the rotation of the first and second rollers 60A, 60B is driven indirectly by the motor via contact with the rotary cutter 300, in other embodiments, rotation of the first and/or second rollers 60A, 60*b* can be driven through a drive train, a gear system pulleys, belts, or combinations thereof.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used, in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A shaving apparatus comprising:

a power source;

a rotary cutter comprising a plurality of cutting edges, the rotary cutter rotatable about a rotational axis; and a fixed blade having a cutting edge, the fixed blade positioned adjacent the rotary cutter;

an electric motor operably coupled to the power source and the rotary cutter to rotate the rotary cutter about the rotational axis in a first rotational direction so that a user's hairs are sheared between the cutting edge of the fixed blade and the cutting edges of the rotary cutter; and a control circuit comprising a current sensing circuit configured to sense a level of current being drawn from the power source by the electric motor, wherein upon the control circuit detecting an increased current condition, the control circuit is configured to either: (1) stop the motor; or (2) reverse the motor so that the rotary cutter rotates in a second rotational direction that is opposite the first rotational direction.

2. The shaving apparatus according to claim 1 further comprising a handle portion, and wherein the control circuit is located within the handle portion.

3. The shaving apparatus according to claim 1 wherein the control circuit is configured to stop the motor upon the control circuit detecting the increased current condition.

4. The shaving apparatus according to claim 3 wherein the increased current condition is a surge in the current being drawn from the power source by the electric motor.

5. The shaving apparatus according to claim 1 wherein the control circuit is configured to reverse the motor upon the control circuit detecting the increased current condition so that the rotary cutter rotates in the second rotational direction that is opposite the first rotational direction.

6. The shaving apparatus according to claim 5 wherein the control circuit is configured to rotate the rotary cutter a predetermined angle of rotation in the second rotational direction upon the control circuit detecting the increased current condition.

7. The shaving apparatus according to claim 6 wherein the increased current condition is a surge in the current being drawn from the power source by the electric motor.

8. The shaving apparatus according to claim 6 wherein the control circuit is configured to stop rotation of the motor upon completing rotation of the rotary cutter the predetermined angle of rotation in the second rotational direction.

9. The shaving apparatus according to claim 1 wherein the fixed blade contacts the rotary cutter.

10. The shaving apparatus according to claim 1 wherein the cutting edge of the fixed blade is elongated and linear.

11. The shaving apparatus according to claim 1 wherein the cutting edge of the fixed blade extends parallel to the rotational axis.

12. The shaving apparatus according to claim 1 wherein the control circuit further comprises a switch, the control circuit configured to open the switch to cut off power from the motor upon the control circuit detecting the increased current condition.

13. The shaving apparatus according to claim 1 wherein the increased current condition is a surge in the current being drawn from the power source by the electric motor, wherein the surge is defined, at least in part, by the current being drawn from the power source by the electric motor exceeding a predetermined current level threshold.

14. The shaving apparatus according to claim 1 wherein the increased current condition is a surge in the current being drawn from the power source by the electric motor, wherein the surge is defined, at least in part, by a rate of increase of the current being drawn from the power source by the electric motor exceeding a predetermined slope value.

15. A shaving apparatus comprising:

a power source;

a rotary cutter comprising a plurality of cutting edges, the rotary cutter rotatable about a rotational axis; and a fixed blade having a cutting edge, the fixed blade positioned adjacent the rotary cutter;

an electric motor operably coupled to the power source and the rotary cutter to rotate the rotary cutter about the rotational axis in a first rotational direction so that a user's hairs are sheared between the cutting edge of the fixed blade and the cutting edges of the rotary cutter; and a control circuit comprising a current sensing circuit and a user-perceptible output device, the control circuit operably coupled to the electric motor and the power source, the control circuit configured to continuously monitor a current being drawn by the electric motor and activate the user-perceptible output device upon the control circuit detecting a surge in the current being drawn by the electric motor.

16. The shaving apparatus according to claim 15 wherein the user-perceptible output device is selected from a group consisting of a light, a display screen, and a speaker.

17. The shaving apparatus according to claim 15 wherein the cutting edge of the fixed blade extends parallel to the rotational axis.

18. The shaving apparatus according to claim 15 wherein the fixed blade contacts the rotary cutter.

19. A shaving apparatus comprising:

a power source;

a rotary cutter comprising a plurality of first cutting edges, the rotary cutter rotatable about a rotational axis; and a first fixed blade having a first cutting edge, the first fixed blade positioned adjacent the rotary cutter;

an electric motor operably coupled to the power source and the rotary cutter; and a control circuit operably coupled to the electric motor and the power source, the control circuit configured to selectively: (1) rotate the rotary cutter about the rotational axis in a first rotational direction so that a user's hairs are sheared between the first cutting edge of the first fixed blade and the first cutting edges of the rotary cutter; and (2) rotate the rotary cutter about the rotational axis in a second rotational direction, the second rotational direction being opposite the first rotational direction; and wherein the control circuit is configured to automatically select between rotating the rotary cutter in the first rotational direction and rotating the rotary cutter in the second rotational direction.

* * * * *